US012582282B2

(12) United States Patent
Jung et al.

(10) Patent No.: US 12,582,282 B2
(45) Date of Patent: Mar. 24, 2026

(54) CUP WASHER

(71) Applicant: LG ELECTRONICS INC., Seoul (KR)

(72) Inventors: Taeyong Jung, Seoul (KR); Miseong Kim, Seoul (KR); Hyo Keun Park, Seoul (KR); Sejae Oh, Seoul (KR); Gyeoung Jin Jeon, Seoul (KR); Jaewoo Jin, Seoul (KR); Changwoo Sung, Seoul (KR); Charyeom Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 25 days.

(21) Appl. No.: 18/372,354

(22) Filed: Sep. 25, 2023

(65) Prior Publication Data

US 2024/0099544 A1 Mar. 28, 2024

(30) Foreign Application Priority Data

| | | |
|---|---|---|
| Sep. 26, 2022 | (KR) | 10-2022-0121431 |
| Jun. 30, 2023 | (KR) | 10-2023-0084952 |
| Aug. 8, 2023 | (KR) | 10-2023-0103272 |

(51) Int. Cl.

| | |
|---|---|
| ***A47L 15/00*** | (2006.01) |
| ***A47L 15/42*** | (2006.01) |
| ***A47L 15/44*** | (2006.01) |
| ***A47L 15/46*** | (2006.01) |
| ***A47L 15/48*** | (2006.01) |
| ***A47L 15/50*** | (2006.01) |

(52) U.S. Cl.

CPC ..... *A47L 15/0065* (2013.01); *A47L 15/4225* (2013.01); *A47L 15/4246* (2013.01); *A47L 15/4257* (2013.01); *A47L 15/4272* (2013.01); *A47L 15/4418* (2013.01); *A47L 15/46* (2013.01); *A47L 15/48* (2013.01); *A47L 15/506* (2013.01)

(58) Field of Classification Search

None

See application file for complete search history.

(56) References Cited

U.S. PATENT DOCUMENTS

| | | | |
|---|---|---|---|
| 3,465,761 | A | 9/1969 | Meeker et al. |
| 4,832,064 | A | 5/1989 | Nezworski |
| 6,581,614 | B1 | 6/2003 | Gotfried |
| 2020/0034688 | A1 | 1/2020 | Lim et al. |
| 2022/0104681 | A1 | 4/2022 | Beck et al. |
| 2022/0104981 | A1 | 4/2022 | Jones |

FOREIGN PATENT DOCUMENTS

| | | | |
|---|---|---|---|
| AU | 24310 71 | A | 7/1972 |
| CN | 110730625 | A | 1/2020 |
| CN | 111973120 | A | 11/2020 |
| CN | 212213682 | U | 12/2020 |
| CN | 215650973 | U | 1/2022 |

(Continued)

*Primary Examiner* — Levon J Shahinian

(74) *Attorney, Agent, or Firm* — Birch, Stewart, Kolasch & Birch, LLP

(57) ABSTRACT

A cup washer includes a base plate, a water tank disposed on the base plate and configured to store water for washing a cup, and a washing unit disposed above the water tank and configured to wash an accommodated cup, wherein a vertical length of the cup washer is formed to be larger than a length of the base plate.

18 Claims, 66 Drawing Sheets

(56) References Cited

FOREIGN PATENT DOCUMENTS

| | | | |
|---|---|---|---|
| CN | 216020886 | U | 3/2022 |
| DE | 1 916 677 | U | 5/1965 |
| DE | 42 33 934 | A1 | 4/1994 |
| EP | 2 559 369 | A2 | 2/2013 |
| EP | 2 656 772 | A2 | 10/2013 |
| GB | 1 526 092 | A | 9/1978 |
| JP | 9-215653 | A | 8/1997 |
| JP | 11-290261 | A | 10/1999 |
| JP | 2003-24261 | A | 1/2003 |
| JP | 2010-36023 | A | 2/2010 |
| JP | 2016-98331 | A | 5/2016 |
| KR | 94-20198 | U | 9/1994 |
| KR | 10-2006-0068402 | A | 6/2006 |
| KR | 10-0686198 | B1 | 2/2007 |
| KR | 10-0700539 | B1 | 3/2007 |
| KR | 10-2009-0022896 | A | 3/2009 |
| KR | 10-2012-0022222 | A | 3/2012 |
| KR | 10-2013-0040919 | A | 4/2013 |
| KR | 10-2014-0099692 | A | 8/2014 |
| KR | 10-2014-0101631 | A | 8/2014 |
| KR | 10-2017-0012945 | A | 2/2017 |
| KR | 10-1803315 | B1 | 11/2017 |
| KR | 10-2019-0099151 | A | 8/2019 |
| KR | 10-2052837 | B1 | 12/2019 |
| KR | 10-2020-0016470 | A | 2/2020 |
| KR | 10-2114048 | B1 | 5/2020 |
| KR | 10-2021-0063953 | A | 6/2021 |
| KR | 10-2021-0069541 | A | 6/2021 |
| KR | 10-2283226 | B1 | 7/2021 |
| KR | 10-2395273 | B1 | 5/2022 |
| WO | WO 03/011486 | A1 | 2/2003 |
| WO | WO 2013/036468 | A1 | 3/2013 |
| WO | WO 2022/164158 | A2 | 8/2022 |
| WO | WO 2022/194952 | A1 | 9/2022 |

CUP WASHER

CROSS-REFERENCE TO RELATED APPLICATIONS

This application claims priority to and benefit of Korean Patent Application Nos. 10-2022-0121431 filed on Sep. 26, 2022, 10-2023-0084952 filed on Jun. 30, 2023, and 10-2023-0103272 filed on Aug. 8, 2023, which are hereby incorporated by reference as if fully set forth herein.

BACKGROUND

Technical Field

The present disclosure relates to a cup washer, and more specifically, to a cup washer for washing a cup carried by a user.

Background Information

Contents described in this section simply provide background information on the present disclosure and do not constitute the related art.

Recently, in order to prevent environmental pollution, the frequency of provision of disposable cups to customers is reduced at stores where beverages are sold, and the trend in which a customer who visits a store carries a multi-use cup, such as a tumbler, and takes out the multi-use cup filled with a beverage is increasing.

In order to provide convenience to customers, that is, users of multi-use cups, it is necessary to provide a cup washer for washing a cup carried by the user in a store and allow the user to conveniently wash the cup carried by the user.

The related art related to a cup washer is disclosed in Korean Utility Model Publication No. 94-20198 (Patent Document 1) and Korean Patent Application Laid-Open No. 10-020-0016470 (Patent Document 2).

However, since a cup washer disclosed in Patent Document 1 requires a user to hold a cup or a brush while washing the cup, there is a problem that causes inconvenience for the user who washes the cup.

In addition, in Patent Document 1, there is no structure for drying a cup to remove the water after washing the cup, resulting in a user's inconvenience.

Therefore, the cup washer needs to be designed to have a structure in which the user may conveniently use, a volume of the cup may be reduced, and a position may be stably maintained without risk of tipping over.

In addition, it is necessary to design a cup washer having a structure for entirely and cleanly washing a cup by washing both the inside of the cup in which water, a beverage, or the like is contained and the outside of the cup in contact with the user's hand.

In addition, it is necessary to design a cup washer having a structure in which the user may conveniently use without bending down.

SUMMARY OF THE DISCLOSURE

The present disclosure is directed to providing a cup washer having a structure in which a user does not need to hold a cup while washing the cup.

In addition, the present disclosure is directed to providing a cup washer having a structure with a small space and that stably maintains a position.

In addition, the present disclosure is directed to providing a cup washer having a structure of supplying hot water to facilitate washing and providing a user's convenience by drying a cup to remove the remaining water after washing.

In addition, the present disclosure is directed to providing a cup washer having a structure to entirely clean a cup.

In addition, the present disclosure is directed to providing a cup washer having a structure in which a user may conveniently use the cup washer without bending down.

Objects of the present disclosure are not limited to the above-described objects, and other objects and advantages of the present disclosure that are not mentioned can be understood by the following description and will be more clearly understood by embodiments of the present disclosure. In addition, it will be able to be easily seen that the objects and advantages of the present disclosure may be achieved by devices and combinations thereof that are described in the claims.

A cup washer according to one embodiment includes a water tank configured to store water for washing a cup, a washing unit disposed above the water tank and including a tub configured to accommodate the cup, and a door disposed on the washing unit to be hinge-rotated in a vertical direction and configured to open and close open upper portions of the tub and the washing unit.

The door may be disposed on an upper end of the washing unit and provided to open and close the tub, and thus a user may conveniently use the cup washer by opening or closing the door without bending down.

The center of gravity of the cup washer may be lowered due to a load of the water tank fully filled with water, which is disposed on a lower portion of the cup washer. Therefore, it is possible to effectively suppress a tower-shaped cup washer having a relatively longer height than the dimensions of the cross-sectional area from tipping over by an external impact.

The cup washer may include an intermediate plate disposed between the water tank and the washing unit and configured to support the washing unit, and a frame supported by the base plate, coupled to the intermediate plate, and supporting the washing unit.

The frame may include a front support of which a lower portion is coupled to the base plate and of which a longitudinal direction is disposed in a vertical direction, a rear support of which a lower portion is coupled to the base plate and a longitudinal direction is disposed in the vertical direction, an intermediate support which is disposed between the front support and the rear support and of which a lower portion is coupled to the base plate and a longitudinal direction is disposed in the vertical direction, and an upper support which is disposed above the intermediate support, of which a longitudinal direction is disposed in a front-rear direction, and to which the washing unit is coupled.

Therefore, components provided on the upper portion of the cup washer in addition to the washing unit may be supported by the frame, and the components may be ultimately supported by the base plate.

In the cup washer according to the embodiment, the cup may be accommodated inside the tub, and a spray device may spray water to the entire inside of the tub. Therefore, water may be sprayed into the tub and spread therein.

With this structure, the water sprayed from the spray device may collide with both an inner surface and an outer surface of the cup to wash the surfaces of the cup to remove any foreign substances.

The washing unit configured to accommodate and wash the cup may be provided on the upper portion of the cup washer. The washing unit may be opened or closed by the door. At this time, the door may be hinge-rotated in the vertical direction of the cup washer to open and close the washing unit.

With this structure, a user may conveniently wash the cup without bending down by operating the cup washer after manually opening the door to put the cup on the washing unit and re-closing the door.

A cup washer according to one embodiment includes a base plate, a water tank disposed on the base plate and configured to store water for washing a cup, and a washing unit disposed above the water tank and configured to wash an accommodated cup, wherein a vertical length of the cup washer is formed to be larger than a length of the base plate.

The washing unit may include a tub in which the cup is accommodated, and the tub may be disposed in an upper portion of the cup washer and may have an opening in an upper portion thereof The cup washer according to one embodiment may further include a door disposed on the tub and configured to open and close the opening of the tub.

The door may be provided to open the opening by rotating upward from the cup washer.

The cup washer according to one embodiment may further include a top cover disposed above the tub, and the door may be coupled to the top cover to be hinge-rotated.

The washing unit may include a sump connected to the tub and configured to store water sprayed from the tub, and a circulation pump connected to the tub and the sump and configured to circulate water between the tub and the sump.

The sump and the circulation pump may be disposed between the tub and the water tank.

The cup washer according to one embodiment may further include a drying module disposed to be connected to the tub and configured to blow heated air for drying into the tub, and a liquid input module configured to inject at least one of detergent or rinse into the tub.

The drying module and the liquid input module may be disposed at a rear of the tub.

The liquid input module may include a detergent storage configured to store the detergent, a rinse storage disposed separately from the detergent storage and configured to store the rinse, a detergent injection part connected to the detergent storage and the tub and configured to inject the detergent into the tub, a rinse injection part connected to the rinse storage and the tub and configured to inject the rinse into the tub, a detergent pump connected to the detergent injection part and configured to pump the detergent to the tub, and a rinse pump connected to the rinse injection part and configured to pump the rinse to the tub.

The cup washer according to one embodiment may further include an intermediate plate disposed above the water tank, a first circuit board disposed behind the water tank and including a controller configured to control an operation of the cup washer, and a board support of which a lower portion is coupled to the base plate and an upper portion is coupled to the intermediate plate and to which the first circuit board is coupled.

The cup washer according to one embodiment may further include a supply pipe configured to supply detergent and rinse to the tub, wherein the first circuit board and the supply pipe may be disposed at positions spaced apart from the water tank and the washing unit behind the water tank.

The cup washer according to one embodiment may further include a frame supported by the base plate, a front panel configured to cover the water tank, and a rear panel coupled to the frame to cover a rear of the cup washer.

The frame may include a pair of front supports which are disposed to be spaced apart from each other at a front of the cup washer and of which a lower portion is coupled to the base plate, and a rear support which is disposed at a rear of the cup washer and of which a lower portion is coupled to the base plate.

The front panel may include a first wall forming a front of the cup washer, a pair of second walls provided to be bent at both ends of the first wall, second coupling protrusions protruding from end portions of the second walls and coupled to the rear support, and third coupling protrusions protruding from upper end portions of the first wall and the second walls to suppress separation of the front panel.

The third coupling protrusion may include a fitting portion, and a hook formed to be surrounded by the fitting portion, formed to have a V-shaped cross section, and provided to be elastically deformed.

The frame may include an intermediate support which is disposed between the front support and the rear support and of which a lower portion is coupled to the base plate.

A cup washer according to another embodiment may include a base plate, a water tank disposed on the base plate and configured to store water for washing a cup, a tub disposed in an upper portion of the cup washer and configured to accommodate the cup, and an intermediate plate disposed between the water tank and the tub, partitioning the water tank and the tub, and supporting the tub.

The cup washer may further include a frame which is supported by the base plate and to which the intermediate plate is coupled, a front panel configured to cover the water tank and the tub, a rear panel coupled to the frame to cover a rear of the cup washer, and an exterior part coupled to the rear panel.

The frame may include a pair of front supports which are disposed to be spaced apart from each other at a front of the cup washer and of which a lower portion is coupled to the base plate, and a rear support which is disposed at a rear of the cup washer and of which a lower portion is coupled to the base plate.

The washing unit according to one embodiment may include a tub in which the cup is accommodated, a drain pump disposed under the tub, and a pipe assembly which is coupled to an outer surface of a sidewall of the tub and connected to the drain pump and a drainpipe and in which a flow path through which water introduced into the drain pump flows is formed.

The tub may include a first through hole formed to pass through the sidewall thereof, and the pipe assembly may include a second through hole connected to the first through hole.

The pipe assembly may include an assembly body which is coupled to the tub and in which the flow path through which water flows is formed, and an assembly cover coupled to the assembly body and configured to cover an exposed portion of the assembly body.

The assembly cover may be fixedly coupled to the assembly body by a thermal fusion method.

The tub may include a coupling surface which is formed on a portion of the sidewall to which the assembly body is coupled and formed by recessing at least a portion of the sidewall and in which the first through hole is formed.

The assembly body may include a space forming portion which is formed as a space therein and in which the second through hole is formed, a first flow pipe which protrudes to the outside of the space forming portion, through which water flows, and which is connected to the drain pump, and a second flow pipe which protrudes to the outside of the space forming portion, through which water flows, and which is disposed to be spaced apart from the first flow pipe and connected to the drainpipe.

The space forming portion may include a first region provided as a space and connected to the second through hole, and a second region provided as a space and connected to the first flow pipe and the second flow pipe.

The space forming portion may include a third region provided as a space and disposed between the first region and the second region, a first diaphragm configured to separate the first region and the second region, and a second diaphragm configured to separate the second region and the third region.

The space forming portion may include a first through space formed to pass through the first diaphragm and connecting the first region to the third region, and a second through space formed to pass through the second diaphragm and connecting the second region to the third region.

The second through hole may be disposed in a lower portion of the first region, the first through space may be formed in upper portions of the first region and the third region, and the second through space may be formed in lower portions of the second region and the third region.

In the cup washer according to the present disclosure, the cup washer may have a tower-like shape with a relatively smaller planar cross-sectional area and a relatively larger vertical length. Since the cup washer is provided in the tower shape and thus has a smaller planar cross section, it is possible to reduce a volume of the cup washer, thereby increasing space efficiency.

In addition, in the cup washer according to the present disclosure, it is possible to lower the overall center of gravity of the cup washer due to a load of the water tank fully filled with water, which is disposed on the lower portion of the cup washer. Therefore, the cup washer provided in a tower shape with a relatively larger length in a vertical direction may maintain a stable state without easily tipping over even in the event of an external impact.

In addition, in the cup washer according to the present disclosure, since the cup washer is provided to be hinge-rotated in the vertical direction of the cup washer on an upper end of the washing unit, the user may conveniently use the cup washer by opening or closing the door without bending down. In addition, with this structure, since no additional space for opening the door is required, it is possible to increase space efficiency.

In addition, in the cup washer according to the present disclosure, components provided on the upper portion of the cup washer in addition to the washing unit may be supported by the frame, and the components may be ultimately supported by the base plate. With this structure, the components may be stably supported by the frame and the base plate even in a state in which relatively heavier components such as the washing unit are provided on the upper portion of the cup washer.

In addition, in the cup washer according to the present disclosure, guide protrusions may be provided on a first coupling protrusion, and guide holes fitted onto the guide protrusion may be provided in the supports. When the guide protrusions are fitted into the guide holes, the holes formed in the supports and the first coupling protrusions for fastening with the fasteners may correspond to each other at accurate positions without being misaligned. Therefore, an operator may couple the supports to a first part by easily fastening the fasteners to the holes.

In addition, in the cup washer according to the present disclosure, a drying module configured to blow heated air into the tub may be provided in the washing unit. Therefore, by drying surfaces of the cup having any remaining water thereon using the drying module after the water washing is completed, it is possible to provide the user's convenience and increase the washing efficiency of the cup washer.

In addition, in the cap washer according to the present disclosure, both an inner surface of the cup containing water, beverages, or the like and an outer surface of the cup touched by a user' hand may be exposed to the sprayed water, and the water may collide with both the inner surface and the outer surface of the cup. Therefore, the cup washer may entirely and cleanly wash the inner surface and the outer surface of the cup at the same time.

In the cup washer according to the present disclosure, the door may be rotatably supported by a hinge support to be rotated in the vertical direction. In addition, the door may be disposed above the washing unit. Therefore, the user may open or close the door using the door being hinge-rotated. Therefore, since the user may open or close the door with a relatively smaller motion without bending down, such a structure may provide the user's convenience.

In addition, in the cup washer according to the present disclosure, when the door is opened in a closed state, the door may be hinge-rotated in the vertical direction, and thus a link part and a rack may move up together. Conversely, when the door in the open state is closed, the door may be hinge-rotated downward, and thus the link part and the rack may move downward together.

Therefore, when the user opens the door, the link part and the rack may move up together, and the user may mount the cup on the rack or take the cup out from the rack without bending down, and such a structure may provide the user's convenience.

In the cup washer according to the present disclosure, a detergent injection device and a rinse injection device may be separately disposed outside the tub in the washing unit. Water flowing into the tub 1 may be mixed with detergent or rinse by the detergent injection device or the rinse injection device.

Therefore, when the cup is washed by spraying water, the washing water in which water and detergent are mixed may be sprayed to the cup, thereby increasing the washing efficiency for the cup. In addition, when the cup is rinsed after being washed, the washing water in which water and rinse are mixed may be sprayed to the cup to effectively rinse the cup.

In addition, in the cup washer according to the present disclosure, a detergent pump and a rinse pump may be connected to the controller provided in the cup washer to operate at a time point set by the controller to inject detergent or rinse into the tub to be mixed with water in the tub. A manager may periodically replenish detergent and rinse in the detergent storage and rinse storage.

Therefore, a user who intends to wash his/her cup may conveniently use detergent increases the washing efficiency for the cup, and cleanly rinses the cup using rinse after washing the cup without having to perform a separate operation for adding detergent and rinse to water.

In addition, in the cup washer of the present disclosure, the rinse may flow into the tub through a second connecting pipe, a three-way fitting, a first connecting pipe, and a washing water inlet. On the other hand, detergent may be introduced through a detergent inlet connected through a separate pipe. In addition, time points at which the detergent and the rinse flow into the tub may be different.

With this structure, paths through which the detergent and the rinse are injected into the tub may be separated so that the detergent and the rinse are not mixed, thereby increasing the efficiency of the washing operation and the rinsing operation of the cup washer.

In addition, in the cup washer of the present disclosure, water and rinse may meet and flow in one pipe to flow into the tub through the washing water inlet. Therefore, the water and the rinse may be more uniformly mixed while flowing, and the washing water in which the water and the rinse are uniformly mixed may be sprayed to the cup, and thus the rinsing operation of the cup may be effectively performed.

In addition, in the cup washer according to the present disclosure, the rack may include a first flow path guide unit configured to guide a flow direction of water at a position adjacent to the washing water inlet of the tub. Therefore, the water flowing into the tub may flow toward the detergent flowing into the tub by the first flow path guide unit. Therefore, since the flowing water is mixed with the detergent, it is possible to easily mix the water with the detergent and increase the washing efficiency of the cup washer.

In the cup washer according to the present disclosure, the washing unit may include a drying module including a blowing fan and an air heating unit. By blowing warm air to the cup accommodated in the tub using the drying module after washing the cup with water, it is possible to provide the dried cup to a user, thereby promoting the user's convenience.

In addition, in the cup washer according to the present disclosure, an air flow path unit including a rising portion, a lateral extension, and a falling portion may be formed entirely in an inverted U shape. With this structure, when viewed based on the air flow path unit, the air inlet hole of the tub may be disposed under the lateral extension.

Therefore, the water flowing into the air flow path unit from the sump through the air inlet hole may not rise from the falling portion to the lateral extension due to gravity. With this structure, it is possible to effectively suppress the water in the sump from flowing back through the air flow path unit and flowing into the blowing fan.

In addition, in the cup washer according to the present disclosure, a water roof may be formed on a lower end portion of the rising portion constituting the air flow path unit. The water condensed on a surface of the drying module may flow down while avoiding the blowing fan by the water roof. Therefore, since the condensed water flowing into the blowing fan is blocked, it is possible to effectively prevent a malfunction or failure of the blowing fan.

In addition, in the cup washer according to the present disclosure, water flowing into a third duct through an air discharge hole may not be discharged to the outside because it is blocked by a stepped portion. In addition, an inner bottom surface of the third duct may be formed to be inclined downward toward the tub. Therefore, the water flowing into the third duct may re-flow back to the tub by gravity.

With this structure, it is possible to effectively suppress the water flowing into the air discharge unit through the air discharge hole from being discharged to the outside of the cup washer, thereby reducing the user's inconvenience caused by the discharge of water through the air discharge hole.

In addition, in the cup washer according to the present disclosure, the drying module may be disposed above the water tray, and a circulation pump may be disposed thereunder. In addition, the water tray may be disposed to protrude in the lateral direction, and when viewed in the vertical direction of the cup washer, the water tray may cover the circulation pump from an upper side.

With this structure, the water condensed on the surface of the drying module may flow down along the drying module to fall on an upper surface of the water tray. Therefore, it is possible to prevent water flowing down from the surface of the drying module to fall from flowing into the circulation pump. Therefore, it is possible to effectively suppress water from falling into the circulation pump and being in contact with electrical wirings and electrical components provided in the circulation pump to cause a malfunction or failure of the circulation pump.

In addition, in the cup washer according to the present disclosure, a pipe assembly can effectively suppress the backflow of contaminated water from a drainpipe to the drain pump by raising a portion of a discharge line of water connected to an outlet of the drain pump to prevent the water flowing from the drainpipe to the drain pump from exceeding a height of the pipe assembly.

In addition, in the cup washer according to the present disclosure, since a first through hole is formed in the tub, a second through hole is formed in the pipe assembly, and air flows into the pipe assembly through the first through hole and the second through hole, it is possible to prevent the occurrence of a siphon phenomenon of a drain line connected to the drain pump, thereby maintaining a water level set inside the tub when the drain pump is not operated. Therefore, it is possible to effectively wash the cup using the circulation pump after collecting water in the tub.

In addition, in the cup washer according to the present disclosure, a space forming portion entirely has a labyrinth-shaped structure, and thus since an obstacle having a complicated structure is disposed on a flow path in which water in a first region flows into the tub through the second through hole, it is possible to minimize an amount of contaminated water of the pipe assembly flowing into the tub. Therefore, it is possible to effectively suppress the contaminated water from contaminating the cup accommodated in the tub after flowing into the tub through the first through hole.

Specific effects together with the above-described effects are described with a description of the following detailed matters for carrying out the disclosure.

DETAILED DESCRIPTION

Figure 1:
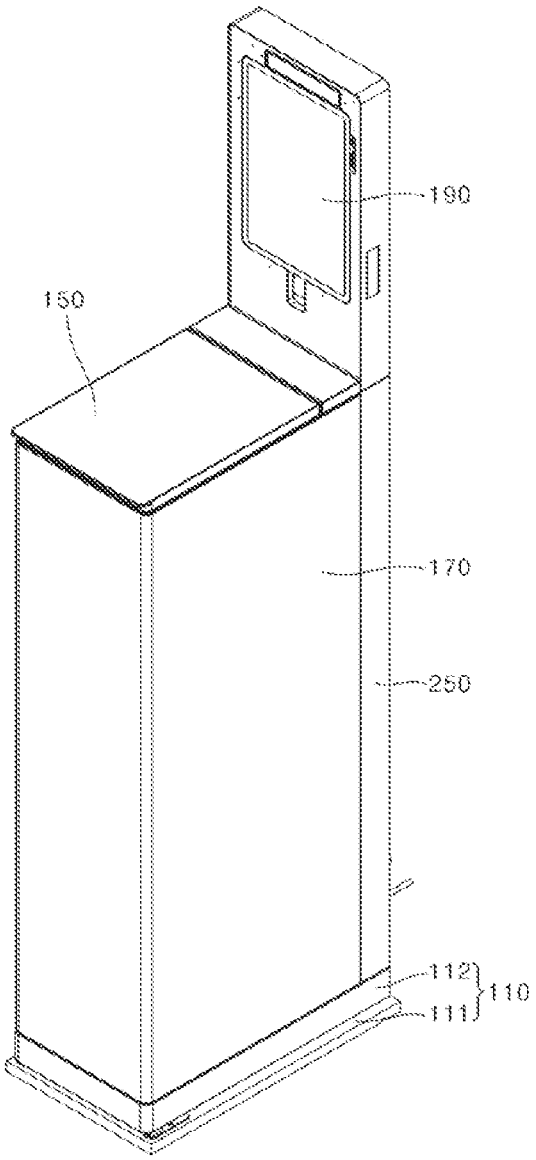
FIG. 1 is a perspective view illustrating a cup washer according to one embodiment.

The above-described objects, features, and advantages will be described below in detail with reference to the accompanying drawings, and thus those skilled in the art to which the present disclosure pertains will be able to easily carry out the technical spirit of the present disclosure. In describing the present disclosure, when it is determined that a detailed description of the known technology related to the present disclosure may unnecessarily obscure the gist of the present disclosure, a detailed description thereof will be omitted. Hereinafter, preferred embodiments according to the present disclosure will be described in detail with reference to the accompanying drawings. In the drawings, the same reference numerals are used to indicate the same or similar components.

Although the terms first, second, and the like are used to describe various components, it goes without saying that these components are not limited by these terms. These terms are only used to distinguish one component from another component, and unless otherwise stated, it goes without saying that the first component may also be the second component.

Throughout the specification, unless otherwise stated, each component may be provided as one or more components.

The singular expression used herein includes the plural expression unless the context clearly dictates otherwise. In the application, terms such as "composed of" or "comprising" should not be construed as necessarily including all of the various components or operations described in the specification and should be construed as not including some of the components or some of the operations or further including additional components or operations.

Throughout the specification, when "A and/or B" is described, this means A, B, or A and B unless otherwise specified, and when "C to D" is described, this means C or more and D or less unless otherwise specified.

Throughout the specification, the term "vertical direction" is a vertical direction of a cup washer in a state in which the cup washer is installed for daily use. The term "lateral direction" is a direction perpendicular to the vertical direction, and the term "front-rear direction" is a direction perpendicular to both the vertical direction and the lateral direction. The term "both side directions" or "side direction" has meaning including the lateral direction and the front-rear direction.

Figure 2:
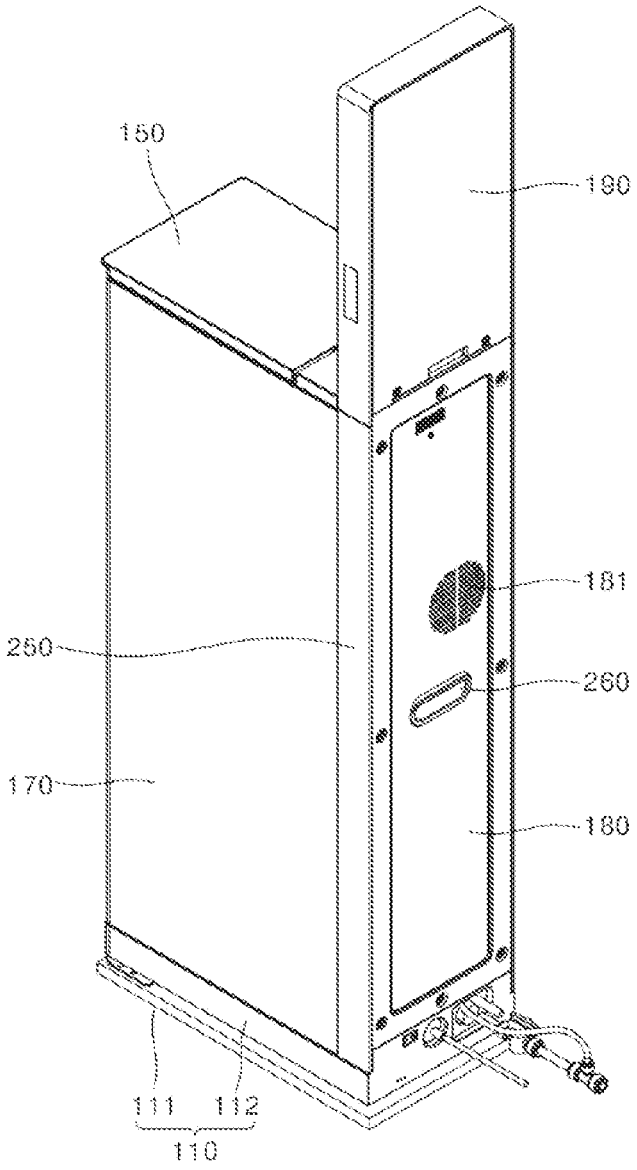
FIG. 2 is a view illustrating the cup washer of FIG. 1 in another direction.

FIG. 1 is a perspective view illustrating a cup washer according to one embodiment. FIG. 2 is a view illustrating the cup washer of FIG. 1 in another direction.

The cup washer according to the embodiment may be provided, for example, in stores where beverages are provided. Users of the cup washer may be customers who buy and drink beverages. In order to protect an environment, provision of disposable cups to customers in service stores has recently been restricted, and a range of such a restriction is gradually expanding.

Therefore, a cup washer may be provided in a service store so that users who carry multi-use cups may use a cup after washing the cup in the service store. A cup to be washed may be a multi-use cup such as a tumbler carried by a user. Therefore, the cup washer may have a structure which may be conveniently by a user.

A washing unit 130 for accommodating and washing a cup may be provided in an upper portion of the cup washer. The washing unit 130 may be disposed above a water tank 120 and wash the accommodated cup, The washing unit 130 may be opened or closed by a door 150. At this time, the door 150 may be hinge-rotated in a vertical direction of the cup washer to open or close the washing unit 130. The door 150 may be coupled to a top cover 210 to be hinge-rotated.

With this structure, a user may conveniently wash a cup without bending down by operating the cup washer after manually opening the door 150 to put the cup on the washing unit 130 and re-closing the door 150.

Meanwhile, in the cup washer, it is necessary to supply water for washing to the washing unit 130. Water may be supplied to the washing unit 130 through a pipe connected to a city water supply. For example, water may be directly supplied to the tub 131 provided in the washing unit 130 through the city water supply. In another embodiment, water may be stored in the water tank 120 disposed under the washing unit 130 and then supplied to the tub 131.

A height of the washing unit 130 in the cup washer needs to be appropriately adjusted to fit an adult's body so that the user may use the cup washer without bending down. In addition, in order to increase space efficiency, the cup washer needs to have a relatively smaller volume.

For this reason, the cup washer may have a tower-like shape with a relatively smaller planar cross-sectional area and a relatively larger vertical length. Due to the tower-like shape, relatively larger components in the cup washer need to be disposed in a vertical direction.

For example, the cup washer may be entirely formed in a tower shape of which a vertical length is formed to be larger than a length of a base plate 110.

In order to reduce a space required for arrangement and use of the cup washer, an open portion of the tub 131 of the washing unit 130 may be disposed to face upward in the cup washer. In addition, in order to save the space, the door 150 for opening and closing the open portion of the tub 131 may be provided to be hinge-rotated in the vertical direction of the cup washer on the upper portion of the cup washer.

Since the door 150 is hinge-rotated on the upper portion of the cup washer, the risk of tipping over of the cup washer may increase.

In addition, since a vibration generator such as a motor is provided in the washing unit 130 disposed on the upper portion of the cup washer in addition to the washing unit 130 including motors such as a drying module 132 and a circulation pump 134 that generate vibrations, the vibrations generated on the upper portion of the cup washer may increase the risk of tipping over of the cup washer. In addition, the cup washer may have an increased risk of tipping over due to the tower-like shape provided to extend in the vertical direction.

In order to suppress the tipping over of the cup washer, it is necessary to lower the overall center of gravity by arranging relatively heavier components on a lower portion of the cup washer.

Figure 3:
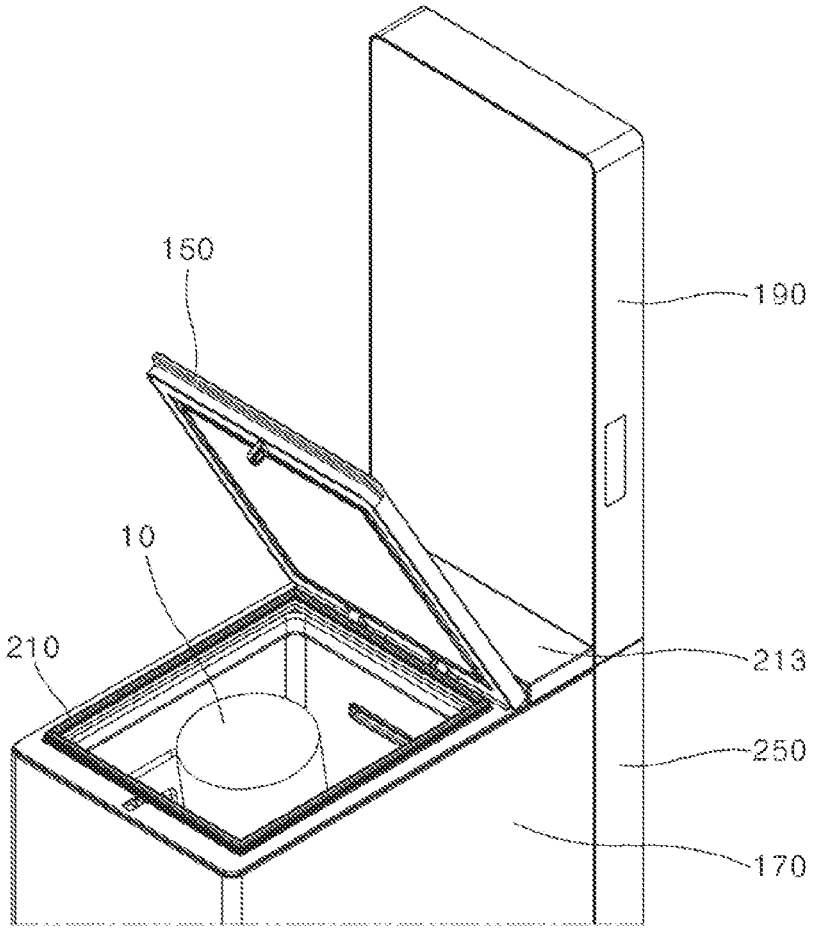
FIG. 3 is a view illustrating a state in which a door is open in the cup washer according to one embodiment.
Figure 4:
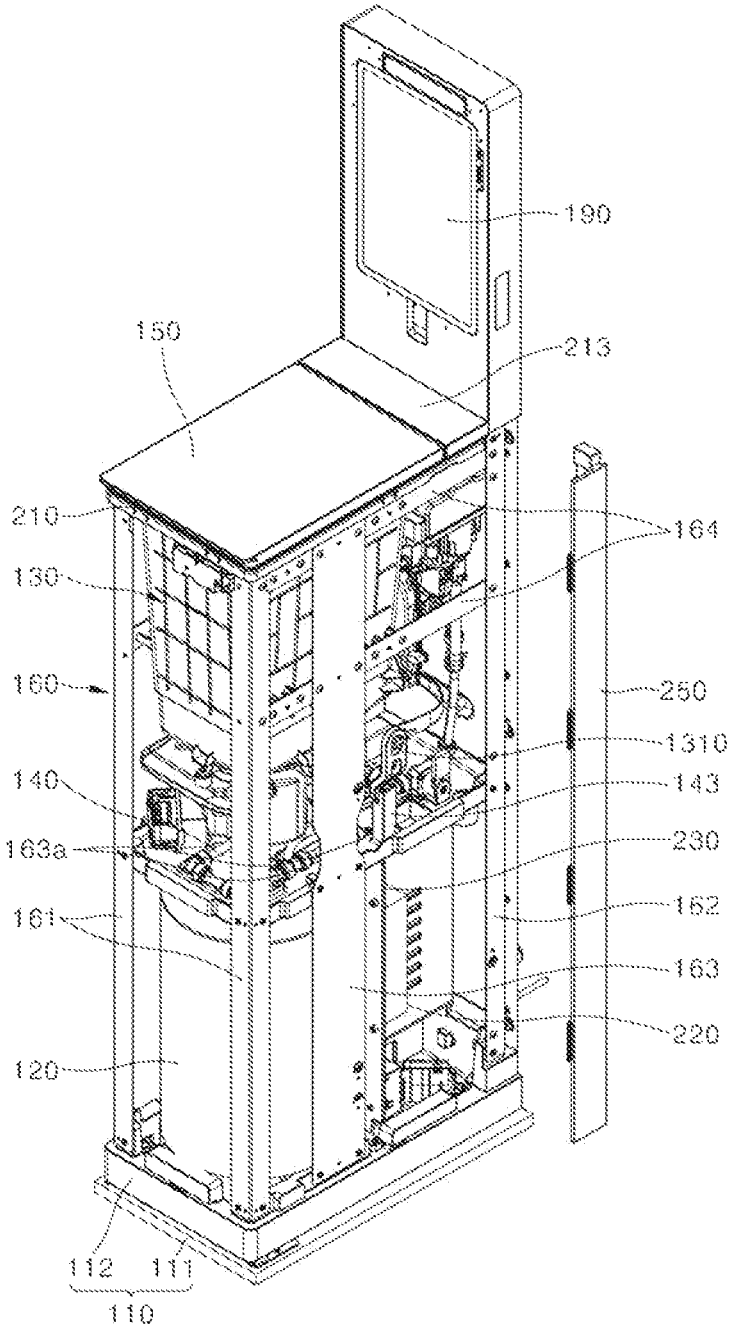
FIG. 4 is a perspective view illustrating the cup washer from which some components are omitted.
Figure 5A:
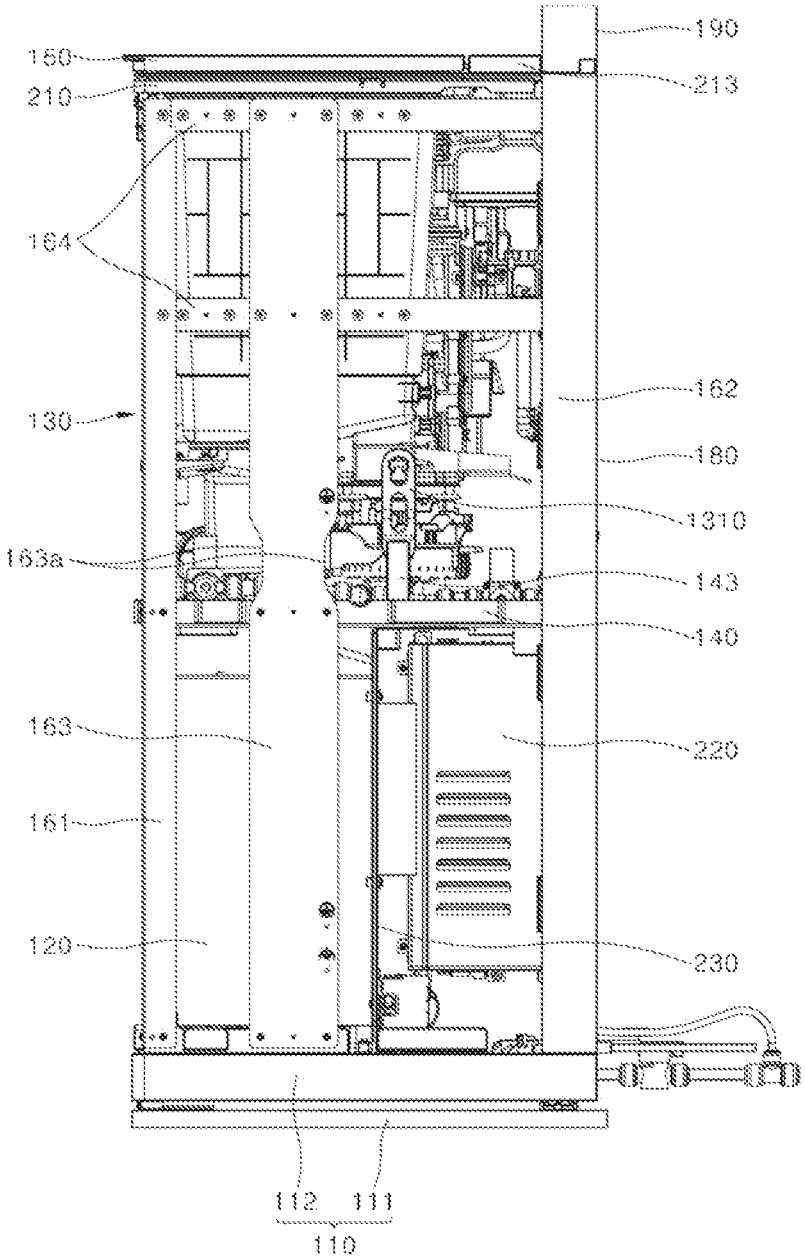
FIG. 5A is a side view illustrating the cup washer of FIG. 4.

Hereinafter, a structure of the cup washer will be described in more detail with reference to the drawings. FIG. 3 is a view illustrating a state in which the door 150 is open in the cup washer according to one embodiment. FIG. 4 is a perspective view illustrating the cup washer from which some components are omitted. FIG. 5A is a side view illustrating the cup washer of FIG. 4.

The cup washer according to one embodiment may include the base plate 110, the water tank 120, the washing unit 130, an intermediate plate 140, the door 150, and a frame 160.

The base plate 110 may be disposed on a lowermost portion of the cup washer to support other components of the cup washer. A lower portion of the base plate 110 may be disposed on the ground. The base plate 110 may include a first part 111 and a second part 112. The first part 111 may have a lower surface disposed on the ground and support the second part 112.

The second part 112 may be disposed above the first part 111, and the water tank 120 may be disposed on the second part 112. The frame 160 may be coupled to the second part 112. For example, front supports 161, rear supports 162, and intermediate supports 163 may be coupled to the second part 112. Therefore, the frame 160 may be supported by the second part 112.

The water tank 120 may be disposed above the base plate 110 to store water for washing the cup. The water tank 120 may be connected to the city water supply using a pipe. Therefore, water in the city water supply may flow into the water tank 120 and may be stored therein. In addition, the water tank 120 may be connected to the washing unit 130 using a pipe. Therefore, water in the water tank 120 may flow into the washing unit 130 and may be used to wash a cup accommodated in the washing unit 130.

A heating device may be provided inside the water tank 120. The water in the water tank 120 may be heated by the heating device and flow into the washing unit 130. Therefore, it is possible to increase washing efficiency for the cup by washing the cup using the heated water.

In another embodiment, a separate water tank other than the water tank 120 may be disposed outside the cup washer, and the heating device may be provided in the separate water tank. That is, a separate water tank for supplying hot water connected to the cup washer with a pipe may be provided, and thus the cup washer may use hot water for washing by receiving the hot water directly from the outside.

The water tank 120 may be fully filled with water. Therefore, the water tank 120 fully filled with water may have a relatively larger load than other components. The water tank 120 may be disposed on the base plate 110 and disposed on the lower portion of the cup washer.

That is, the cup washer may have the washing unit 130 disposed on the upper portion thereof and the water tank 120 disposed on the lower portion thereof. Since the load of the water tank 120 fully filled with water is sufficiently larger than a load of the washing unit 130, it is possible to effectively suppress tipping over of the cup washer.

Due to the load of the water tank 120 fully filled with water, which is disposed on the lower portion of the cup washer, the overall center of gravity of the cup washer may be lowered. Therefore, the cup washer provided in a tower shape with a relatively larger length in the vertical direction may maintain a stable state without easily tipping over even in the event of an external impact.

The washing unit 130 may be disposed above the water tank 120 and wash the accommodated cup. A space for accommodating the cup may be formed in the washing unit 130. The washing unit 130 may be connected to the water tank 120 using a pipe. Therefore, water for washing may flow into the washing unit 130 from the water tank 120.

In another embodiment, the washing unit 130 may be directly connected to the city water supply bypassing the water tank 120. Therefore, depending on a user's selection, the cup may be washed using water introduced from the water tank 120 or the cup may be washed using water introduced directly from the city water supply.

The intermediate plate 140 may be disposed between the water tank 120 and the tub 131 to partition the water tank 120 and the tub 131 and may support the tub 131. The tub 131 may be disposed above the intermediate plate 140 based on the intermediate plate 140, and the water tank 120 may be disposed under the intermediate plate 140.

The intermediate plate 140 may be disposed between the water tank 120 and the washing unit 130 to support at least a portion of the washing unit 130. The washing unit 130 may be disposed above the intermediate plate 140, and the intermediate plate 140 may support a portion of the load of the washing unit 130. The intermediate plate 140 may have substantially a plate-like shape and may be coupled to the frame 160 at an edge thereof to be supported by the frame 160.

The door 150 may be disposed above the washing unit 130 and may be hinge-rotated in the vertical direction to open and close an open upper portion of the washing unit 130. Referring to FIG. 3, the door 150 may be hinge-rotated in the vertical direction of the cup washer. Therefore, a user may proceed with washing a cup 10 by manually opening the door 150 to put the cup 10 into the washing unit 130 and then closing the door 150.

The top cover 210 may be provided on an upper end of the washing unit 130. The top cover 210 may be disposed above the tub 131. A part of the top cover 210 may be coupled to an edge portion of the upper end of the washing unit 130, and the door 150 may be disposed thereon.

An inlet cover 213 may be provided on the other part of the top cover 210. The inlet cover 213 may open and dose inlets for detergent and rinse out into the washing unit 130 and may be detachably provided on the top cover 210.

A user may open or close the door 150 disposed on the upper end of the cup washer to put a cup into the washing unit 130 or take the cup out of the washing unit 130. At this time, since the door 150 is hinge-rotated in the vertical direction, the user may conveniently move the door 150 without bending down.

In addition, due to the hinge-rotation of the door 150, the door 150 may be provided so that an area of the cup washer is not changed in a state in which the door 150 is open. Therefore, since a planar cross-sectional area of the cup washer is constant regardless of whether the door 150 is opened or closed, no additional space is required to open the door 150.

In the embodiment, since the door may be provided to be hinge-rotated in the vertical direction of the cup washer at the upper end of the washing unit 130, the user may conveniently use the cup washer by opening or closing the door 150 without bending down. In addition, with this structure, since no additional space for opening the door 150 is required, it is possible to increase space efficiency.

The frame 160 may be supported by the base plate 110 and coupled to the intermediate plate 140 and support the washing unit 130. The frame 160 may provide an internal space of the cup washer and may be coupled to various components to support these components.

The frame 160 may include the front supports 161, the rear supports 162, the intermediate supports 163, and top supports 164. The components of the frame 160 may withstand loads of the washing unit 130, the door 150, and the like provided on the upper portion of the cup washer.

A pair of front supports 161 may be disposed to be spaced apart from each other on the front of the cup washer and have lower portions coupled to the base plate 110, and longitudinal directions thereof are disposed in the vertical direction. The pair of front supports 161 may be disposed at positions of the front of the cup washer, which are spaced apart from each other in a lateral direction of the cup washer and may form corner portions of the front of the cup washer.

The front supports 161 may be formed in an L-shaped cross section to form the corner portions of the cup washer. The front supports 161 may be coupled to the base plate 110 by fasteners such as screws.

A pair of rear supports 162 may be disposed to be spaced apart from each other on the rear of the cup washer and have lower portions coupled to the base plate 110, and longitudinal directions thereof are disposed in the vertical direction. The pair of rear supports 162 may be disposed at positions of the rear of the cup washer, which are spaced apart from each other in the lateral direction of the cup washer and disposed adjacent to corner portions of the rear of the cup washer. The rear supports 162 may be coupled to the base plate 110 by fasteners.

A pair of intermediate supports 163 may be disposed to be spaced apart from each other, may be disposed between the front supports 161 and the rear supports 162, and may have lower portions coupled to the base plate 110, and longitudinal directions thereof are disposed in the vertical direction. The pair of intermediate supports 163 may be disposed at positions of a central portion of the cup washer, which are spaced apart from each other in the lateral direction of the cup washer.

The intermediate supports 163 may be coupled to the base plate 110 by fasteners. In addition, the intermediate supports 163 may be coupled to the intermediate plates 140 and the upper supports 164 by the fasteners to stably maintain the positions and support the loads of the components of the cup washer.

A pair of recesses 163*a* having symmetrical shapes may be formed on central portions of the intermediate supports 163. When assembling or disassembling the cup washer, an operator can conveniently assemble or disassemble the cup washer by manually holding the recesses 163*a* of the intermediate supports 163.

The upper supports 164 may be disposed above the front supports 161 and the intermediate supports 163, and a pair of upper supports 164 may be disposed to be spaced apart from each other in the lateral direction, may have longitudinal directions disposed in a front-rear direction, and may be coupled to the washing unit 130. The pair of upper supports 164 may be disposed at positions of the upper portion of the cup washer, which are spaced apart from each other in the lateral direction of the cup washer.

The washing unit 130 may be coupled to the upper supports 164 by fasteners. Therefore, the upper supports 164 may support the load of the washing unit 130.

A plurality of upper supports 164 may be provided to be spaced apart from each other in the vertical direction of the cup washer. Therefore, in FIG. 5A and the like, an embodiment in which a total of four upper supports 164 including one pair provided at both sides of the cup washer, and one pair provided on the upper and lower portions of the cup washer are provided is illustrated. However, the number of upper supports 164 is not limited thereto.

Each of the upper supports 164 may be coupled to the front supports 161, the rear supports 162, and the intermediate supports 163. Therefore, the load of the washing unit 130 may be transmitted to the front supports 161, the rear supports 162, and the intermediate supports 163 through the upper supports 164 and finally transmitted to the base plate 110.

With this structure, the cup washer may stably support the washing unit 130 provided therein. The upper support 164 may be coupled to the front supports 161, the rear supports 162, and the intermediate supports 163 by fasteners such as a screw.

In the embodiment, components provided on the upper portion of the cup washer in addition to the washing unit 130 may be supported by the frame 160, and the components may be ultimately supported by the base plate 110. With this structure, the components may he stably supported by the frame 160 and the base plate 110 even in a state in which relatively heavier components such as the washing unit 130 are provided on the upper portion of the cup washer.

The cup washer may include a front panel 170 and a rear panel 180. The front panel 170 may be disposed on the front of the cup washer to cover the water tank 120, the tub 131, and the washing unit 130. The front panel 170 may be coupled to the rear support 162 of the frame 160 by a fastener.

The rear panel 180 may be coupled to the frame 160 to cover the rear of the cup washer. A first vent 181 for ventilating an inside and an outside of the cup washer may be provided on the rear panel 180. Air flowing into the drying module 132 to be described below may flow into the cup washer through the first vent 181.

A handle 260 for a user or a manager to hold the cup washer may be coupled to the rear panel 180 to facilitate the movement of the cup washer.

The cup washer may include a display unit 190 coupled to an upper portion of the rear support 162 and disposed at one side of the door 150. The display unit 190 may be disposed at one side of the upper portion of the cup washer, for example, at one side of the door 150 and provided to protrude from the door 150.

In order for a user to conveniently look at the display unit 190, the display unit 190 may be disposed on the upper portion of the cup washer so that a longitudinal direction thereof is disposed in the vertical direction of the cup washer, and a display surface may be disposed to face the front of the cup washer. Therefore, it is possible to improve the user's vision capable of looking at the contents displayed on the display unit 190.

Therefore, the user may look at the display unit 190 in the front of the cup washer. Various pieces of information on the use of the cup washer may be displayed on the display unit 190 in the form of images, texts, and videos.

The user may operate the cup washer or know an operating state of the cup washer by looking at the information displayed on the display unit 190. In addition, a command input device in which commands are inputted by, for example, a capacitive touch method may be provided on the display unit 190. Therefore, the user may control the operation of the cup washer using the display unit 190.

The cup washer may include a first circuit board 220 and a board support 230. The first circuit board 220 may be disposed at one side of the water tank 120, for example, behind the water tank 120, and may include a controller for controlling the operation of the cup washer. The first circuit board 220 may be disposed at the one side of the water tank 120 on the lower portion of the cup washer in which an extra space is formed due to the arrangement of the water tank 120 having a relatively smaller volume than the washing unit 130.

A lower portion of the board support 230 may be coupled to the base plate 110, an upper portion thereof may be coupled to the intermediate plate 140, and the first circuit board 220 may be coupled to the board support 230. The board support 230 may be stably coupled to the base plate 110 by a fastener.

The board support 230 may be used not only to fix the first circuit board 220, but also to fix a pipe disposed on the lower portion of the cup washer.

The first circuit board 220 may be coupled to the board support 230 and disposed to be spaced upward from the base plate 110. Therefore, even when water leaks in the water tank 120, pipes, or the like, water falls due to gravity and the water is collected in the base plate 110, it is possible to prevent the first circuit board 220 from being submerged.

In addition, the first circuit board 220 may be coupled to the board support 230 and disposed in a state of being upright inside the cup washer. Therefore, the first circuit board 220 may not be coupled to the rear panel 180, and thus since the rear panel 180 may be easily coupled to and separated from the cup washer without separately separating the first circuit board 220, it is possible to conveniently perform repair and maintenance of the rear panel 180.

In addition, the first circuit board 220 may be coupled to the board support 230 and disposed to be spaced apart from the water tank 120. Therefore, it is possible to suppress heat transmitted to the outside of the water tank 120 by hot water stored in the water tank 120 from being directly applied to the first circuit board 220, thereby effectively suppressing overheating of the first circuit board 220.

The first circuit board 220 and supply pipes for supplying detergent and rinse to the tub 131 may be disposed behind the water tank 120. The first circuit board 220 and the supply pipes of detergent and rinse may be disposed at positions spaced apart from the water tank 120 and the washing unit 130 behind the water tank 120.

Therefore, the replacement or repair work of the first circuit board 220 or the supply pipes may be performed without disassembling the water tank 120 and the washing unit 130 in order to replace or repair the first circuit board 220 and the supply pipes for detergent and rinse. Therefore, the maintenance and repair work of the cup washer can be made conveniently.

The cup washer may include an exterior part 250 coupled to the rear panel 180 to cover the rear support 162. A plurality of fasteners may be coupled to the rear support 162 for coupling with other components of the cup washer.

Therefore, a structure in which the rear support 162 to which the fastener is fastened is directly exposed to the outside may degrade a visual sense of beauty of the cup washer. Therefore, a structure of covering the rear support 162 to which the fastener is fastened is required.

The exterior part 250 may cover the rear support 162 and may be coupled to a relatively very fewer number of fasteners when compared to the rear support 162. With this structure, the exterior part 250 may be disposed outside the cup washer at a position corresponding to the rear support 162 to improve the simple look of the cup washer.

Figure 5B:
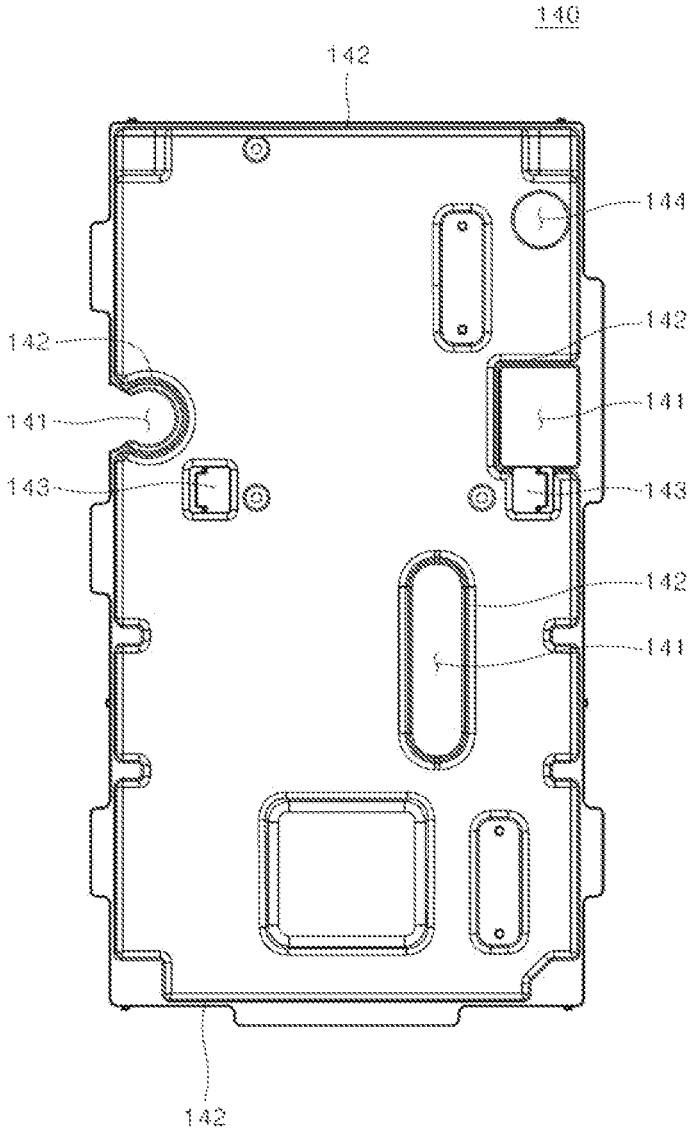
FIG. 5B is a plan view illustrating an intermediate plate according to one embodiment.
Figure 5C:
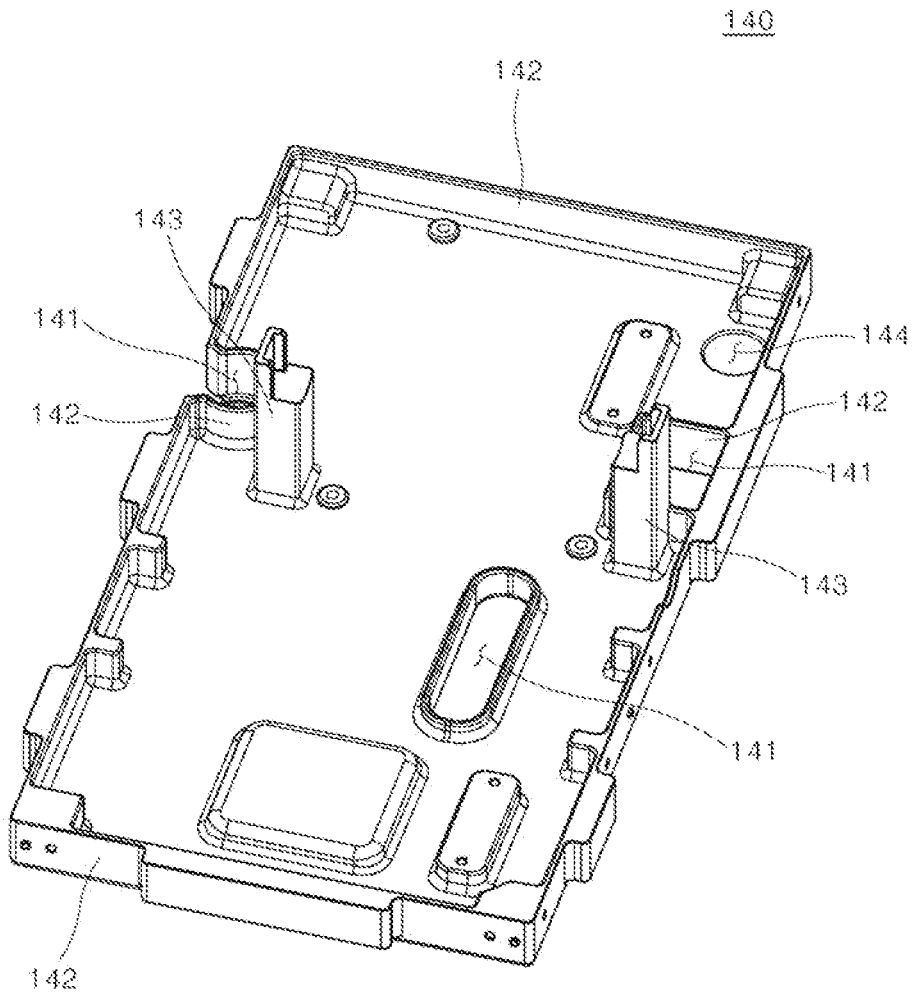
FIG. 5C is a perspective view illustrating the intermediate plate.

FIG. 5B is a plan view illustrating the intermediate plate 140 according to one embodiment. FIG. 5C is a perspective view illustrating the intermediate plate 140. The intermediate plate 140 may support a load of water contained in a portion of the washing unit 130 and the tub 131.

In addition, the intermediate plate 140 may be disposed between the washing unit 130 and the water tank, formed in substantially a plate shape, and disposed in a lateral direction of the cup washer. With this structure, the intermediate plate 140 can suppress the distortion of an exterior of the cup washer.

Based on the intermediate plate 140, the cup washer may be divided into a first floor on which the water tank, the first circuit board, and the like are disposed and a second floor on which the washing unit 130 is disposed. Since the intermediate plate 140 separates the first floor and the second floor, it is possible to suppress a fire from spreading to the other floor in the event of a fire on either the first floor or the second floor.

For example, a fire may occur in the first circuit board 220 disposed on the first floor due to excessive heating, and the intermediate plate 140 can block a fire occurring on the first floor on which the first circuit board unit 220 is disposed from spreading to the second floor.

Conversely, since power is supplied to the circulation pump of the washing unit 130 disposed on the second floor, a fire may occur due to an overload of the circulation pump, and the intermediate plate 140 can block the fire occurring on the second floor on which the circulation pump is disposed from spreading to the first floor.

As described above, the intermediate plate 140 can block a fire due to an abnormal operation of a component on any one floor from spreading to the other floor to suppress damage to the entire cup washer due to the fire and suppress the fire from spreading to the entire cup washer, thereby improving the safety of the cup washer.

Hereinafter, a structure of the intermediate 140 will be described in detail with reference to FIGS. 5B and 5C. The intermediate plate 140 may include a through hole 141, a rigid rib 142, a holder 143, and a drain hole 144.

The through hole 141 may be formed to pass through the intermediate plate 140, and a plurality of through holes 141 may be provided in the intermediate plate 140. The through holes 141 may be formed to arrange pipes connecting components disposed on the first floor and the second floor, components disposed at positions at which some of the components disposed on the first floor or the second floor pass through the intermediate plate 140, etc.

The through holes 141 may be disposed in various shapes and at various positions to correspond to shapes and arrangement positions of the pipes and other components passing therethrough.

The rigid rib 142 may be provided to surround an edge of the intermediate plate 140 or provided to surround an edge of the through hole 141 and may protrude from the intermediate plate 140 upward from the cup washer (or downward from the cup washer in another embodiment).

The intermediate plate 140 may be disposed to entirely extend in the lateral direction of the cup washer, and the rigid rib 142 may be disposed to extend in a vertical direction of the cup washer to reinforce the rigidity of the intermediate plate 140. With this structure, the intermediate plate can effectively suppress the distortion of the cup washer by stably supporting the cup washer.

The holder 143 may be formed to protrude from an upper surface of the intermediate plate 140 upward from the cup washer. The holder 143 may be coupled to the washing unit 130 to support the washing unit 130.

For example, the holder 143 and the washing unit 130 may be coupled by a connecting bar 1310 interposed therebetween. One side of the connecting bar 1310 provided in the cup washer may be coupled to the tub 131, and the other side thereof may be coupled to an upper end portion of the holder 143.

Therefore, the tub 131 may be coupled to the holder 143 by the connecting bar 1310, and the washing unit 130 including the tub 131 may be coupled to the intermediate plate 140 and stably supported by the intermediate plate 140. In order for the tub 131 to be stably coupled to the holder 143, a plurality of holders 143 may be provided.

The drain hole 144 may be formed to pass through the intermediate plate 140. Since the tub 131 and the sump 133 in which water is contained are provided, water may be discharged to a lower portion of the washing unit 130. The discharged water falls on the upper surface of the intermediate plate 140, and due to the rigid rib 142, a considerable amount of water may be collected on the upper surface of the intermediate plate 140.

When the water collected on the upper surface of the intermediate plate 140 is left unattended, mold or the like may occur due to a humid environment, which is not good for hygiene.

Therefore, the drain hole 144 for discharging the water collected on the upper surface of the intermediate plate 140 to a lower side of the intermediate plate 140 may be formed to pass through the intermediate plate 140. The drain hole 144 may be disposed at an appropriate position of the intermediate plate 140.

Additionally, by connecting a separate hose to the drain hole 144 and connecting the hose to the drainpipe, the water falling on the upper surface of the intermediate plate 140 may be smoothly discharged to the outside of the cup washer through the drainpipe.

Figure 6:
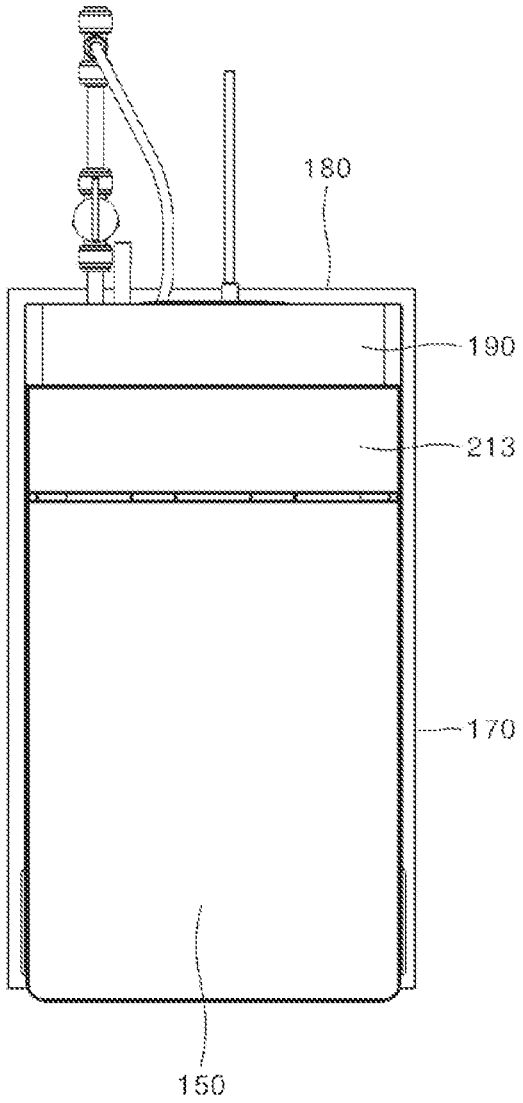
FIG. 6 is a plan view illustrating the cup washer.
Figure 7:
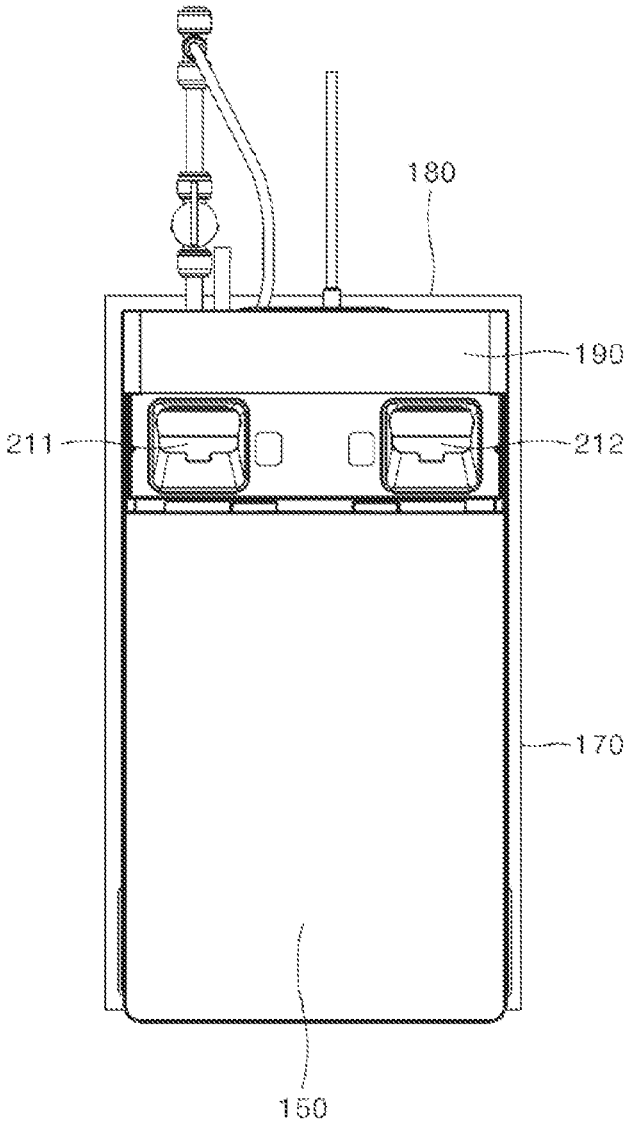
FIG. 7 is a view illustrating a cup washer from which some components are omitted in FIG. 6.

FIG. 6 is a plan view illustrating the cup washer. FIG. 7 is a view illustrating a cup washer from which some components are omitted in FIG. 6, The top cover 210 may include a, detergent inlet 211, a rinse inlet 212, and the inlet cover 213.

The detergent inlet 211 may be provided to be used to put detergent into the washing unit 130. The detergent inlet 211 may be connected to a detergent storage 136, and the detergent flowing into the detergent inlet 211 may be stored in the detergent storage 136.

The rinse inlet 212 may be provided to be used to put rinse into the washing unit 130. The rinse inlet 212 may be connected to a rinse storage 137, and the rinse flowing into the rinse inlet 212 may be stored in the rinse storage 137. The detergent inlet 211 and the rinse inlet 212. may be separated and provided on the top cover 210.

The inlet cover 213 may be detachably provided on the top cover 210 to cover the detergent inlet 211 and the rinse inlet 212. In the case of inputting detergent or rinse, a manager of the cup washer may remove the inlet cover 213 to input detergent or rinse into the detergent inlet 211 or the rinse inlet 212.

Normally, the inlet cover 213 may cover the detergent inlet 211 and the rinse inlet 212 to suppress foreign substances from flowing into the cup washer through the detergent inlet 211 and the rinse inlet 212 and improve the beauty of the cup washer.

Figure 8:
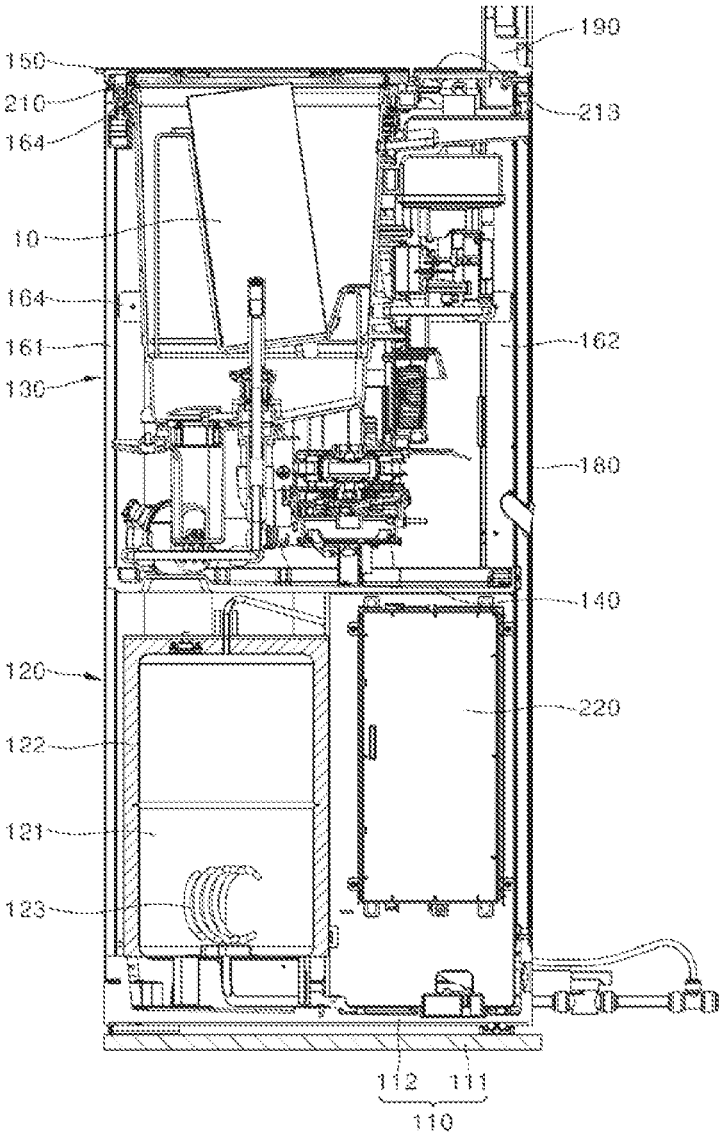
FIG. 8 is a cross-sectional view illustrating a portion of the cup washer according to one embodiment.

FIG. 8 is a cross-sectional view illustrating the cup washer according to one embodiment. The water tank 120 may include a storage tank 121, an insulator 122, and a heater 123. The storage tank 121 may be formed in a hollow cylindrical shape to store water. The storage tank 121 may be connected to the city water supply using a pipe so that tap water may flow into the storage tank 121 from a city water supply pipe.

The insulator 122 may be provided to surround the storage tank 121 and formed in a cylindrical shape. The insulator 122 may cover the storage tank 121 to prevent hot water heated in the storage tank 121 from being cooled by outside air. The insulator 122 may be formed of an insulating material having a predetermined thickness formed in a shape corresponding to the storage tank 121.

The heater 123 may function as a heating device. The heater 123 may be accommodated inside the storage tank 121 and may heat water. The water stored in the storage tank 121 may be heated by the heater 123 to become hot water and used for washing the cup. The heater 123 may be provided to be operated by, for example, an electric resistance heating method and disposed inside the storage tank 121 to be submerged in water.

Figure 9:
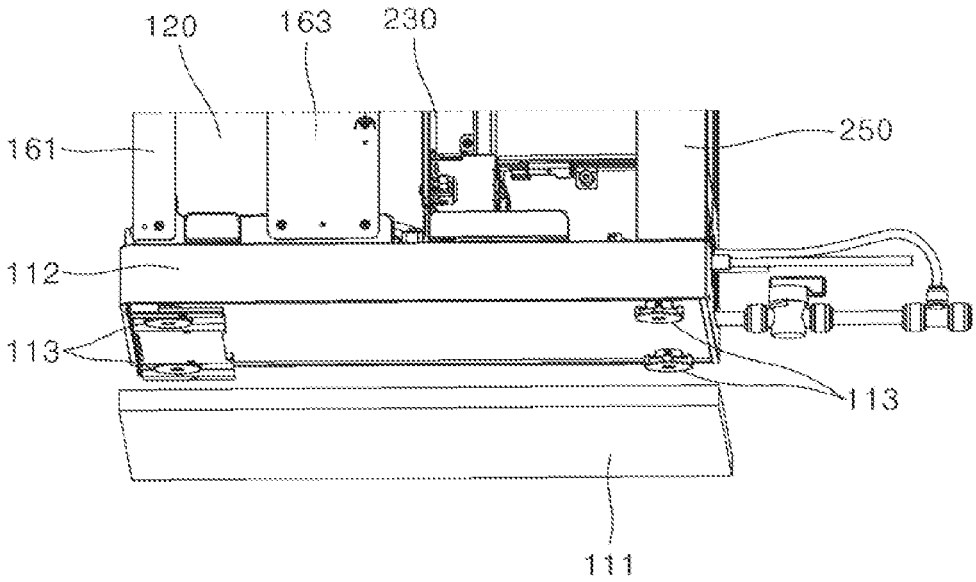
FIG. 9 is an exploded view illustrating a portion of the cup washer.

FIG. 9 is an exploded view illustrating a portion of the cup washer. The base plate 110 may include a level adjusting unit 113. The level adjusting unit 113 may be rotatably coupled to the first part 111, provided to be moved in the vertical direction with respect to the second part 112, and screw-coupled to the second part 112.

The level adjusting unit 113 may be disposed on each portion adjacent to corners of the first part 111 and the second part 112, and a total of four level adjusting units 113 may be provided. The manager may manually rotate each of the level adjusting units 113, and separation distances between the first part 111 and the second part 112 may be changed according to the rotation.

With this structure, the manager may rotate each of the level adjusting units 113 to appropriately adjust the separation distances between the first part 111 and the second part 112 on the corners of the first part 111 and the second part 112 and thus adjust a horizontal state of the cup washer with respect to the ground.

Figure 10:
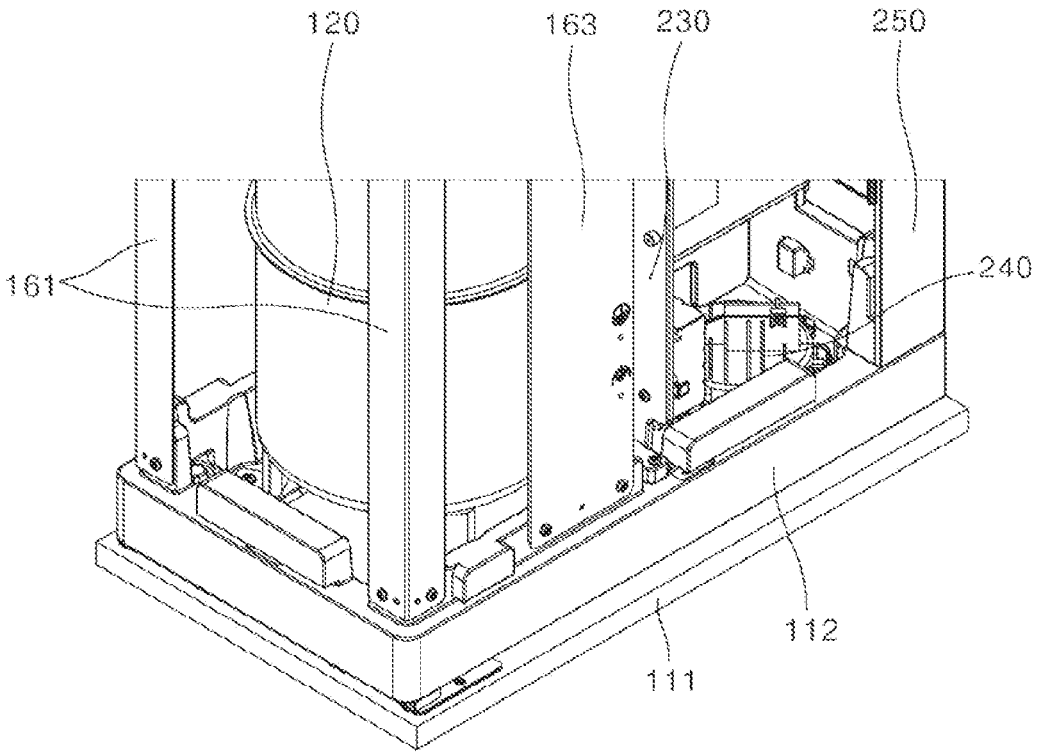
FIG. 10 is a perspective view illustrating a portion of the cup washer.
Figure 11:
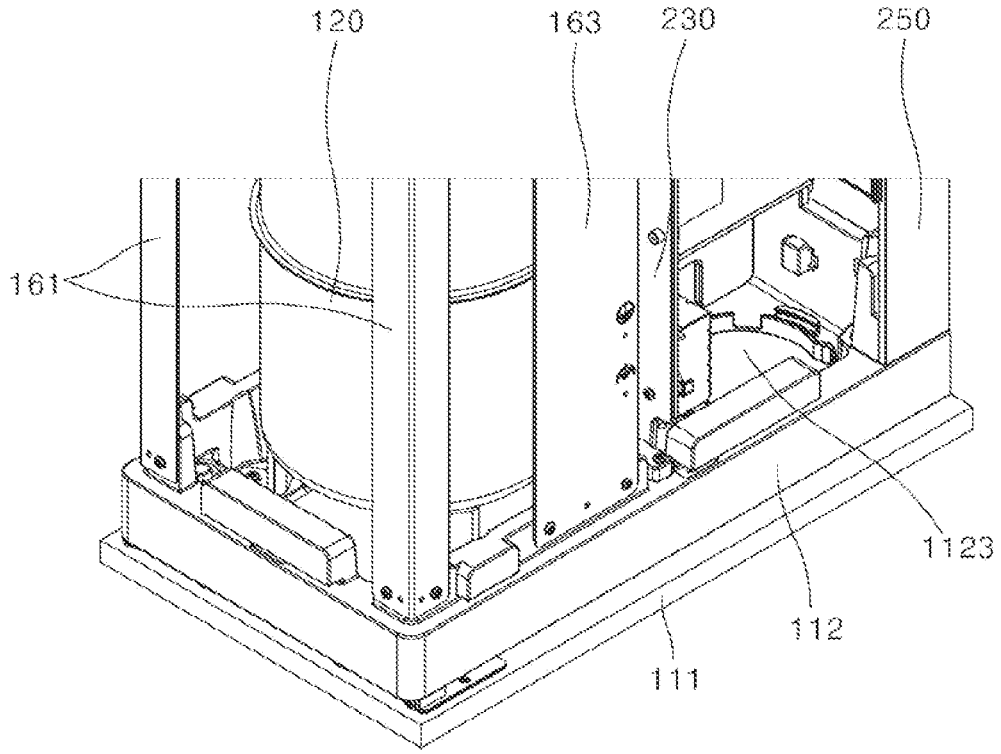
FIG. 11 is a view illustrating a cup washer from which a floating sensor is omitted in FIG. 10.

FIG. 10 is a perspective view illustrating a portion of the cup washer. FIG. 11 is a view illustrating a cup washer from which a floating sensor 240 is omitted in FIG. 10. The cup washer may include the floating sensor 240 disposed on the second part 112 of the base plate 110 to transmit an alarm signal to the controller when water is introduced.

Water may be stored in the washing unit 130 and the water tank 120, and a plurality of pipes through which water flows may be provided inside the cup washer. Therefore, water may leak inside the cup washer, and it is necessary to detect leakage of water in order to take appropriate measures against the leakage of water.

The water leaking from the cup washer may be collected in the second part 112 of the base plate 110 forming the lower portion of the cup washer by gravity. Therefore, the floating sensor 240 for detecting the leakage of water may be provided on the second part 112.

The floating sensor 240 may be formed in a structure in which some components float due to buoyancy when water is introduced and thus the inflow of water is detected. When the floating sensor 240 detects the inflow of water, the floating sensor 240 may transmit a signal to the controller of the cup washer, and when receiving the signal, the controller may implement an alarm signal notifying the manager of the signal in the cup washer in the form of texts, images, sounds, etc. Therefore, the manager may take appropriate measures to block the leakage of water.

A seating groove 1123 in which the floating sensor 240 is seated may be formed in the second part 112 of the base plate 110. The seating groove 1123 may be formed by recessing an upper surface of the second part 112, and the floating sensor 240 may be disposed therein. The upper surface of the second part 112 may be provided to be inclined to have a height decreasing toward the seating groove 1123 when viewed in a lateral direction of the cup washer.

With this structure, even when water falls on a portion of the upper surface of the second part 112, which is spaced apart from the seating groove 1123, the water may move along an inclination by gravity and flow into the floating sensor 240 disposed in the seating groove. Therefore, even when a relatively smaller amount of water leaks, the floating sensor 240 may effectively detect the leakage of water.

Figure 12:
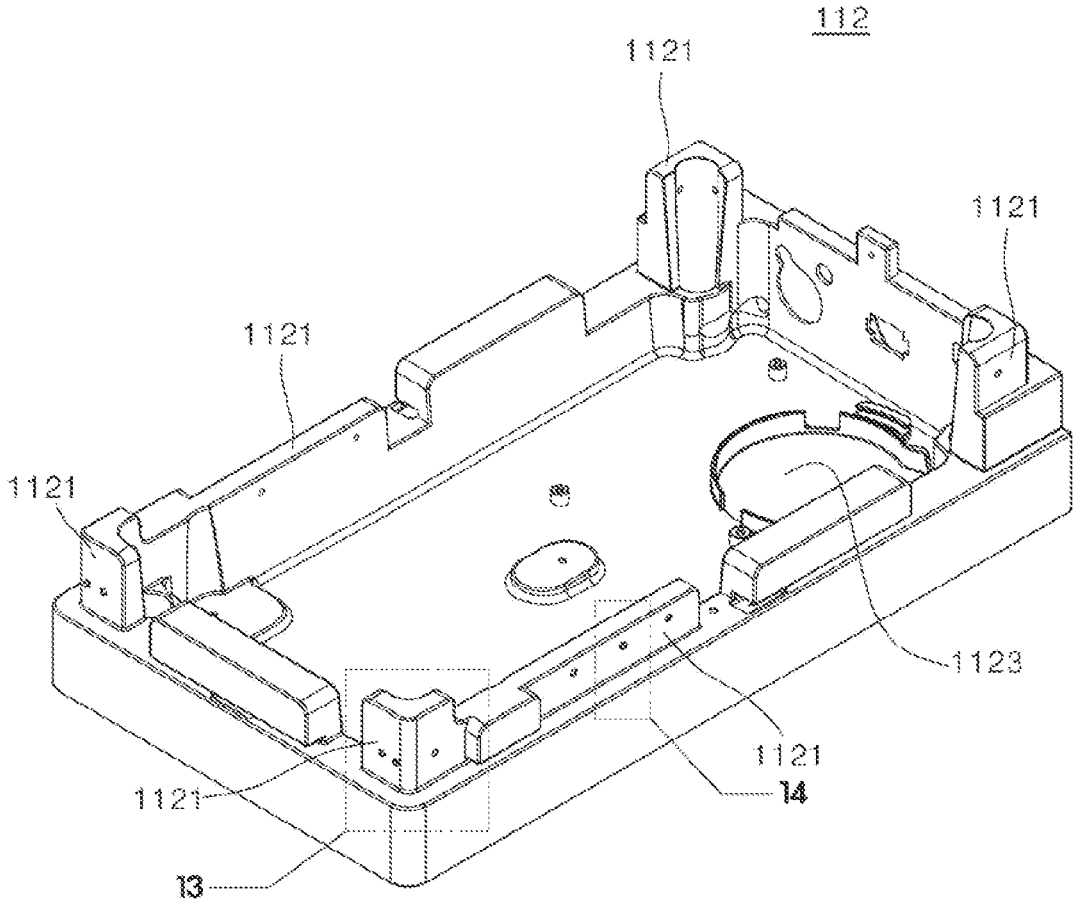
FIG. 12 is a view illustrating a second part according to one embodiment.
Figure 13:
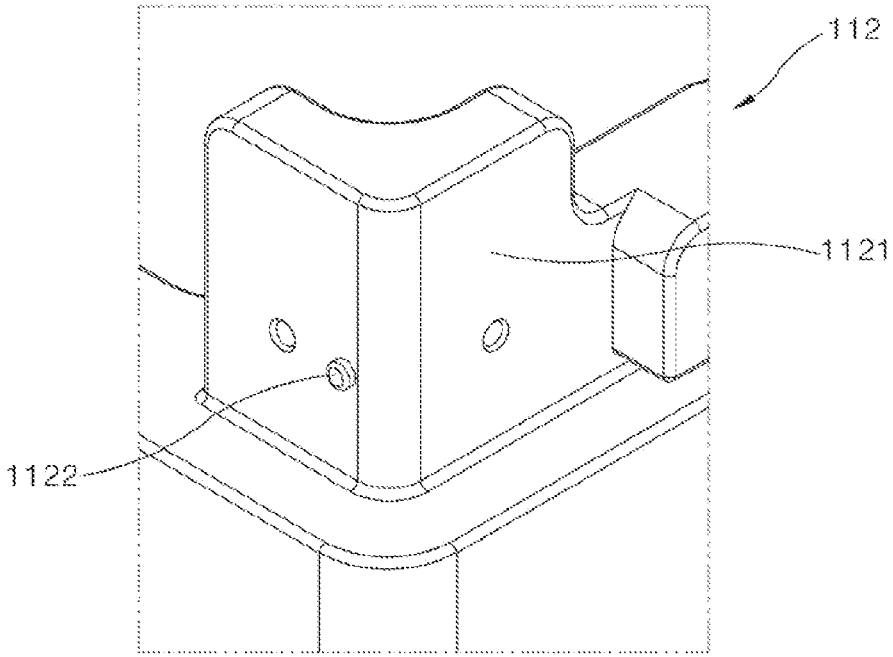
FIG. 13 is an enlarged view illustrating portion 13 in FIG. 12.
Figure 14:
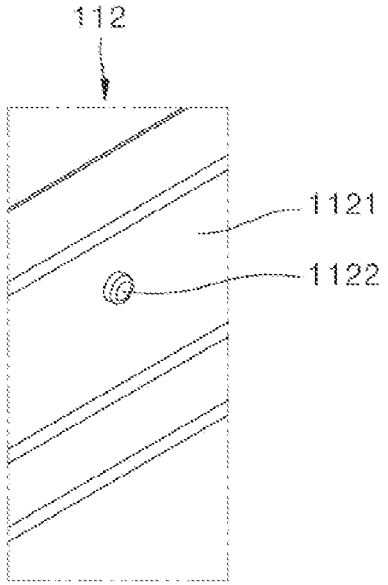
FIG. 14 is an enlarged view illustrating portion 14 in FIG. 12.

FIG. 12 is a view illustrating the second part 112 according to one embodiment. FIG. 13 is an enlarged view illustrating portion 13 in FIG. 12. FIG. 14 is an enlarged view illustrating portion 14 in FIG. 12. The second part 112 of the base plate 110 may include first coupling protrusions 1121.

The first coupling protrusions 1121 may be disposed on corners of the second part 112, may protrude upward, and may be coupled to the front supports 161, the rear supports 162, and the intermediate supports 163. The first coupling protrusions 1121 may be disposed on edges of the second part 112 and may have different shapes and positions depending on the supports to be coupled thereto.

For example, the first coupling protrusions 1121 coupled to the front supports 161 or the rear supports 162 may be formed in an L shape in correspondence to the shapes of the front supports 161 and the rear supports 162 having the L-shaped cross sections and formed on portions adjacent to the corners of the second part 112 to correspond to the positions of the front supports 161 and the rear supports 162.

In addition, the first coupling protrusions 1121 coupled to the intermediate supports 163 may be formed to have linear cross sections in correspondence to the shapes of the intermediate supports 163 having linear cross sections and formed in portions adjacent to sides of the second part 112 to correspond to the positions of the intermediate supports 163.

The first coupling protrusion 1121 may include guide protrusions 1122 protruding laterally from the first coupling protrusion 1121 to guide coupling positions of the front supports 161 and the intermediate supports 163.

The front supports 161, the rear supports 162, and the intermediate supports 163 may be coupled to the first coupling protrusions 1121 by fasteners. When the supports are coupled to the first coupling protrusions 1121, the supports are first positioned with respect to the first coupling protrusions 1121, and then the fasteners are fastened thereto.

At this time, when the supports are not disposed at accurate positions, holes formed in the supports and holes formed in the first coupling protrusions 1121 for fastening with the fasteners may be misaligned. Therefore, the guide protrusions 1122 may be formed on the first coupling protrusions 1121 so that the holes between the supports and the first coupling protrusions 1121 are disposed at the accurate positions.

Although not illustrated, the guide protrusions 1122 may be formed on the first coupling protrusions 1121 to which the rear supports 162 are coupled. The guide protrusions 1122 may allow the holes of the supports and the holes of the first coupling protrusions 1121 for fastening with the fasteners to be disposed at the accurate positions.

Figure 15:
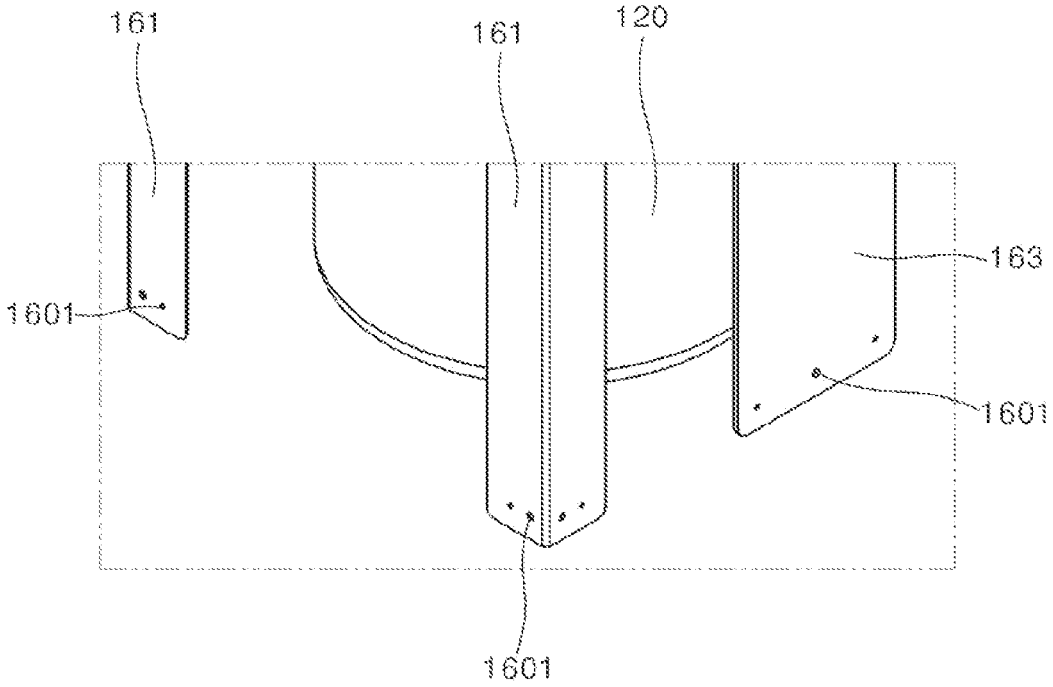
FIG. 15 is an enlarged view illustrating end portions of front supports and an intermediate support.

FIG. 15 is an enlarged view illustrating end portions of the front supports 161 and the intermediate support 163. Guide holes 1601 into which the guide protrusions 1122 are inserted may be formed in the front supports 161 and the intermediate supports 163. Although not illustrated, the guide protrusions 1122 may be formed on the rear supports 162 to correspond to the guide protrusions 1122 of the first coupling protrusions 1121.

The guide protrusions 1122 may be coupled to the guide holes 1601. When the guide protrusions 1122 are fitted into the guide holes 1601, the holes of the supports to which the fasteners are fastened and the holes of the first coupling protrusions 1121 may be disposed at the accurate positions without being misaligned.

Figure 16:
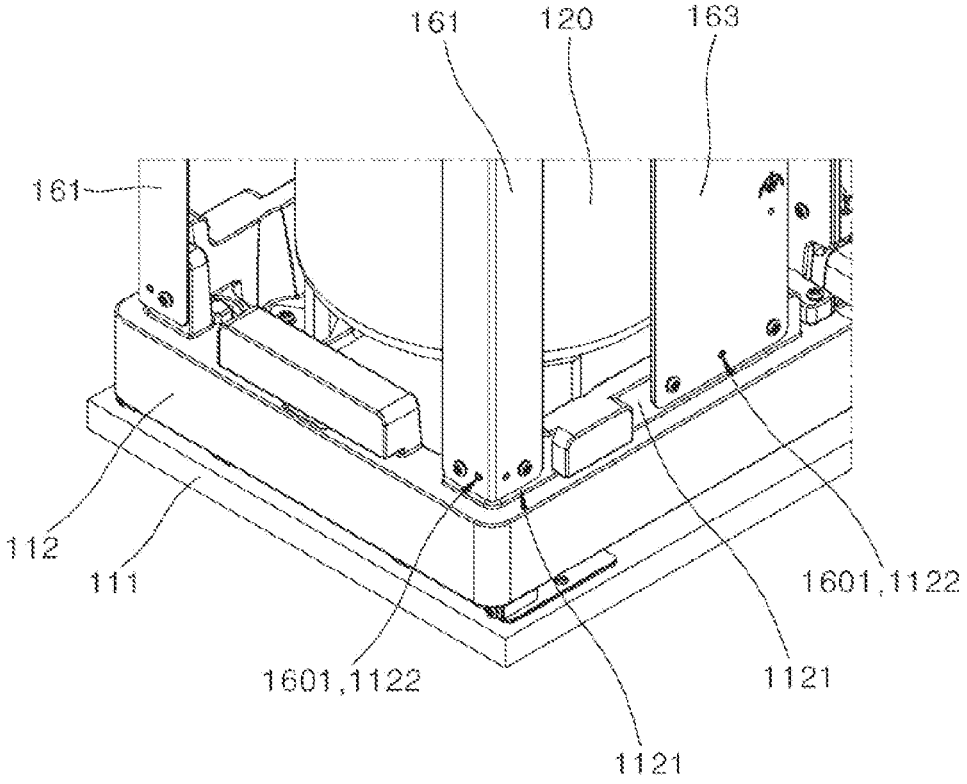
FIG. 16 is a view illustrating a state in which the front supports and the intermediate support are coupled to the second part.

FIG. 16 is a view illustrating a state in which the front supports 161 and the intermediate supports 163 are coupled to the second part 112. The supports (the front supports 161, the intermediate supports 163, and the rear supports 162) may be coupled to the first coupling protrusions 1121 in the following order.

First, the guide holes 1601 of the supports are fitted onto the guide protrusions 1122 of the first coupling protrusions 1121. Therefore, the holes of the supports and the holes of the first coupling protrusions 1121 to which the fasteners are fastened may correspond to the accurate positions without being misaligned. Next, an operator may couple the supports to the first part 111 by inserting fasteners such as a screw into the holes of the supports and the first coupling protrusions 1121 for fastening.

In the embodiment, the guide protrusions 1122 may be provided on the first coupling protrusions 1121, and the guide holes 1601 fitted onto the guide protrusions 1122 may be provided in the supports. When the guide protrusions 1122 are fitted into the guide holes 1601, the holes formed in the supports and the first coupling protrusions 1121 for fastening with the fasteners may correspond to each other at the accurate positions without being misaligned. Therefore, the operator may couple the supports to the first part 111 by easily fastening the fasteners to the holes.

Figure 17:
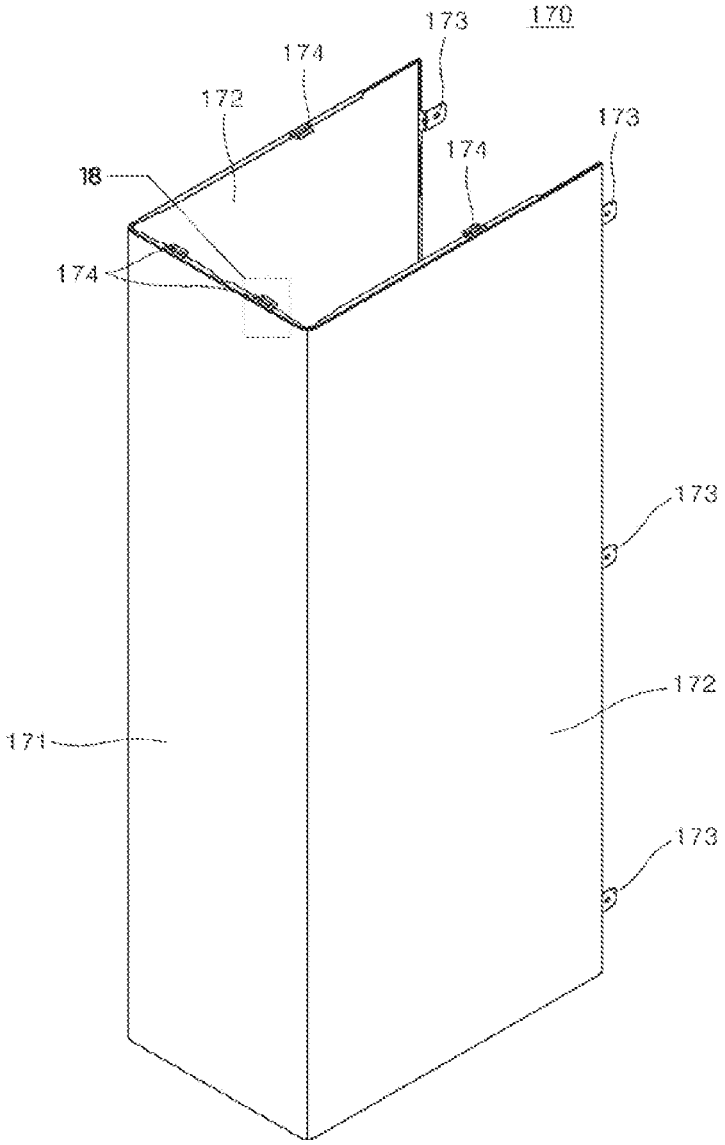
FIG. 17 is a perspective view illustrating a front panel according to one embodiment.

FIG. 17 is a perspective view of the front panel 170 according to one embodiment. The front panel 170 may form an outer shape of the cup washer and cover a front surface and side surfaces of the cup washer. The front panel 170 may include a first wall 171, second walls 172, second coupling protrusions 173, and third coupling protrusions 174. The front panel 170 may be generally formed in a thin plate shape.

The first wall 171 may cover a front surface of the cup washer to form a front of the cup washer. A pair of second walls 172 bent at both ends of the first wall 171 may be provided and may form side portions of the cup washer by covering the side surfaces of the cup washer. The first wall 171 and the second walls 172 may be coupled to the rear panel 180 to form a space in which various components of the cup washer are embedded.

The second coupling protrusions 173 may protrude from ends of the second walls 172 and may be coupled to the rear supports 162 of the frame 160. The second coupling protrusion 173 may protrude from an end of the rear of the second wall 172 to reach the rear support 162 of the frame 160.

The second coupling protrusions 173 may be provided on each of the pair of second walls 172, and a plurality of second coupling protrusions 173 may be provided to be spaced apart from each other in the vertical direction of the front panel 170.

The second coupling protrusions 173 may be firmly coupled to the rear supports 162 by fasteners. Therefore, the entire front panel 170 may be coupled to the rear supports 162 and supported by the rear supports 162.

The front panel 170 is generally formed in a thin plate shape and has a relatively larger area. Therefore, it may be difficult to stably couple the front panel 170 to the cup washer only with the second coupling protrusions 173.

For example, when an external impact is applied to the cup washer, the front panel 170 may be separated from the cup washer on portions of an upper end portion and a lower end portion of the front panel 170. Therefore, a structure of stably coupling the front panel 170 to the cup washer in addition to the second coupling protrusions 173 is required. To this end, the third coupling protrusions 174 may be provided on the front panel 170.

The third coupling protrusions 174 may protrude from upper ends of the first wall 171 and the second walls 172 and may be coupled to the top cover 210 to prevent the removal of the front panel 170. A plurality of third coupling protrusions 174 disposed to be spaced apart from each other may be provided on the first wall 171 and the second walls 172.

The third coupling protrusions 174 may be coupled to the top cover 210 to suppress the front panel 170 from being removed from the cup washer due to an external impact and at the same time, guide the front panel 170 to be easily coupled to the cup washer.

Figure 18:
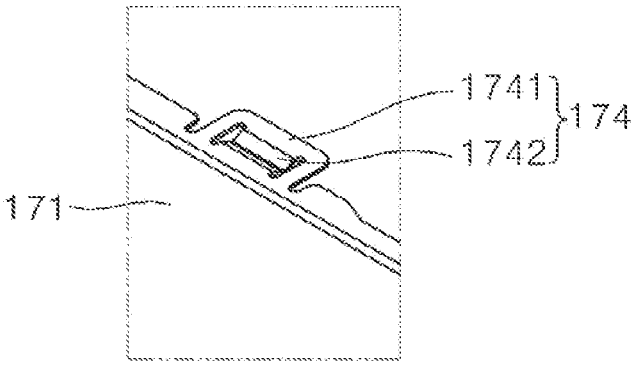
FIG. 18 is an enlarged view illustrating portion 18 in FIG. 17.
Figure 19:
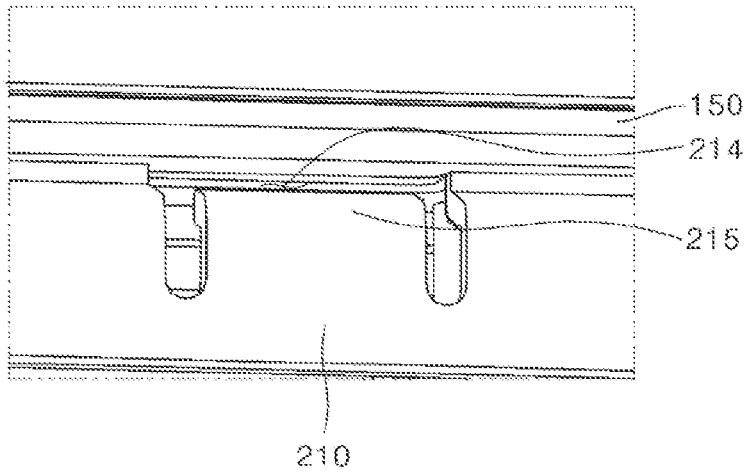
FIG. 19 is an exploded view illustrating a portion of a top cover.

FIG. 18 is an enlarged view illustrating portion 18 in FIG. 17. FIG. 19 is an enlarged view illustrating a portion of the top cover 210. The third coupling protrusions 174 may be provided to entirely enable elastic deformation, and each may include a fitting portion 1741 and a hook 1742.

The fitting portion 1741 may be fitted into a groove formed in the top cover 210. More particularly, the fitting portion 1741 may be fitted into a fitting groove 214 formed in the top cover 210. The fitting portion 1741 may be formed to protrude from the front panel 170, and the hook 1742 may be formed integrally with the fitting portion 1741. The hook 1742 may be formed to be surrounded by the fitting portion 1741, may have a V-shaped cross section, and may be provided to be elastically deformed.

The fitting grooves 214 and hooks 215 may be provided on portions of the top cover 210 to which the third coupling protrusions 174 are coupled. The fitting grooves 214 may be formed by recessing the side surfaces of the top cover 210, and the fitting portions 1741 may be inserted therein. The hook 215 may be formed at a position adjacent to the fitting grooves 214, and the hook 1742 in which the fitting portion 1741 is inserted into the fitting groove 214 may be in contact with the hook 215.

The third coupling protrusions 174 and the hooks 215 may be elastically deformed. Therefore, when the third coupling protrusion 174 is inserted into the fitting groove 214 by applying a force that is greater than or equal to a predetermined magnitude, the third coupling protrusion 174 and the hook 215 are elastically deformed, and thus the hook 1742 may maintain a state of being coupled to the hook 215.

In the case of separating the front panel 170 from the cup washer, when the third coupling protrusions 174 are separated by applying a force that is greater than or equal to a predetermined magnitude, the third coupling protrusion 174 and the hook 215 may be elastically deformed, and thus the hook 1742 may be separated from the hook 215. Therefore, the front panel 170 may be separated from the cup washer.

Meanwhile, a structure similar to the third coupling protrusion 174 may be formed on a lower end portion of the first wall 171 or lower ends of the second walls 172, and a structure similar to the fitting groove 214 and the hook 215 may be provided on the second part 112 of the base plate 110 to which the lower end portion of the first wall 171 and the lower ends of the second walls are coupled.

In another embodiment, a structure similar to the fitting groove 214 and the hook 215 may be formed on the lower end portion of the first wall 171 or the lower ends of the second wall 172, and a structure similar to the third coupling protrusion 174 may be provided on the second part 112 of the base plate 110.

Figure 20:
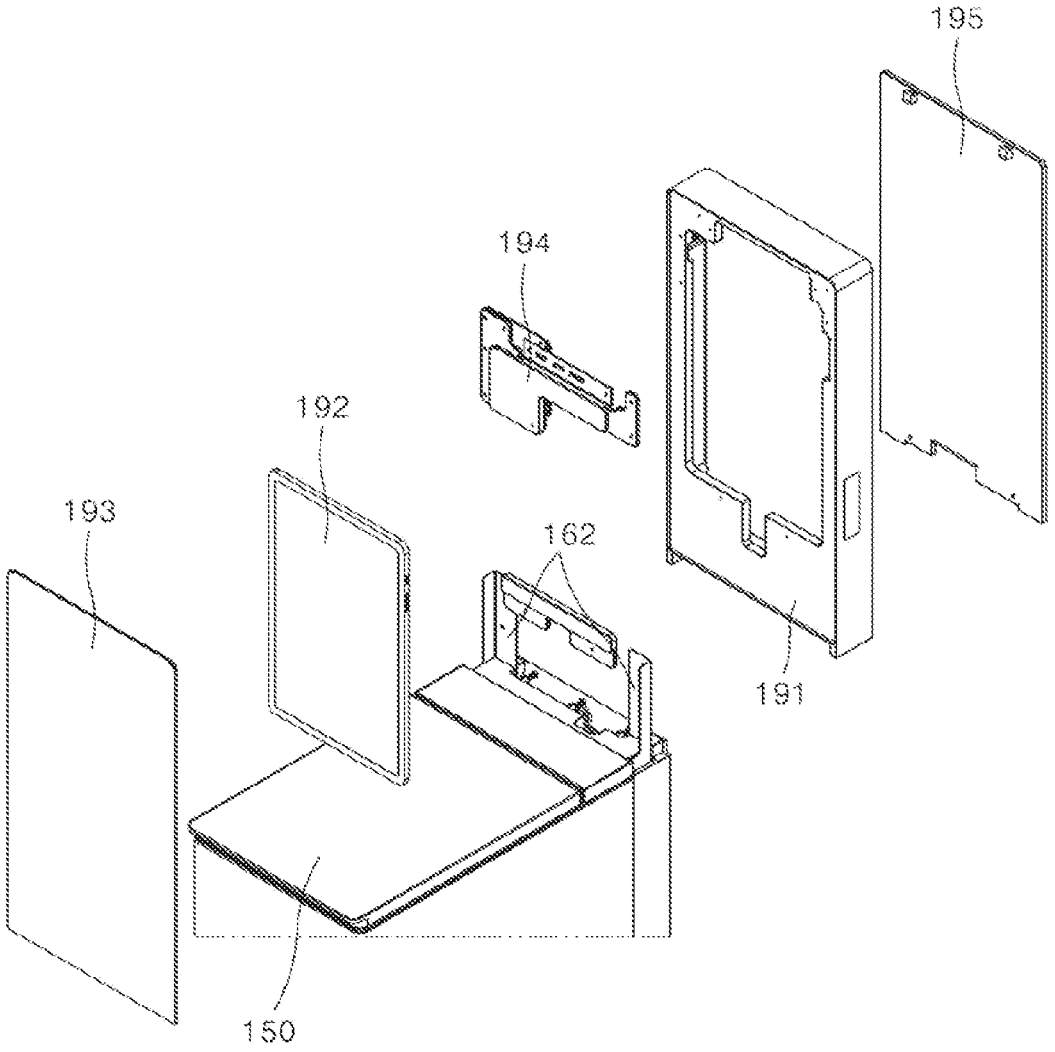
FIG. 20 is an exploded view illustrating a display unit according to one embodiment.

FIG. 20 is an exploded view illustrating the display unit 190 according to one embodiment. The display unit 190 may be disposed to protrude above the door 150 and provided so that a user may easily look at the display unit 190 and input an operation command through the display unit 190.

The rear supports 162 may be formed longer than the front supports 161. Therefore, the upper ends of the rear supports 162 may protrude upward from the door 150, and the display unit 190 may be coupled to the protruding upper ends of the rear supports 162.

The display unit 190 may include a housing 191, a display panel 192, a cover glass 193, a second circuit board 194, and a rear cover 195. The housing 191 may be coupled to the rear supports 162. Components forming the display unit 191 may be accommodated inside the housing 191 or coupled to an outer side of the housing 191.

The display panel 192 may be accommodated in the housing 191, and an image may be displayed thereon. Texts, videos, images, or the like for providing Information on the operation of the cup washer to the user and guiding the user to input a command may be displayed on the display panel 192.

The display panel 192 may be protected by the housing 191, and the cover glass 193 may be disposed in front of the display panel 192. The cover glass 193 may be disposed in front of the display panel to protect a front surface of the display panel 192.

The second circuit board 194 may be accommodated in the housing 191 to control the operation of the display panel 192. Various active elements, passive elements, and circuits for operating the display panel 192 may be provided on the second circuit board 194. The second circuit board 194 may be electrically connected to the first circuit board 220 and controlled by the controller provided on the first circuit board 220.

The rear cover 195 may be disposed behind the display panel 192 and coupled to the housing 191. The rear cover 195 may close the rear of the housing 191 to protect the display panel 192 accommodated in the housing 191.

Figure 21:
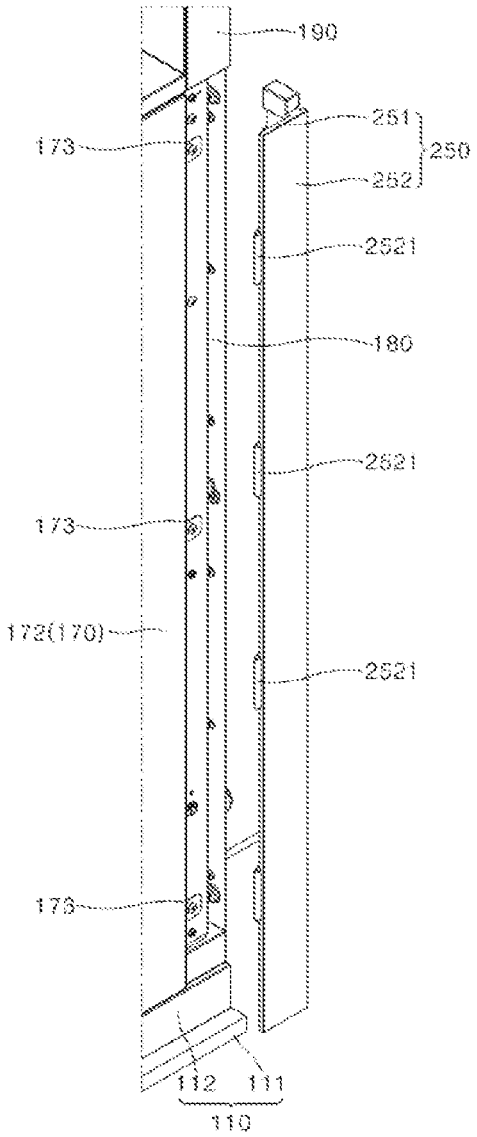
FIG. 21 is a view illustrating an exterior part according to one embodiment.
Figure 22:
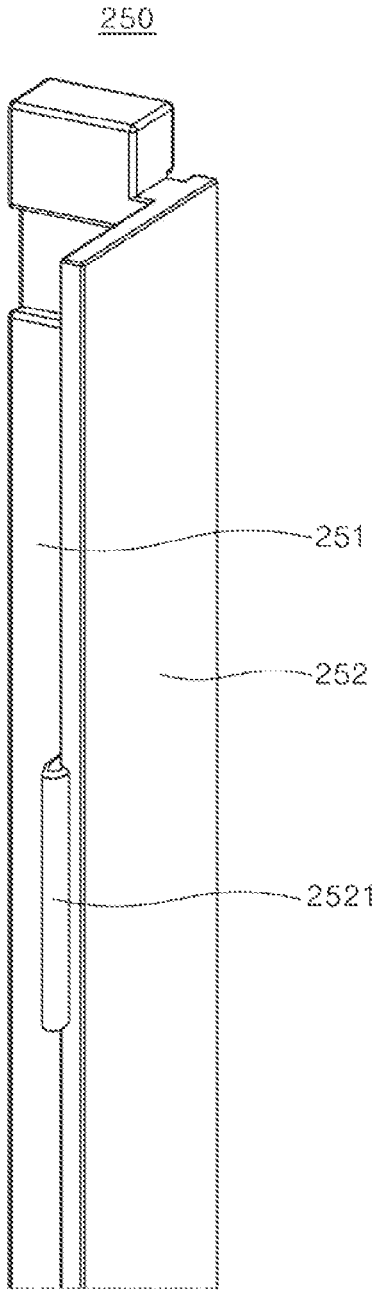
FIG. 22 is an enlarged view illustrating a portion of the exterior part.
Figure 23:
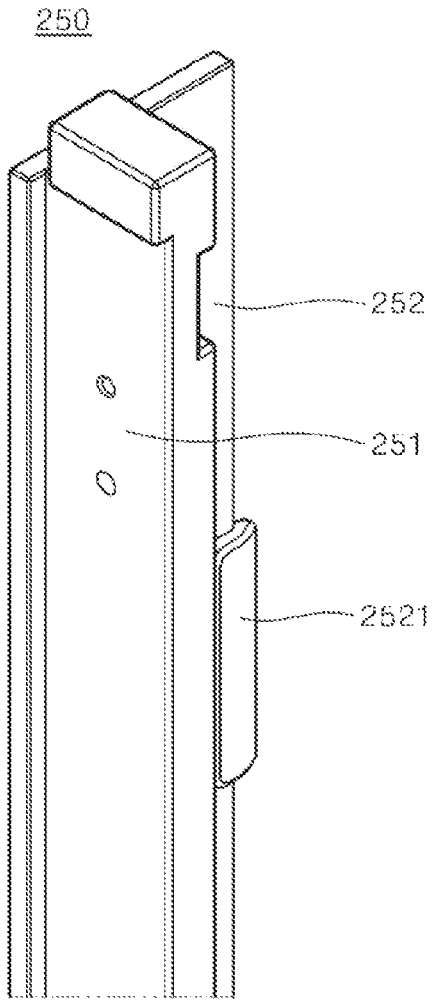
FIG. 23 is a view illustrating the portion of the exterior part of FIG. 22 in another direction.

FIG. 21 is a view illustrating the exterior part 250 according to one embodiment. FIG. 22 is an enlarged view illustrating a portion of the exterior part 250. FIG. 23 is a view illustrating the portion of the exterior part of FIG. 22 in another direction.

The second coupling protrusions 173 formed on the front panel 170 may be disposed at outer sides of the rear supports 162 and coupled to the rear supports 162 by fasteners such as a screw. In addition, an end portion of the upper support 164 may be coupled to the rear supports 162. The upper support 164 may also be coupled to the rear supports 162 by fasteners.

With this structure, a plurality of screws may be disposed on the rear supports 162 in an exposed shape. Since such an exterior may lower a sense of visual beauty of the cup washer, a structure of covering these screws is required.

Therefore, the cup washer may have a structure in which the exterior part 250 covers the rear supports 162. The exterior part 250 may be provided in substantially an L-shaped cross section and may include a first exterior plate 251 and a second exterior plate 252.

The first exterior plate 251 may be disposed inside the rear panel 180 and coupled to the rear supports 162. The first exterior plate 251 may be coupled to one side surfaces of the L-shaped rear supports 162.

Since one side surface of the first exterior plate 251 is disposed inside the rear panel 180, the one side surface of the first exterior plate 251 may be covered by the rear panel 180. Therefore, the screws fastened to the first exterior plate 251 for coupling between the first exterior plate 251 and the rear supports 162 may be covered by the rear panel 180, and thus the rear surface of the cup washer may have an increased sense of beauty and a sleek exterior because the plurality of screws are covered.

Of course, in order to couple the rear panel 180 to the first exterior plate 251, the screws may be fastened to the rear panel 180, and these screws may be exposed to the outside, but since the number of screws coupling the rear panel 180 to the first exterior plate 251 is less than the number of screws coupling the first exterior plate 251 to the rear supports 162, as a result, it is possible to reduce the number of screws viewed from the outside, thereby increasing a sense of beauty of the cup washer.

The second exterior plate 252 may be bent from the first exterior plate 251 to cover the rear supports 162. The second exterior plate 252 may cover the other side surface of the L-shaped rear support 162, which is bent from one side surface covered by the rear panel 180.

Fitting guides 2521 protruding forward may be provided in the second exterior plate 252. The fitting guides 2521 may be inserted into the ends of the second walls 172 of the front panel 170 so that the second exterior plate 252 may be stably coupled to the front panel 170.

Since the second exterior plate 252 is mounted on the second walls 172 by the fitting guides 2521, the second exterior plate 252 may stably maintain a state of covering the rear supports 162 without separate fasteners such as a screw.

Therefore, although the second exterior plate 252 covers the rear supports 162 with a plurality of screws, the screws may not be fastened to the second exterior plate 252. With this structure, since the plurality of screws provided on the rear supports 162 are prevented from being exposed to the outside, the outer side surfaces of the cup washer may look neat, thereby increasing a sense of beauty.

Figure 24:
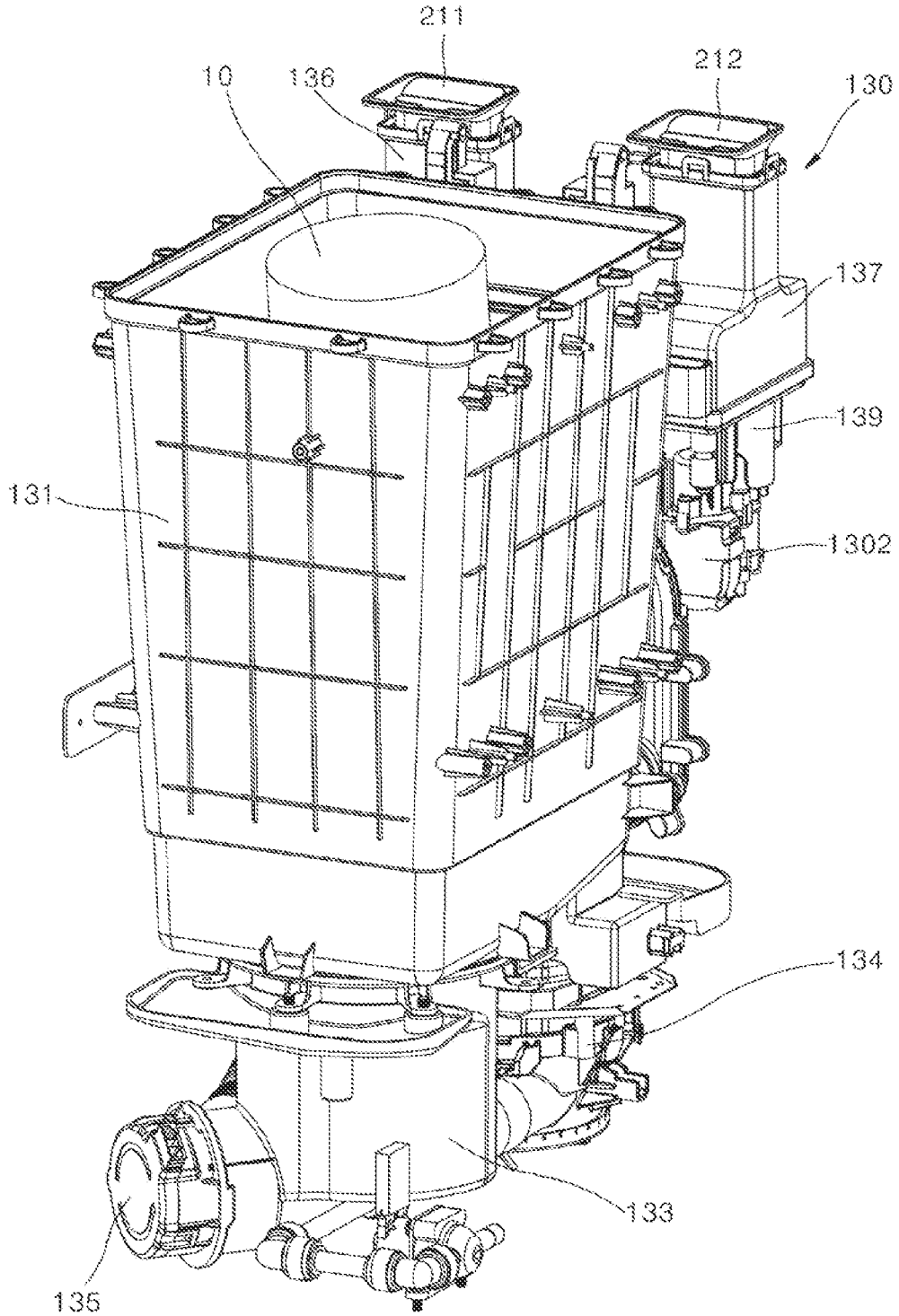
FIG. 24 is a perspective view illustrating a washing unit according to one embodiment.
Figure 25:
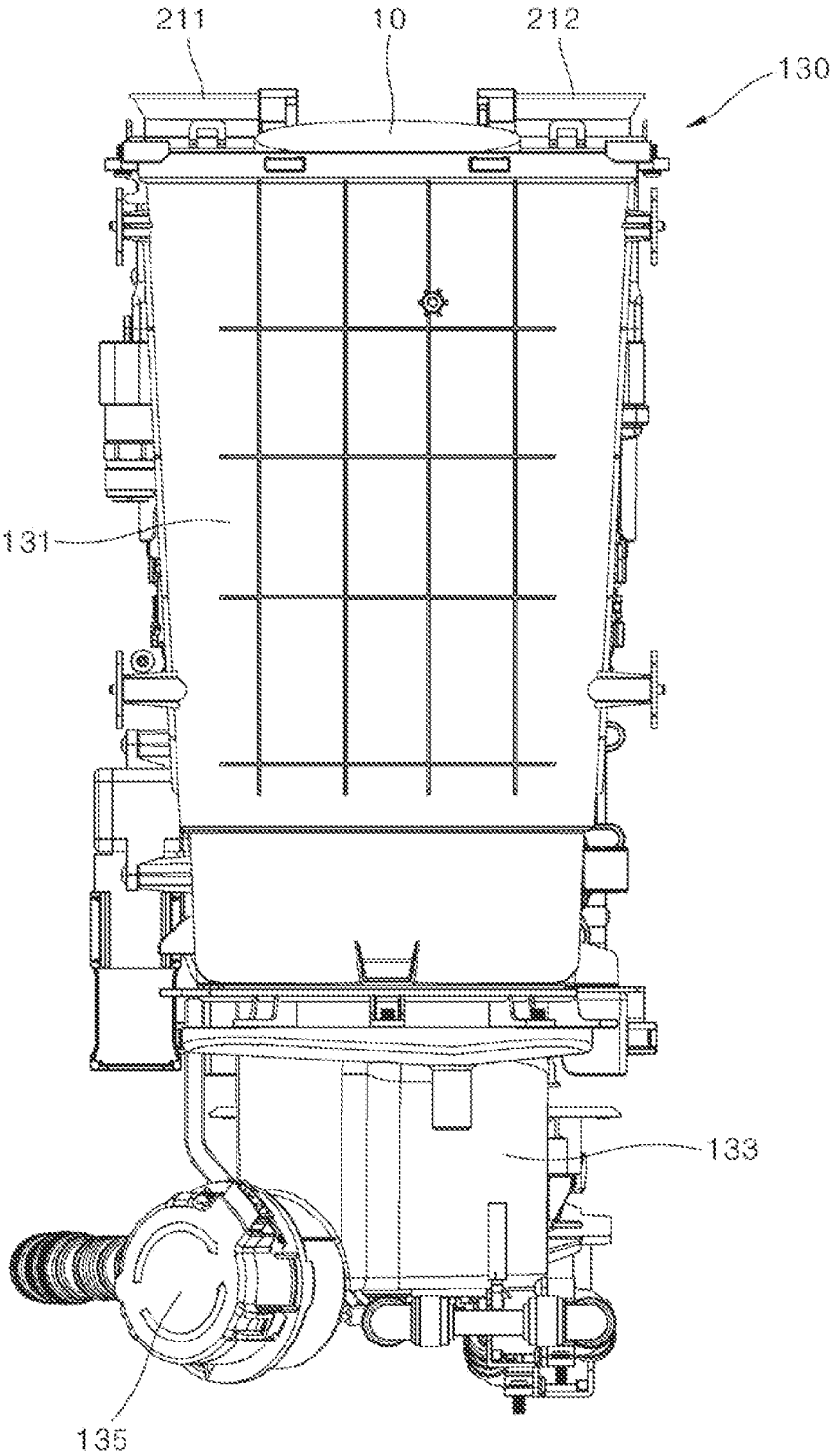
FIG. 25 is a front view illustrating the washing unit according to one embodiment.
Figure 26:
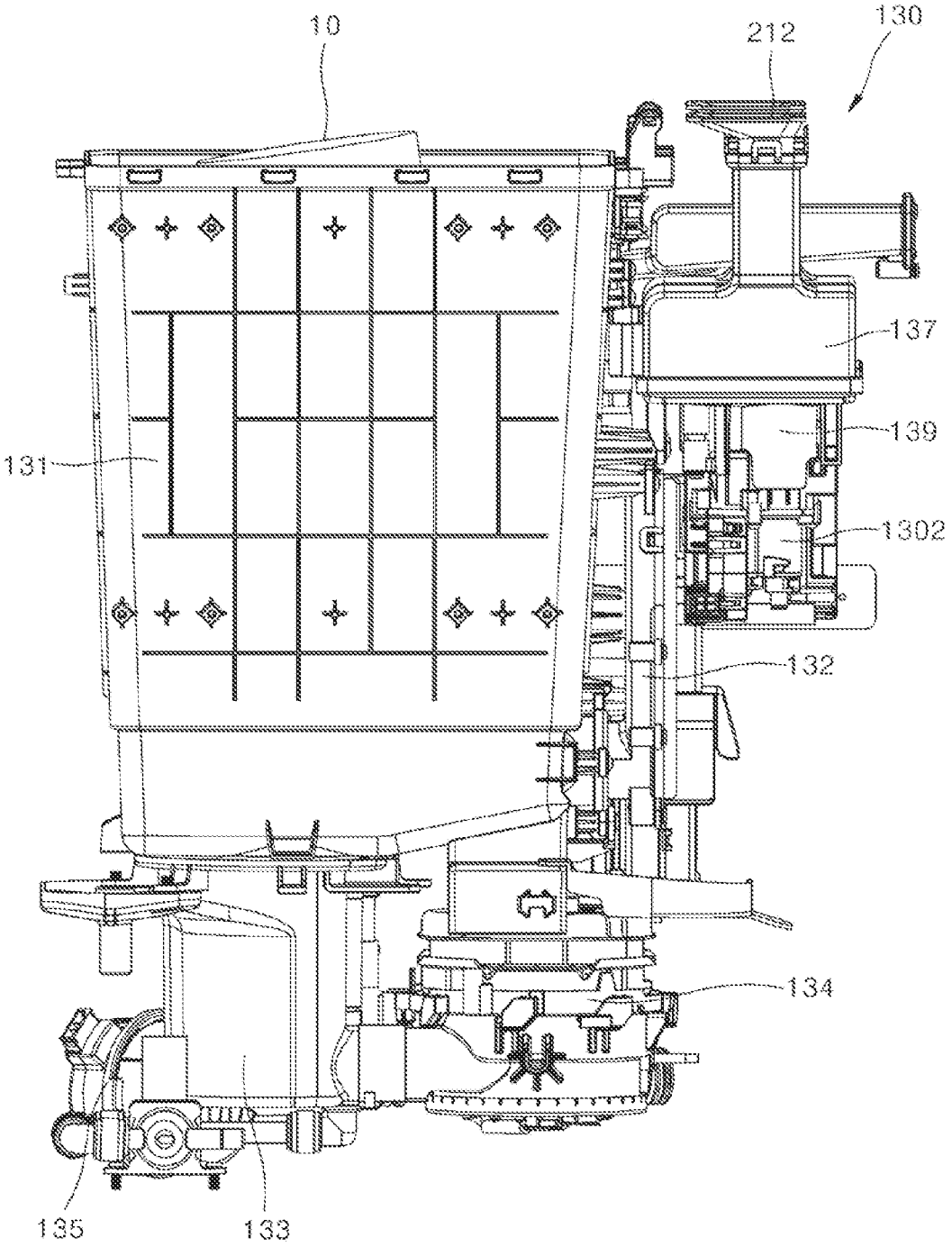
FIG. 26 is a side view illustrating the washing unit according to one embodiment.
Figure 27:
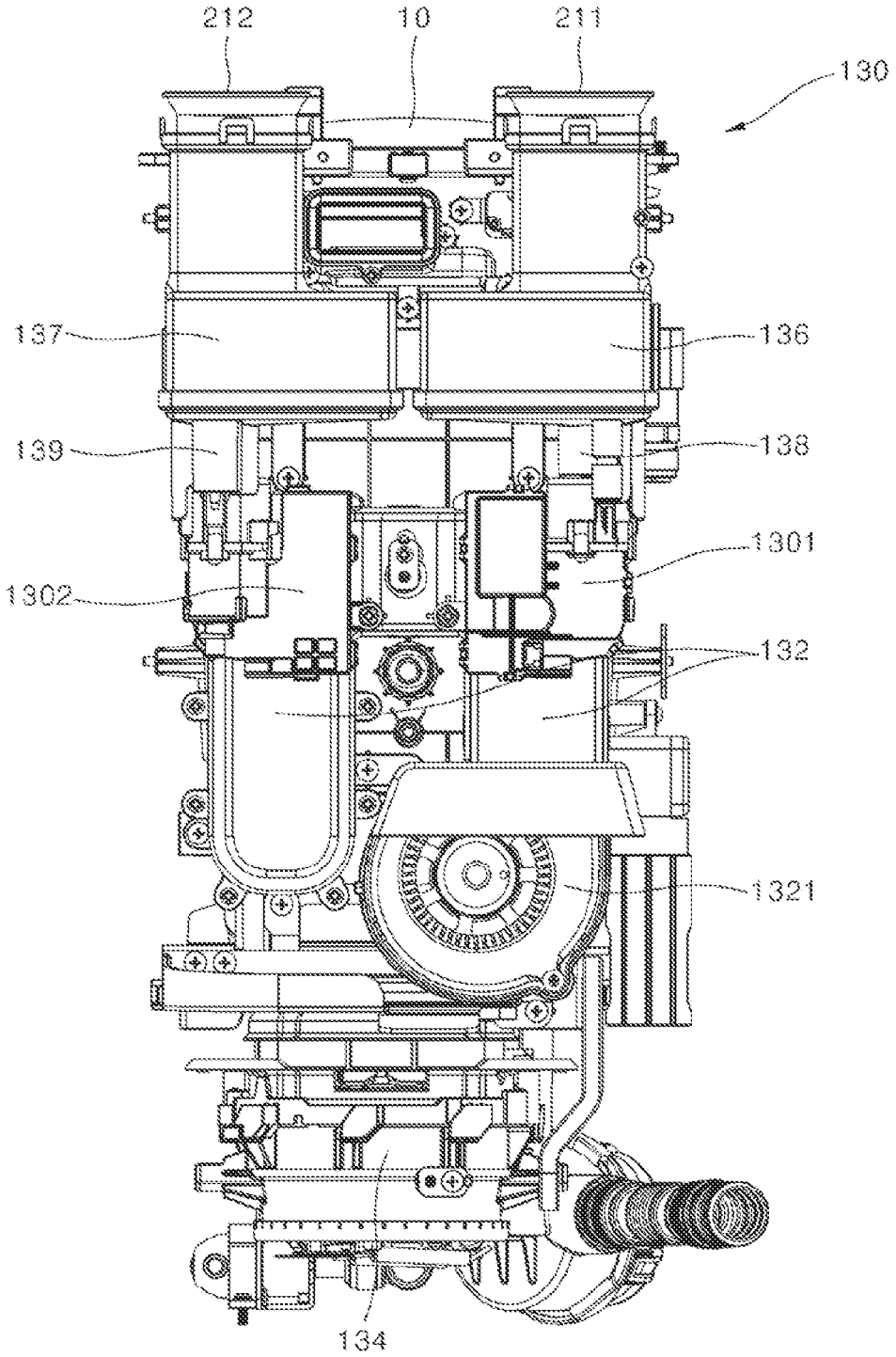
FIG. 27 is a rear view illustrating the washing unit according to one embodiment.

Hereinafter, a specific structure of the washing unit 130 will be described in detail with reference to the drawings. FIG. 24 is a perspective view illustrating the washing unit 130 according to one embodiment. FIG. 25 is a front view illustrating the washing unit 130 according to one embodiment. FIG. 26 is a side view illustrating the washing unit 130 according to one embodiment. FIG. 27 is a rear view illustrating the washing unit 130 according to one embodiment.

The washing unit 130 may include the tub 131, the drying module 132, a sump 133, a circulation pump 134, and a drain pump 135.

The tub 131 may be disposed above the water tank 120 to provide a space in which a cup is accommodated, and washing water may be sprayed. A rack on which a cup is mounted may be provided inside the tub 131, and a spray device for spraying water may be provided on a lower portion of the tub 131. An open upper end of the tub 131 may be opened and closed by the door 150.

The tub 131 may be disposed on the upper portion of the cup washer to be formed to have an open upper portion. The door 150 may be disposed above the tub 131 and may open and close an opening of the tub 131. Therefore, a user may put the cup into or take the cup out from the tub 131 through the opening positioned in the upper portion of the cup washer.

The door 150 may be provided to open the opening by rotating upward from the cup washer. The door 150 may be disposed to rotate upward from the cup washer to reduce a space in which the door 150 moves compared to when the door 150 rotates in the horizontal direction in the cup washer. Therefore, a cross-sectional area required for arranging the cup washer can be reduced, thereby increasing space efficiency.

In addition, since the door 150 rotates upward from the cup washer to open and close the opening of the tub 131 disposed on the upper portion of the cup washer, the user may put the cup on the tub 131 or take the cup out from the tub 131 without bending down, thereby providing the user's convenience.

The drying module 132 may be disposed at one side of the tub 131 to be connected to the tub 131 and may spray heated air for drying to an inside of the tub 131. After the washing of the cup 10 with water is completed, water remains on surfaces of the cup. The drying module 132 may dry the cup by spraying the heated air, that is, hot air to the cup to dry the cup to remove any remaining water.

A heating device for heating air flowing into the drying module 132 may be provided in the drying module 132. In addition, a blowing fan 1321 for forcing air to flow through a flow path formed in the drying module 132 may be provided in the drying module 132.

The sump 133 may be disposed under the tub 131 to be connected to the tub 131 to store the water sprayed in the tub 131. The water stored in the sump 133 may be sprayed by the spray device from the tub 131 while circulating between the tub 131 and the sump 133 by the circulation pump 134 to wash the cup 10 accommodated in the tub 131.

The circulation pump 134 may be disposed under the tub 131 to be connected to the tub 131 and the sump 133 to circulate water between the tub 131 and the sump 133. The circulation pump 134 may force water to flow from the sump 133 to the tub 131.

In one embodiment, the sump 133 and the circulation pump 134 may be disposed between the tub 131 and the water tank 120. With this structure, since the sump 133, the circulation pump 134, and the tub 131 may be disposed at positions adjacent to one another to eliminate or reduce pipes for connecting the above components, it is possible to simply design the structure of the cup washer.

However, since the sump 133 and the circulation pump 134 are disposed on the upper portion of the cup washer, the load acting on the upper portion of the cup washer may increase. In the embodiment, the water tank 120 may be disposed on the lower portion of the cup washer to lower the center of gravity of the cup washer, thereby effectively preventing tipping over of the cup washer.

In another embodiment, the circulation pump 134 may be disposed on the side surface of the tub 131 and connected to the tub 131 and the sump 133 with a pipe to circulate water between the tub 131 and the sump 133.

In another embodiment, the circulation pump 134 may be separated from the tub 131, disposed on the lower portion of the cup washer, for example, on the side surface of the water tank 120, and connected to the tub 131 and the sump 133 with a pipe. Since the circulation pump 134 is disposed on the lower portion of the cup washer, it is possible to effectively lower the center of gravity of the entire cup washer, thereby preventing the tipping over of the cup washer.

For the same purpose, the drain pump 135 may also be separated from the tub 131, disposed on a side surface of the water tank 120, and disposed to be connected to the sump 133 with a pipe. With this structure, it is possible to further lower the center of gravity of the entire cup washer, thereby more effectively suppressing the tipping over of the cup washer.

The circulation pump 134 may be connected to the spray device disposed under the tub 131. Therefore, when the circulation pump 134 operates, the water stored in the sump 133 may flow into the spray device and may be sprayed into the tub 131 by the spray device to wash the cup.

In the cup washer according to the embodiment, the cup may be accommodated inside the tub 131, and the spray device may spray water to the entire inside of the tub 131. Therefore, water may be sprayed into the tub 131 and spread therein.

With this structure, both the inner surface of the cup containing water, beverages, or the like, and the outer surface of the cup touched by a user's hand may be exposed to the sprayed water, and the water may collide with both the inner surface and the outer surface of the cup. Therefore, the cup washer may entirely and cleanly wash the inner surface and the outer surface of the cup at the same time.

The drain pump 135 may be disposed under the tub 131 to be connected to the sump 133 to discharge water from the sump 133 to the outside. When the washing of the cup with water is completed, the drain pump 135 may operate so that the water stored in the sump 133 may be discharged to the outside of the cup washer through a drainpipe connected to the drain pump 135.

A washing process of the cup 10 with the water stored in the water tank 120 is as follows. Water may flow into the water tank 120 from the city water supply through a pipe and may be stored therein. The water in the water tank 120 may be heated by the heating device provided in the water tank 120. Heated water in the water tank 120 may flow into the tub 131 through a pipe and may be stored in the sump 133 disposed under the tub 131.

When the circulation pump 134 is operated to wash the cup, hot water may be sprayed from the sump 133 into the tub 131 through the spray device to wash the cup. The hot water sprayed into the tub 131 may re-flow into the sump 133, re-flow into the spray device by the circulation pump 134, and may be sprayed into the tub 131 by the spray device.

While the circulation pump 134 is operating, water for washing may sequentially flow through the sump 133, the spray device, and the tub 131, and this flow may be repeated. When the washing of the cup with water is completed, the circulation pump 134 may be stopped, and the drain pump 135 may be operated to discharge the water stored in the sump 133 to the outside.

When the drainage by the drain pump 135 is completed, the drying module 132 may be operated to blow hot air into the tub 131, and after the spraying of the hot air is performed for a set time, a cup washing operation including a drying process may be completed.

The cup washer may perform washing with detergent and then rinsing with rinse. Hereinafter, a structure provided to input detergent and rinse into the tub 131 will be described in detail.

Meanwhile, in the cup washing process with hot water, the washing process using detergent and the rinsing process using rinse may be separated. After a process of washing the cup by mixing detergent with hot water is completed, the water in the sump 133 contains detergent and foreign substances. Therefore, the contaminated water may be discharged to the outside by operating the drain pump 135.

After the contaminated water is discharged to the outside, the rinsing operation may be performed by allowing water to re-flow into the sump 133 and mixing the water with the rinse to operate the circulation pump 134. It is possible to increase washing efficiency of the cup washer by separating the washing process using the detergent and the rinsing process using the rinse by such a method.

The washing unit 130 may include a liquid input module for putting at least one of detergent or rinse into the tub 131.

The drying module 132 and the liquid input module may be disposed behind the tub 131. The drying module 132 and the liquid input module may be disposed at a position adjacent to the tub 131 behind the tub 131 so that air for drying, detergent, and rinse may be efficiently input into the tub 131.

However, since the drying module 132 and the liquid input, module are disposed on the upper portion of the cup washer together with the tub 131, the load acting on the upper portion of the cup washer may increase. In the embodiment, the water tank 120 may be disposed on the lower portion of the cup washer to lower the center of gravity of the cup washer, thereby effectively preventing the tipping over of the cup washer.

The liquid input module may include a detergent storage 136, a rinse storage 137, a detergent injection part 138, a rinse injection part 139, a detergent pump 1301, and a rinse pump 1302.

The detergent storage 136 may be disposed behind the tub 131 to store detergent. The rinse storage 137 may be disposed behind the tub 131 separately from the detergent storage 136 to store rinse. Therefore, the detergent and the rinse may not be mixed.

A detergent inlet 211 into which detergent is input and a rinse inlet 212 into which rinse is input may be provided on the top cover 210. The detergent inlet 211 may be connected to the detergent storage 136, and the rinse inlet 212 may be connected to the rinse storage 137. Therefore, the detergent and the rinse introduced through the detergent inlet 211 and the rinse inlet 212 may be stored in the detergent storage 136 and the rinse storage 137.

The detergent injection part 138 may be connected to the detergent storage 136 and the tub 131 to inject the detergent into the tub 131. An inlet of the detergent injection part 138 may be connected to the detergent storage 136 and an outlet thereof may be connected to the tub 131.

The rinse injection part 139 may be connected to the rinse storage 137 and the tub 131 to inject the rinse into the tub 131. An inlet of the rinse injection part 139 may be connected to the rinse storage 137 and an outlet thereof may be connected to the tub 131.

The detergent pump 1301 may be connected to the detergent injection part 138 to pump the detergent to the tub 131. The rinse pump 1302 may be connected to the rinse injection part 139 to pump the rinse to the tub 131. Operations of the detergent pump 1301 and the rinse pump 1302 may be controlled by the controller.

The controller may operate the detergent pump 1301 to mix the detergent with water in the washing process and operate the rinse pump 1302 to mix the rinse with water in the rinsing process.

The water tank 120 may be connected to the tub 131 using a pipe and provided so that the water in the water tank 120 flows into the tub 131. Therefore, the water in the water tank 120 may flow into the tub 131 after being heated to become hot water and may be stored in the sump 133 until the circulation pump 134 operates.

Meanwhile, as described above, the tub 131 may also have a water supply path directly connected to the city water supply. Therefore, normal washing or rapid washing may be performed on the cup by the user's selection.

In normal washing, the cup may be washed using the hot water heated in the water tank 120, and the cup may be cleanly washed using detergent and rinse, but it may take a relatively longer time.

In rapid washing, since the cup may be washed using cold tap water supplied from the city water supply, does not use detergent or rinse, and thus the washing time is relatively shorter, a user who intends to quickly wash a cup that is relatively less contaminated may conveniently use the cup washer.

Figure 28:
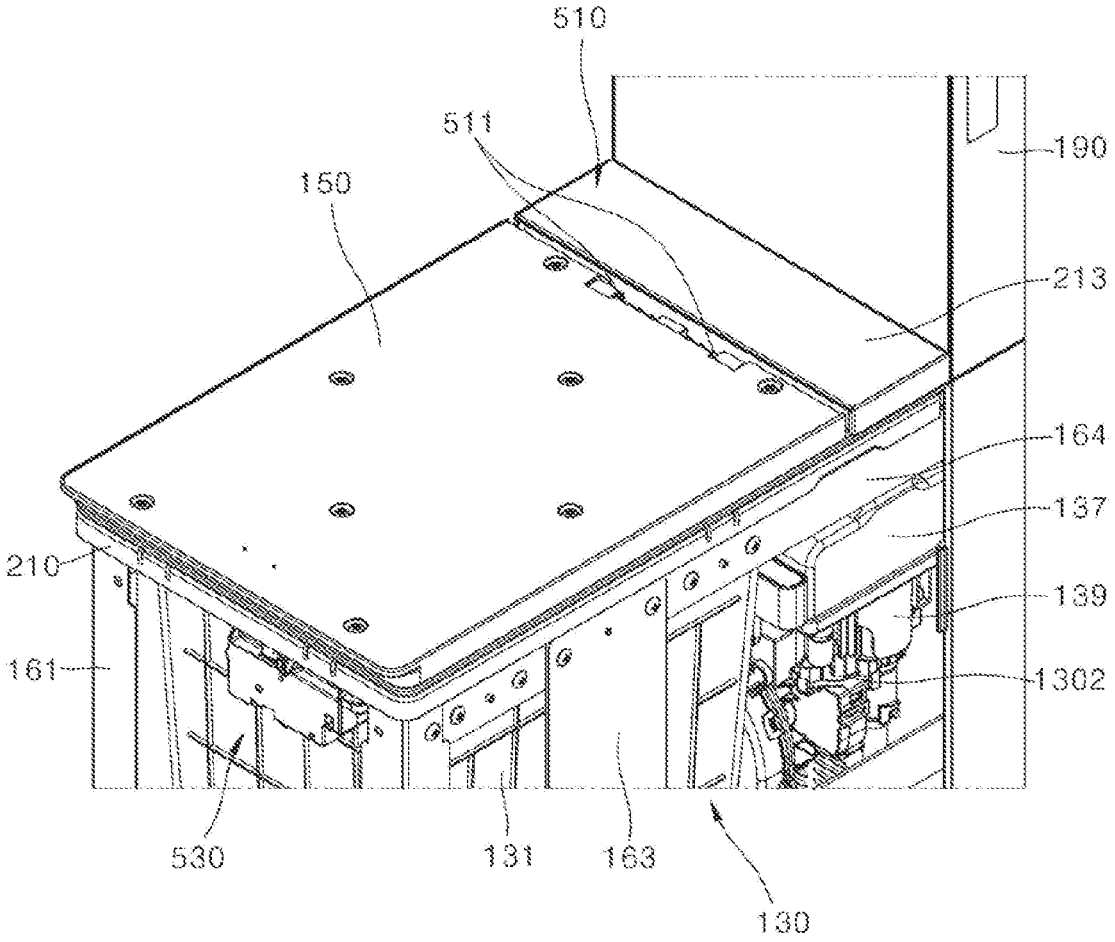
FIG. 28 is a perspective view illustrating a state in which an upper cover of a door is omitted.
Figure 29:
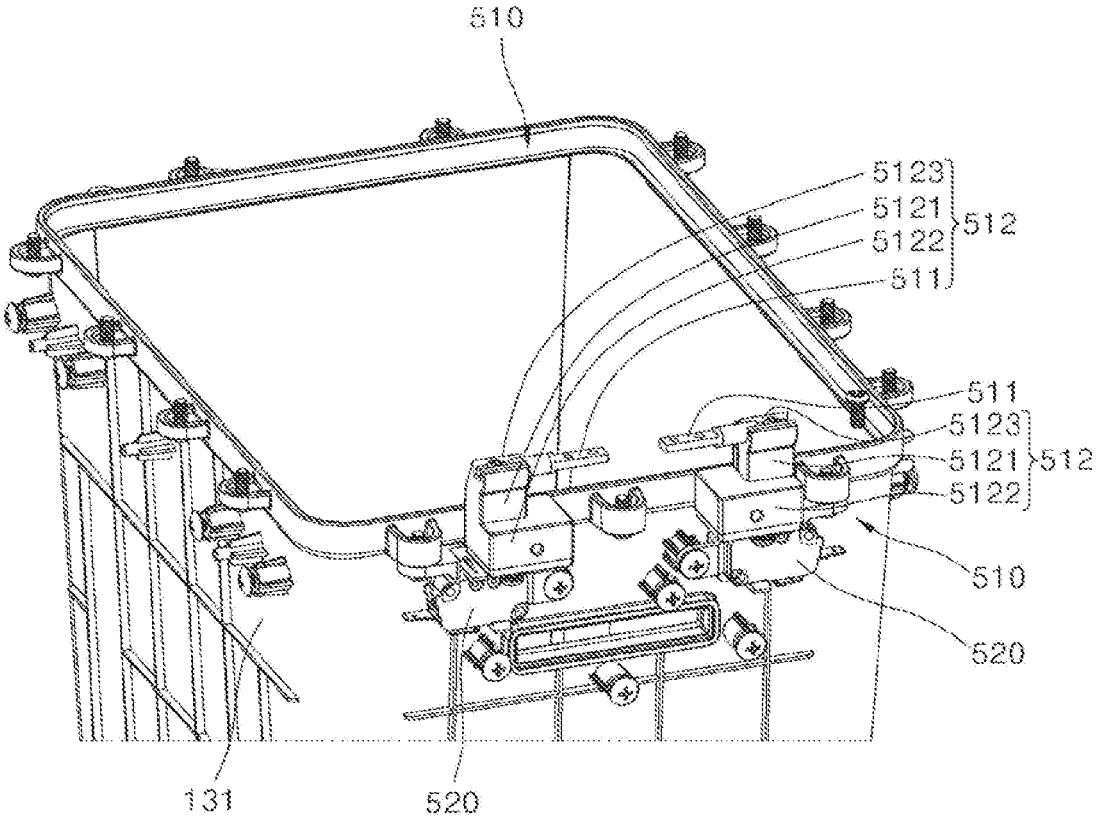
FIG. 29 is a perspective view illustrating a hinge support according to one embodiment.

FIG. 28 is a perspective view illustrating a state in which an upper cover of the door 150 is omitted. FIG. 29 is a perspective view illustrating a hinge support 510 according to one embodiment.

The cup washer according to the embodiment may include the washing unit 130, the top cover 210, and the door 150. The washing unit 130 may wash the accommodated cup 10. The top cover 210 may be disposed on the upper end of the washing unit 130, and the door 150 may be disposed thereon. The door 150 may be disposed above the washing unit 130 and may hinge-rotate in the vertical direction to open and close an open upper portion of the washing unit 130.

The washing unit 130 may be coupled so that the door 150 is hinge-coupled thereto. A user may open or close the door 150 by rotating the door 150 in the vertical direction. The washing unit 130 may include the tub 131 and the hinge support 510.

The tub 131 may provide a space in which the cup 10 is accommodated, and washing water may be sprayed to the space. The hinge support 510 may be disposed outside the tub 131 and may include a hinge shaft 511 mounted on the door 150.

A pair of hinge supports 510 may be provided to be disposed at positions spaced apart from each other, and the pair of hinge supports 510 may be disposed in a symmetrical form. Each of the pair of hinge supports 510 may be rotatably coupled to the door 150. Likewise, each component to be described below constituting the hinge support 510 may also be provided in a pair.

The hinge support 510 may include the hinge shafts 511 and support parts 512. The hinge shafts 511 may be coupled to the door 150 to rotate together according to the rotation of the door 150. The hinge shafts 511 may be fixedly coupled to the door 150. Therefore, when the user rotates the door 150, the door 150 and the hinge shafts 511 may rotate together.

The support parts 512 may be coupled to the tub 131, and the hinge shafts 511 may be rotatably supported by being inserted into the supports 512. The support parts 512 may be fixedly coupled to the tub 131, and the hinge shafts 511 may be rotatably coupled with respect to the support parts 512. Therefore, when the user rotates the door 150, the hinge shafts 511 rotate with respect to the support parts 512, and thus the door 150 may hinge-rotate with respect to the support parts 512.

Figure 30:
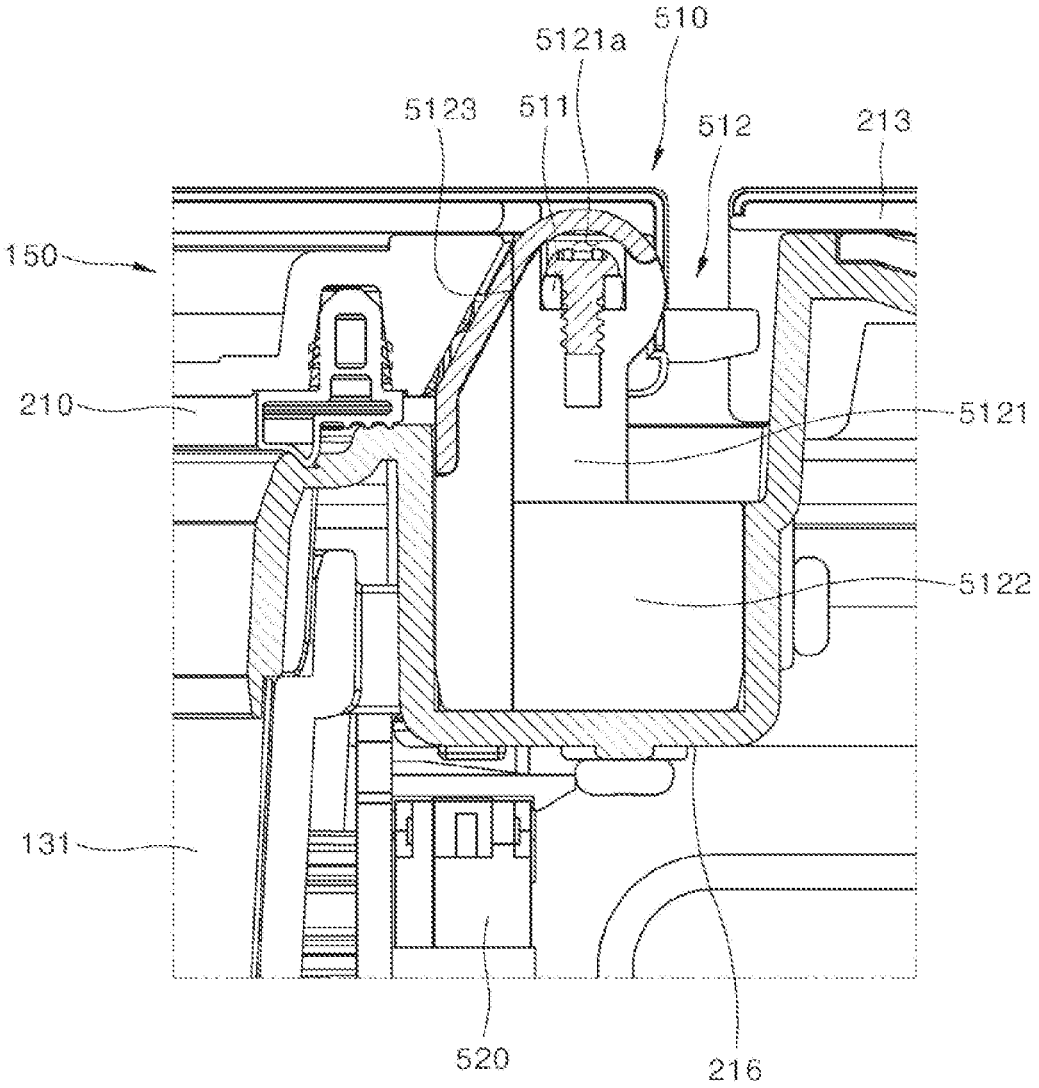
FIG. 30 is a cross-sectional view illustrating the hinge support.

FIG. 30 is a cross-sectional view illustrating the hinge support 510. As illustrated in FIG. 30, the support part 512 may include a first support part 5121, a second support part 5122, and a cover part 5123.

An insertion hole 5121*a* into which the hinge shaft 511 is rotatably coupled may be formed in the first support part 5121. The hinge shaft 511 may be inserted into the insertion hole 5121*a* to be hinge-rotated with respect to the first support part 5121, and the door 150 may also rotate together with the hinge shaft 511.

The second support part 5122 may be coupled to the top cover 210 to support the first support part 5121. The first support part 5121 and the second support part 5122 may be integrally formed. The first support part 5121 may be formed in a shape protruding from the second support part 5122.

The cover part 5123 may be coupled to the first support part 5121 to close an open portion of the insertion hole 5121*a*. In a state in which the cover part 5123 is removed, when the hinge shaft 511 is inserted into the insertion hole 5121*a* of the first support part 5121 and the cover part 5123 is re-coupled to the first support part 5121, the hinge shaft 511 may be rotatably coupled to the first support part 5121.

The top cover 210 may include a seating groove 216 in which the second support part 5122 is seated. The second support part 5122 may be fixedly coupled to the top cover 210. Therefore, the hinge shaft 511 may stably hinge-rotate with respect to the support part 512.

The seating groove 216 may be provided in the top cover 210, and the second support part 5122 may be seated in the seating groove 216. A pair of seating grooves may be provided to be disposed at positions spaced apart from each other in correspondence to the pair of second support parts 5122.

As illustrated in FIG. 30, in a state where the second support part 5122 is seated in the seating groove 216, the second support part 5122 may be fixedly coupled to the top cover 210 by a fastener such as a screw. Therefore, the support part 512 may be fixedly coupled to the top cover 210 to stably support the rotation of the hinge shaft 511.

In the embodiment, the door 150 may be rotatably supported by the hinge support 510 to rotate in the vertical direction. In addition, the door 150 may be disposed above the washing unit 130. Therefore, a user may open or close the door 150 by hinge-rotating the door 150. Therefore, since the user may open or close the door 150 with a relatively smaller motion without bending down, such a structure may provide the user's convenience.

The cup washer may include an opening/closing detector 520. A pair of opening/closing detectors 520 may be provided to be disposed at positions spaced apart from each other in correspondence to the pair of hinge supports 510.

The opening/closing, detector 520 may be disposed under the support part 512, coupled to the tub 131, and may detect the rotation of the hinge shaft 511 to detect whether the door 150 is opened or closed. The opening/closing detector 520 may detect the rotation of the hinge shaft 511 by comparing the rotation of the hinge shaft 511 with an arrangement angle of the hinge shaft 511 in a state in which the door 150 is closed, and when the hinge shaft 511 rotates at a set angle or more, the opening/closing detector 520 may detect that the door 150 is opened.

The opening/closing detector 520 may be connected to the controller, and the controller receiving an open signal of the door 150 from the opening/closing detector 520 may detect the opening of the door 150 and thus each step of the washing operation may be performed.

For example, the opening/closing detector 520 and the support part 512 may be electrically connected, and a switch structure that is turned on or off depending on whether the hinge shaft 511 rotates at a set angle or more may be provided on the support part 512. The opening/closing detector 520 may detect the opening/closing of the door 150 after receiving a signal from the switch structure provided in the support part 512.

In another embodiment, a Hall sensor structure of detecting the rotation of the hinge shaft 511 may be provided in the support part 512, and the opening/closing detector 520 may detect the opening/closing of the door 150 after receiving a signal from the Hall sensor structure.

Figure 31:
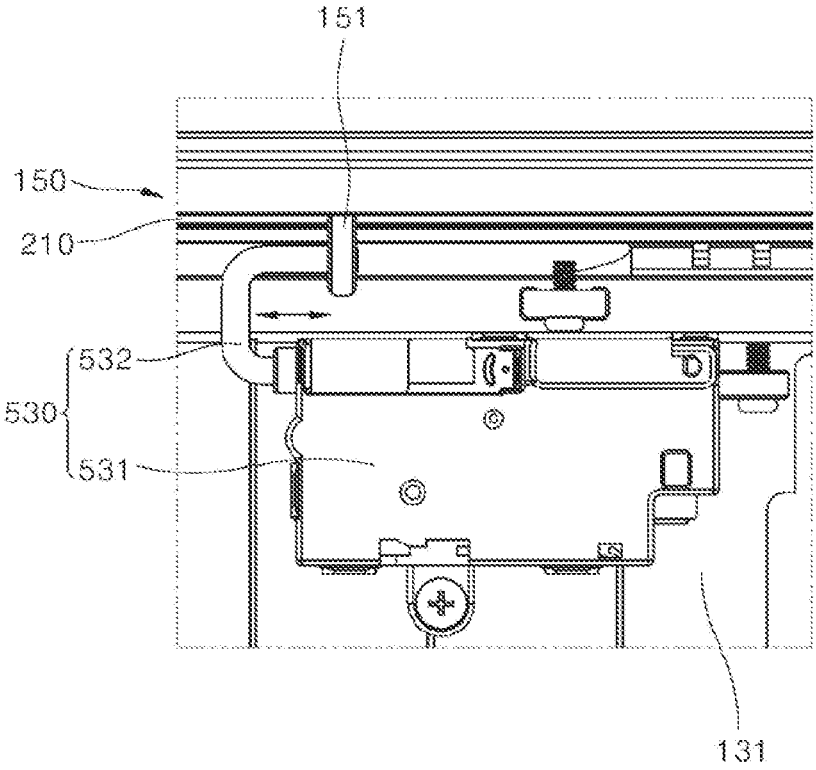
FIG. 31 is a view illustrating a locking device according to one embodiment.

FIG. 31 is a view illustrating a locking device 530 according to one embodiment. The cup washer may include the locking device 530 for locking the door 150. The locking device 530 may be disposed in front of the washing unit 130, disposed outside the washing unit 130, and coupled to the tub 131 to lock the door 150.

In the washing process in which water is sprayed to the tub 131 and hot air for drying is sprayed to the tub 131, it is necessary to lock the door 150 to protect the user and prevent water from leaking to the outside. Locking and unlocking of the door 150 may be performed by the controller.

The locking device 530 may include a locking control unit 531 and a latching unit 532. The locking control unit 531 may be coupled to the tub 131 to control an operation of locking or unlocking the door 150. The locking control unit 531 may be connected to the controller of the cup washer to lock or unlock the door 150 after receiving a control signal from the controller.

The latching unit 532 may have one side inserted into the locking control unit 531 to reciprocately move with respect to the locking control unit 531 according to the operation of the locking control unit 531 to open or close the door 150. The latching unit 532 may have substantially a lying U shape, have one end portion movably coupled to the locking control unit 531, and have the other end portion provided to move with respect to a latching part 151 of the door 150, and thus may be inserted into or separated from the latching part 151.

As indicated by a left-right arrow in FIG. 31, the latching unit 532 may be provided to reciprocately move with respect to the locking control unit 531. The locking control unit 531 may lock or unlock the door 150 by reciprocately moving the latching unit 532.

The door 150 may include the latching part 151 for locking or unlocking the door 150 by the reciprocating movement of the latching unit 532. The other side of the latching unit 532 may be inserted into the latching part 151, and the latching unit 532 may be inserted or separated according to the movement of the latching unit 532.

Figure 32:
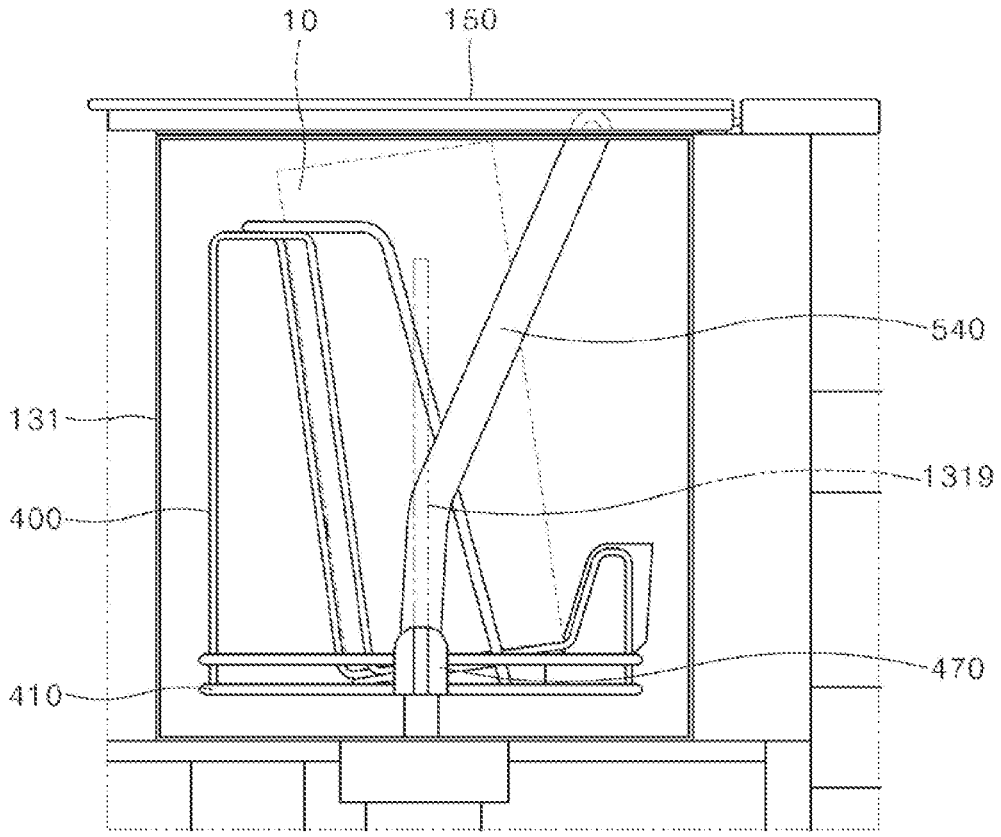
FIG. 32 is a cross-sectional view illustrating a tub and a link part according to one embodiment.
Figure 33:
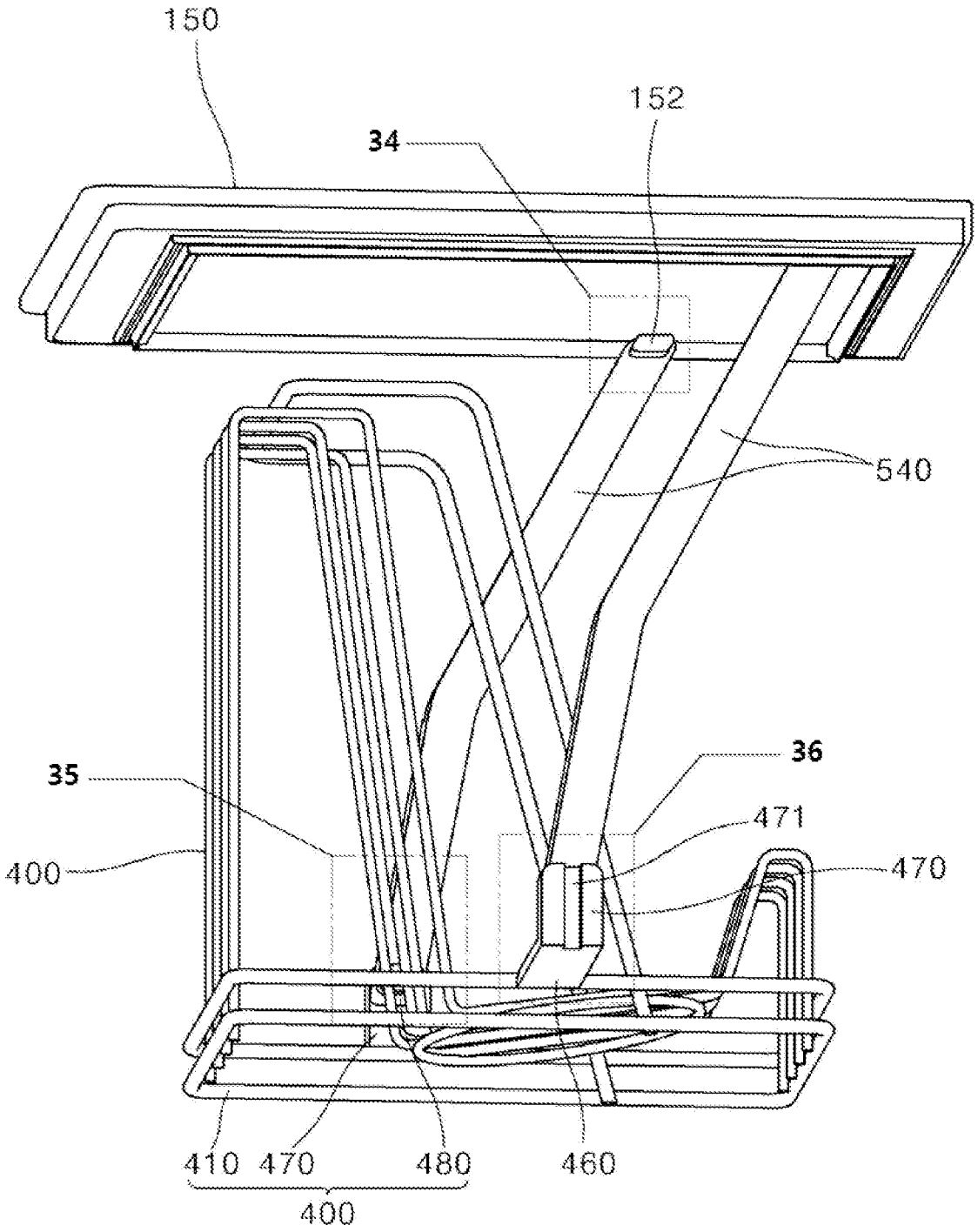
FIG. 33 is a perspective view illustrating a door, a link part, and a rack according to one embodiment.

FIG. 32 is a cross-sectional view illustrating the tub 131 and a link part 540 according to one embodiment. FIG. 33 is a perspective view illustrating the door 150, the link part 540, and the rack 400 according to one embodiment. The cup washer may include the rack 400 and the link part 540.

The rack 400 may be provided inside the tub 131, and a cup may be seated on the rack 400. The rack 400 may be manufactured using a wire and may entirely have a mesh structure so that sprayed water may easily wash the cup seated on the rack 400 after passing through the rack 400.

The link part 540 may connect the door 150 to the rack 400 and move the rack 400 up as the door 150 rotates after being opened. The link part 540 may be formed in substantially a flat and long rod shape. A pair of link parts 540 may be provided to be disposed at positions spaced apart from each other.

In a state in which the door 150 is fully opened, an upper portion of the link part 540 needs to be positioned behind the washing unit 130 so that a user does not feel uncomfortable upon putting the cup on the rack 400 or taking the cup out from the rack 400. Therefore, the link part 540 may be formed to have a smooth curve in a longitudinal direction, and an upper end portion of the link part 540 may be rotatably coupled to the rear of the door 150.

The link part 540 may be connected to the door 150, and the rack 400 may be connected to the link part 540. Therefore, the link part 540 and the rack 400 may move up or down with respect to the tub 131 according to the opening/closing of the door 150.

When the door 150 is opened in a closed state, the door 150 may be hinge-rotated upward, and thus both the link part 540 and the rack 400 may move upward. Conversely, when the door 150 is closed in the open state, the door 150 may be hinge-rotated downward, and thus both the link part 540 and the rack 400 may move downward.

Therefore, when the user opens the door 150, the link part 540 and the rack 400 may move up together so that a user may put the cup on the rack 400 or take the cup out from the rack 400 without bending down, and thus this structure may provide the user's convenience.

Figure 34:
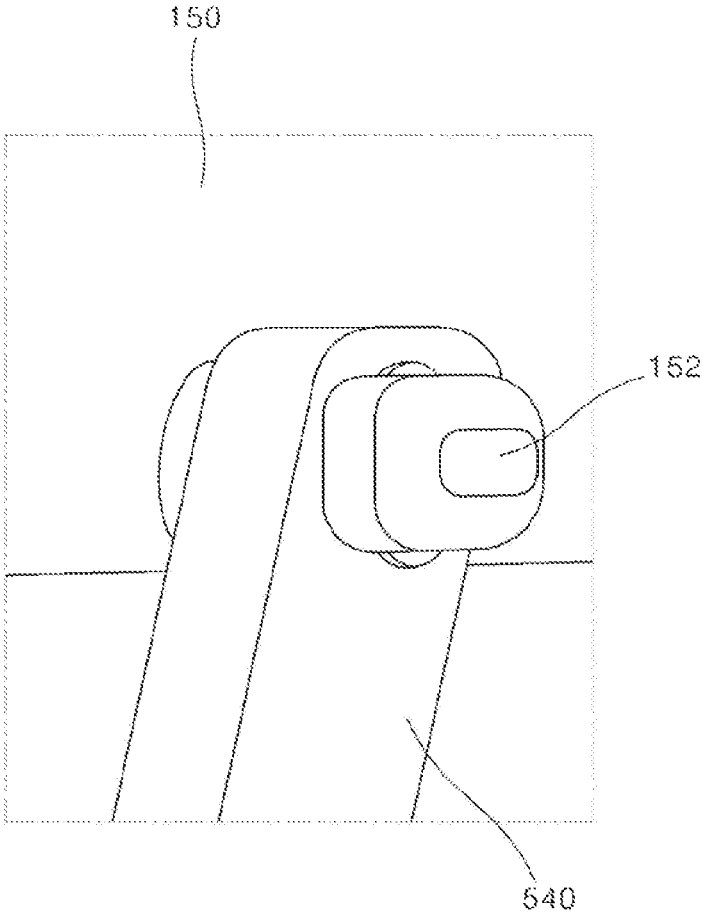
FIG. 34 is an enlarged view illustrating portion 34 in FIG. 33.
Figure 35:
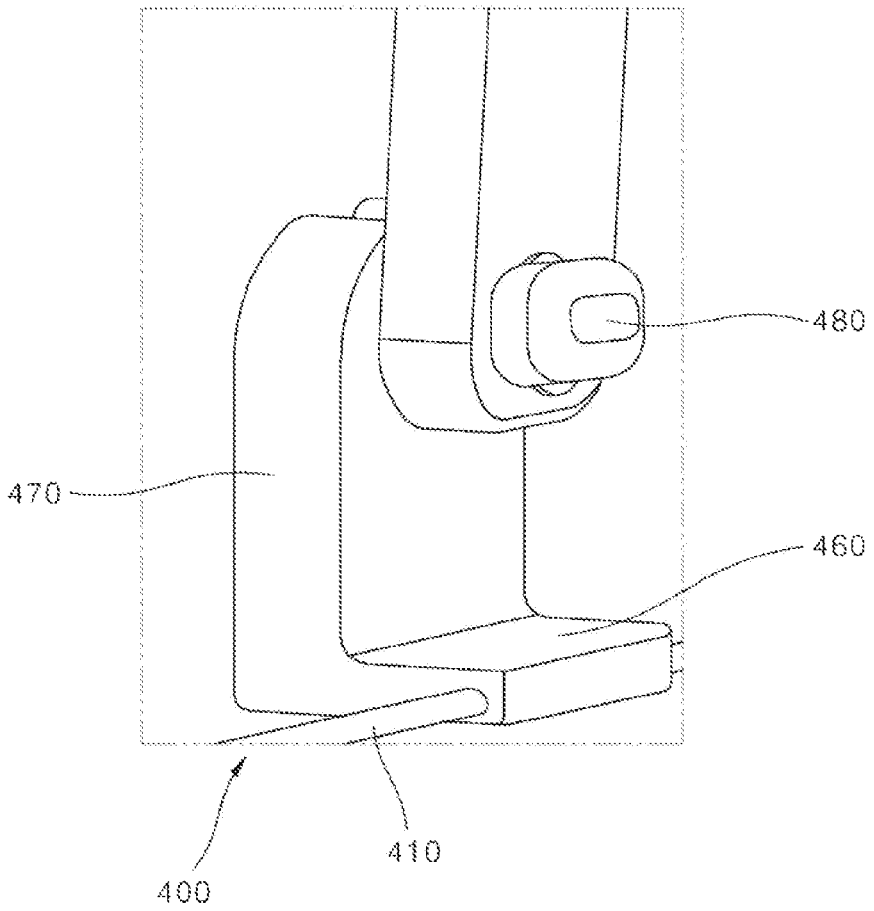
FIG. 35 is an enlarged view illustrating portion 35 in FIG. 33.

FIG. 34 is an enlarged view illustrating portion 34 in FIG. 33. FIG. 35 is an enlarged view illustrating portion 35 in FIG. 33.

The link part 540 may have one end portion rotatably coupled to the door 150 and the other end portion rotatably coupled to the rack 400. Therefore, the link part 540 may rotate with respect to both the door 150 and the rack 400.

With this structure, even when the door 150 rotates in a process of being opened and closed, the link part 540 may rotate and thus the rack 400 may perform a linear motion in the vertical direction of the tub 131 with respect to the rotational movement of the door 150. Therefore, while the door 150 rotates, the rack 400 may straightly move up or down in the vertical direction of the tub 131.

The door 150 may include a first mounting protrusion 152 on which one side of the link part 540 is rotatably mounted. The first mounting protrusion 152 may protrude from the door 150 inward of the door 150, and the upper end portion of the link part 540 may be rotatably coupled to the first mounting protrusion 152.

Therefore, when the door 150 rotates, the link coupled to the first mounting protrusion 152 may move up and down while rotating with respect to the door 150, and thus the rack 400 rotatably coupled to the link may straightly move up or down in the vertical direction.

Referring to FIG. 33, the rack 400 may include a bottom portion 410, a connecting portion 460, a guide portion 470, and a second mounting protrusion 480. The cup may be seated on the bottom portion 410 and the cup seated on the rack 400 may be supported at a lower side. In order to stably support the cup, the bottom portion 410 may be provided in a shape that is widely expanded in front-rear and left-right directions in a lateral direction of the tub 131.

The connecting portion 460 may extend from the bottom portion 410, and the guide portion 470 may be coupled to an end portion of the connecting portion 460. The guide portion 470 may be bent at the connecting portion 460 and may guide the rack 400 to move in the vertical direction of the washing unit 130 as the door 150 rotates. The guide portion 470 may be guided by a guide rail 1319 to be described below to move in the vertical direction of the tub 131.

The second mounting protrusion 480 may protrude from the guide portion 470, and the link part 540 may be rotatably mounted on the second mounting protrusion 480. The second mounting protrusion 480 may protrude from the rack 400 inward of the rack 400, and the upper end portion of the link part 540 may be rotatably coupled to the second mounting protrusion 480.

Therefore, when the door 150 rotates, the link coupled to the second mounting protrusion 480 may move up and down while rotating with respect to the rack 400, and thus the rack 400 rotatably coupled to the link may straightly move up or down in the vertical direction.

Figure 36:
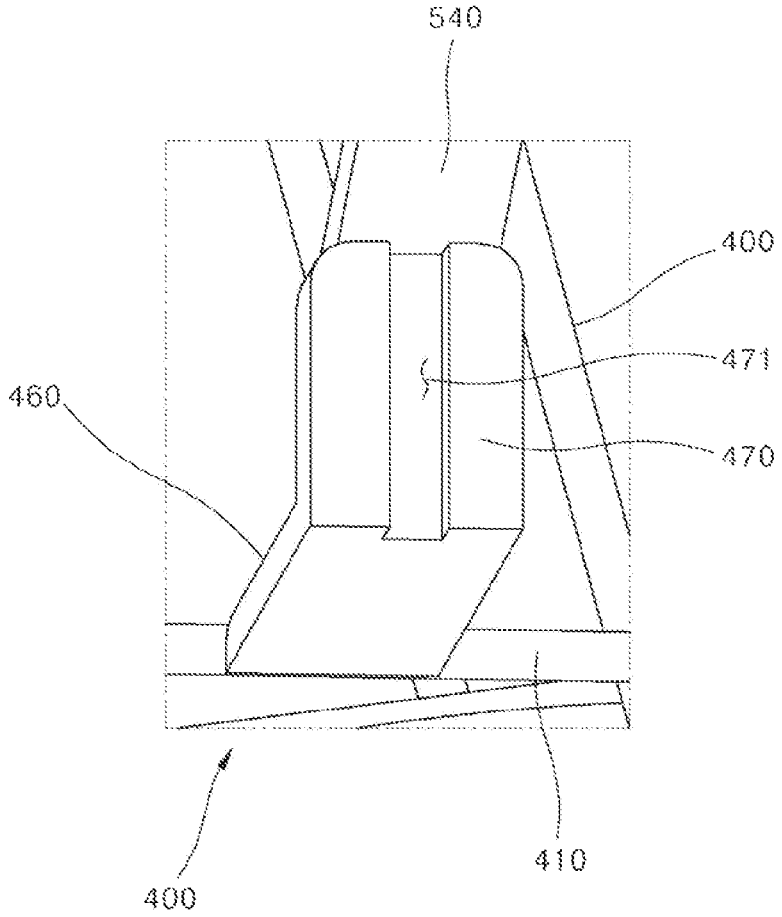
FIG. 36 is an enlarged view illustrating portion 36 in FIG. 33.
Figure 37:
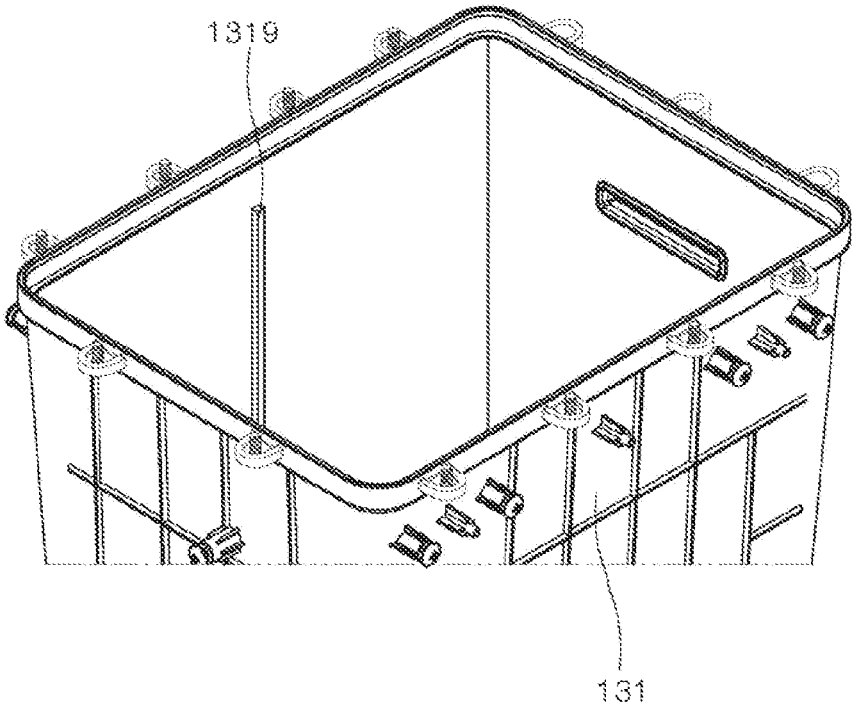
FIG. 37 is a view illustrating the inside of the tub.

FIG. 36 is an enlarged view illustrating portion 36 in FIG. 33. FIG. 37 is a view illustrating the inside of the tub 131.

The tub 131 may include the guide rail 1319 which is formed to protrude from an inner surface of a side wall and of which a longitudinal direction is disposed in the vertical direction of the tub 131. A pair of guide rails 1319 disposed to face each other may be provided, and a pair of guide portions 470 of the rack 400 to which the guide rails 1319 are coupled may also be provided.

Correspondingly, the guide portion 470 may include a rail groove 471 of which the longitudinal direction is disposed in the vertical direction of the tub 131 and in which the guide rail 1319 is seated. As the rail groove 471 is moved by being guided by the guide rail 1319, the entire rack 400 may be moved by being guided by the guide rail 1319.

The guide rail 1319 may be straightly disposed in the vertical direction of the tub 131. Therefore, the guide rail 1319 seated in the rail groove 471 may be guided by the guide rail 1319 to move in the vertical direction of the tub 131.

The rack 400 may straightly move up and down in the vertical direction of the tub 131 along the guide rail 1319. Therefore, even when the door 150 and the link part 540 rotate when the door 150 is opened and closed, the rack 400 may move up and down in the vertical direction of the tub 131 without rotating.

When the door 150 is opened by being rotated in a dosed state, the rack 400 may be guided by the guide rail 1319 to move up in the tub 131. Conversely, when the door 150 is closed by being rotated in the opened state, the rack 400 may be guided by the guide rail 1319 to move down in the tub 131.

Therefore, when a user opens the door 150, the rack 400 may move up, and the user may conveniently put the cup on the rack 400 disposed at a position moving up in the tub 131 without bending down. When the user closes the door 150 after putting the cup on the rack 400, the rack 400 and the put cup may be moved down and disposed at a designed position inside the tub 131, and washing may be performed.

After the washing is completed, when the user re-opens the door 150, the rack 400 and the cup may move up, and thus the user may conveniently collect the cup from the rack 400 without bending down.

Figure 38:
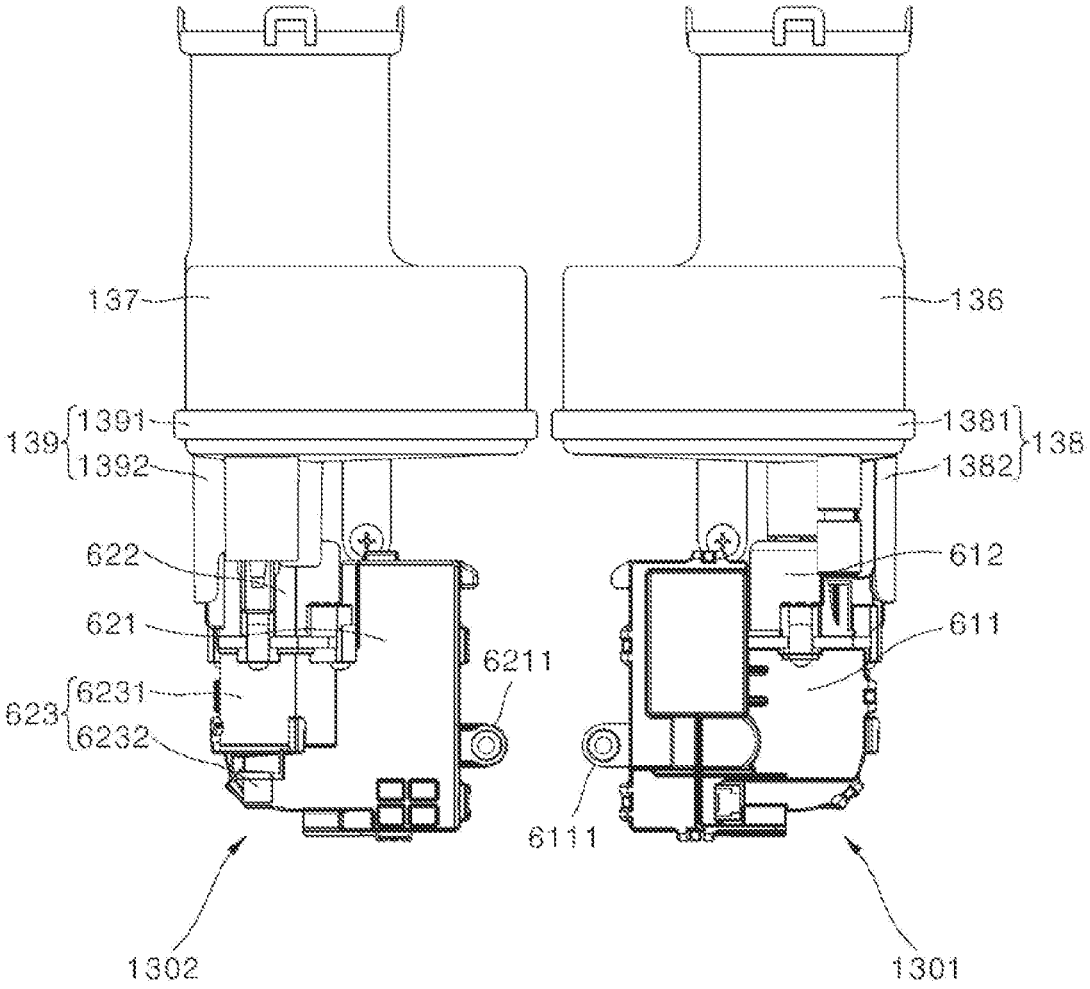
FIG. 38 is a view illustrating a detergent injection device and a rinse injection device according to one embodiment.
Figure 39:
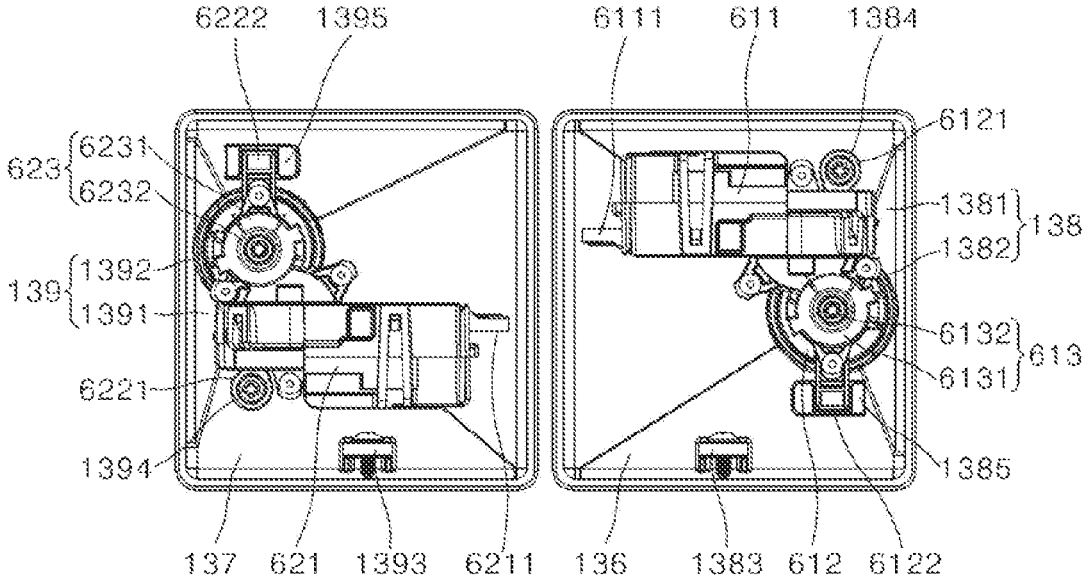
FIG. 39 is a bottom view illustrating the detergent injection device and the rinse injection device.

FIG. 38 is a view illustrating a detergent injection device and a rinse injection device according to one embodiment. FIG. 39 is a bottom view illustrating the detergent injection device and the rinse injection device. The cup washer may include the washing unit 130 for washing the accommodated cup 10. The washing unit 130 may include the tub 131 which provides a space in which the cup 10 is accommodated and in which washing water is sprayed.

The washing unit 130 may include the detergent injection device for injecting detergent into the tub 131 and the rinse injection device for injecting rinse into the tub 131. The cup may be washed by the detergent mixed with water and sprayed to the cup. The cup may be rinsed after the cup is washed by the rinse mixed with water and sprayed to the cup.

Therefore, the rinse may be used to rinse the cup after the detergent is used to wash the cup. That is, the detergent and the rinse may be mixed with the water sprayed to the tub 131 with a time difference. The detergent and the rinse may be provided in a liquid state and pumped by the detergent pump 1301 and the rinse pump 1302 to flow into the tub 131. The detergent injection device and the rinse injection device may be disposed outside the tub 131.

The detergent injection device may include the detergent storage 136, the detergent injection part 138, and the detergent pump 1301. The detergent storage 136 may be disposed at one side of the tub 131 to store detergent. A manager may periodically pour detergent into the detergent storage 136 to store the detergent in the detergent storage 136.

The detergent injection part 138 may be coupled to a lower portion of the detergent storage 136 to inject the detergent in the detergent storage 136 into the detergent pump 1301. Since the detergent injection part 138 is disposed under the detergent storage 136, detergent may be collected in the detergent injection part 138 by gravity and injected into the detergent pump 1301.

The detergent pump 1301 may be connected to the detergent injection part 138 to pump the detergent to the tub 131. The operation of the detergent pump 1301 may be controlled by the controller provided in the cup washer. The detergent pump 1301 may operate at a set time point to pump the detergent introduced from the detergent injection part 138 to the tub 131.

The detergent pump 1301 may include a first body 611, a first connector 612, and a detergent discharge unit 613. The first body 611 may include a motor for providing a pumping force for discharging detergent, a gear device connecting the motor to discharging devices of the detergent discharge unit 613, and the like therein.

The first connector 612 may be coupled to the first body 611 and connected to the detergent injection part 138 so that detergent may be introduced from the detergent injection part 138. The first connector 612 may connect the detergent injection part 138 to the detergent discharge unit 613.

One side of the detergent discharge unit 613 may be connected to the first connector 612 and the other side thereof may be connected to the tub 131 to discharge detergent into the tub 131. A pipe may be connected to the other side of the detergent discharge unit 613 so that the detergent discharged from the detergent discharge unit 613 may be injected into the tub 131 through the pipe.

The detergent discharge unit 613 may include the detergent pumping part 6131 and a detergent injection nozzle 6132. The detergent pumping part 6131 may be connected to the first connector 612 to pump the detergent introduced from the first connector 612. The detergent pumping part 6131 may be driven by receiving a driving force from a motor provided in a body to generate a pumping force and pump the detergent flowing into the first connector 612 to the tub 131.

The detergent injection nozzle 6132 may be coupled to the detergent pumping part 6131 and connected to the tub 131. For example, a pipe connected to the tub 131 may be mounted on one end portion of the detergent injection nozzle 6132. The detergent injection nozzle 6132 may inject detergent into the tub 131. The detergent injection nozzle 6132 may be formed to have a smaller inner diameter than the detergent pumping part 6131 has and connected to the pipe.

Figure 40:
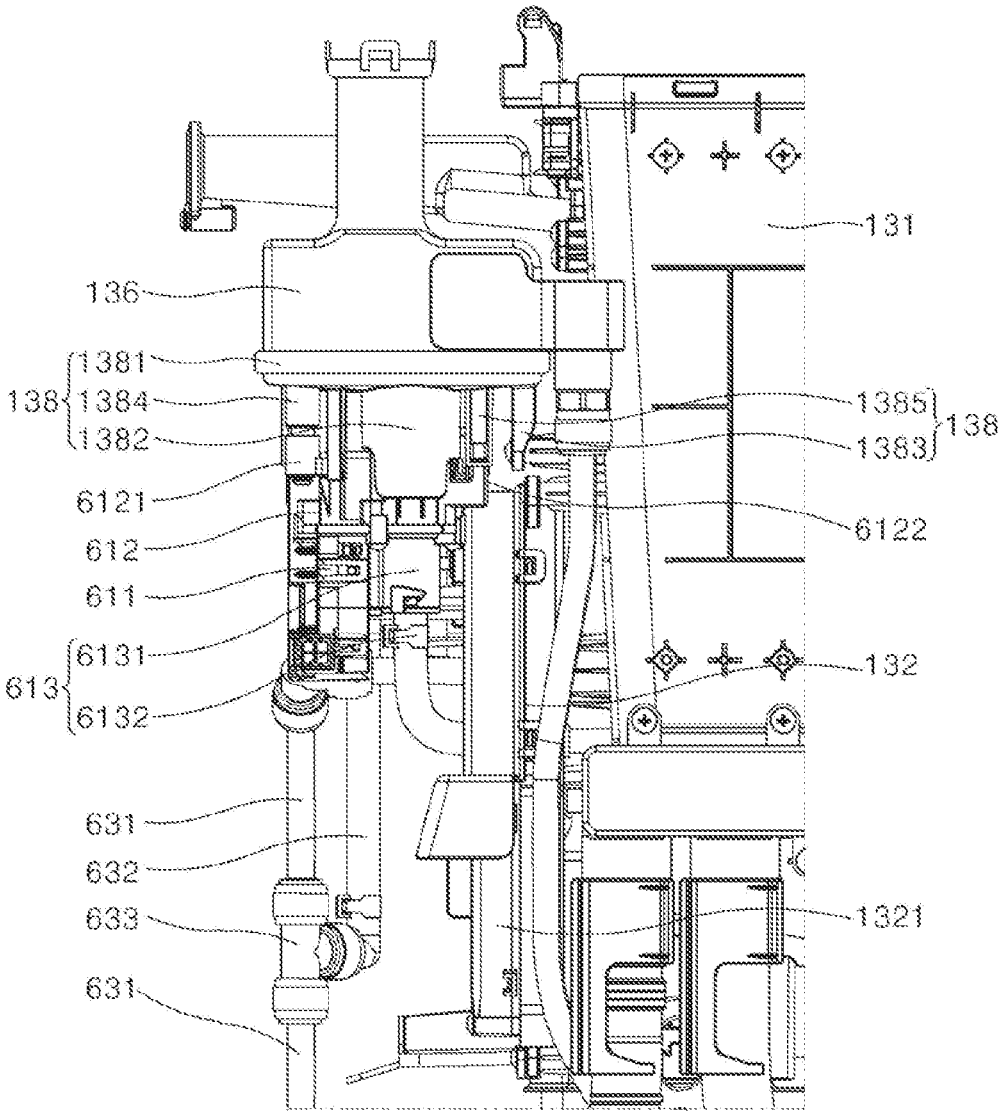
FIG. 40 is a side view illustrating a portion of the washing unit.
Figure 41:
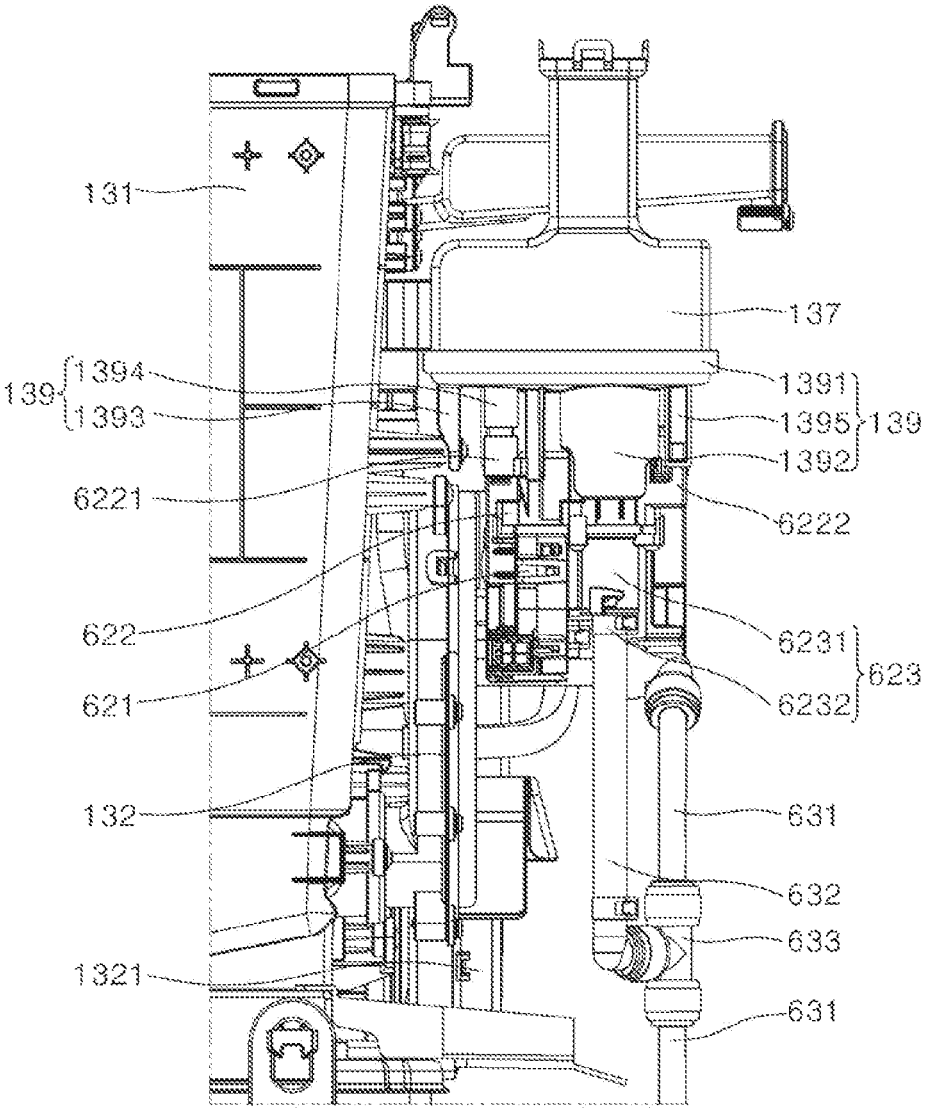
FIG. 41 is a side view illustrating the portion of the washing unit of FIG. 40 in an opposite direction.

FIG. 40 is a side view illustrating a portion of the washing unit 130. FIG. 41 is a side view illustrating the portion of the washing unit of FIG. 40 in an opposite direction.

The rinse injection device may include the rinse storage 137, the rinse injection part 139, and the rinse pump 1302. Referring to FIGS. 38 and 39, the detergent injection device and the rinse injection device may have a similar outer shape, and some components thereof may be symmetrically disposed in the horizontal direction and the vertical direction.

The rinse storage 137 may be disposed at the one side of the tub 131 separately from the detergent storage 136 to store rinse. The manager may periodically pour rinse into the rinse storage 137 to store the rinse in the rinse storage 137.

The rinse injection part 139 may be coupled to a lower portion of the rinse storage 137 to inject the rinse in the rinse storage 137 into the rinse pump 1302. Since the rinse injection part 139 is disposed on the lower portion of the rinse storage 137, rinse may be collected in the rinse injection part 139 by gravity and injected into the rinse pump 1302.

The rinse pump 1302 may be connected to the rinse injection part 139 to pump the rinse to the tub 131. The operation of the rinse pump 1302 may be controlled by the controller provided in the cup washer. The rinse pump 1302 may operate at a set time point to pump the rinse introduced from the rinse injection part 139 to the tub 131.

The rinse pump 1302 may include a second body 621, a second connector 622, and a rinse discharge unit 623. The second body 621 may include a motor for providing a pumping force for discharging rinse, a gear device connecting the motor to discharging devices of the rinse discharge unit 623, and the like therein.

The second connector 622 may be coupled to the second body 621 and connected to the rinse injection part 139 so that rinse may be introduced from the rinse injection part 139. The second connector 622 may connect the rinse injection part 139 to the rinse discharge unit 623.

One side of the rinse discharge unit 623 may be connected to the second connector 622 and the other side thereof may be connected to the tub 131 to discharge rinse into the tub 131. A pipe may be connected to the other side of the rinse discharge unit 623 so that the rinse discharged from the rinse discharge unit 623 may be injected into the tub 131 through the pipe.

The rinse discharge unit 623 may include a rinse pumping part 6231 and a rinse injection nozzle 6232. The rinse pumping part 6231 may be connected to the second connector 622 to pump the rinse introduced from the second connector 622. The rinse pumping part 6231 may be driven by receiving a driving force from a motor provided in a body to generate a pumping force and pump the rinse flowing into the second connector 622 to the tub 131.

The rinse injection nozzle 6232 may be coupled to the rinse pumping part 6231 and connected to the tub 131. For example, a pipe connected to the tub 131 may be mounted on one end portion of the rinse injection nozzle 6232. The rinse injection nozzle 6232 may inject rinse into the tub 131. The rinse injection nozzle 6232 may be formed to have a smaller inner diameter than the rinse pumping part 6231 has and connected to the pipe.

In the embodiment, the detergent injection device and the rinse injection device may be separately disposed outside the tub 131 in the washing unit 130. Water flowing into the tub 131 may be mixed with detergent or rinse by the detergent injection device or the rinse injection device.

Therefore, when the cup is washed by spraying water, the washing water in which water and detergent are mixed may be sprayed to the cup, thereby increasing the washing efficiency for the cup. In addition, when the cup is rinsed after being washed, the washing water in which water and rinse are mixed may be sprayed to the cup to effectively rinse the cup.

In the embodiment, the detergent pump 1301 and the rinse pump 1302 may be connected to the controller provided in the cup washer and may operate at a time set by the controller to inject detergent or rinse into the tub 131 to be mixed with water in the tub 131. A manager may periodically replenish detergent and rinse in the detergent storage 136 and the rinse storage 137.

Therefore, a user who intends to wash his/her cup may conveniently use detergent, thereby increasing the washing efficiency for the cup, and cleanly rinse the cup using rinse after washing the cup without having to perform a separate operation for adding detergent and rinse to water.

Figure 42:
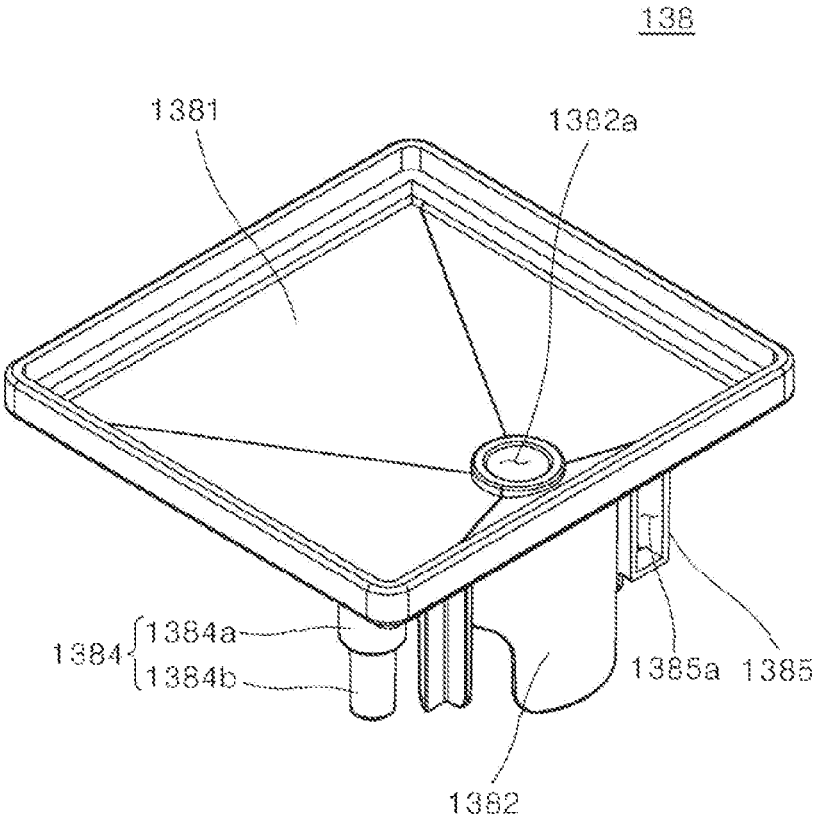
FIG. 42 is a perspective view illustrating a detergent injection part according to one embodiment.
Figure 43:
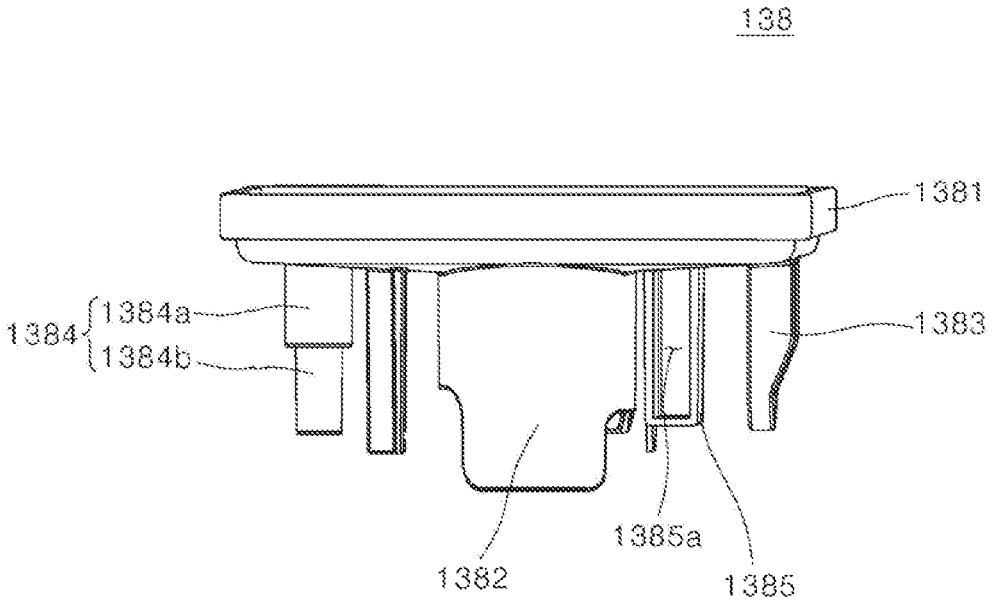
FIG. 43 is a view illustrating the detergent injection part of FIG. 42 in another direction.
Figure 44:
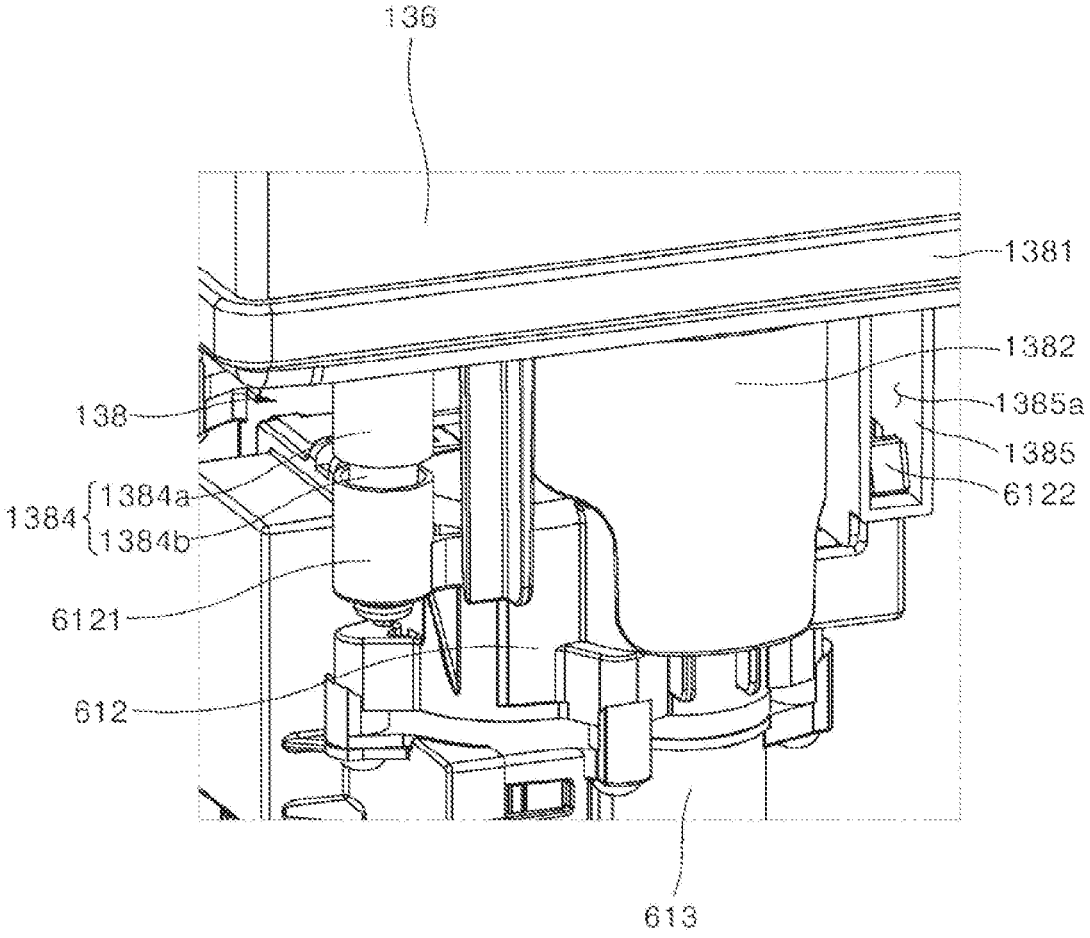
FIG. 44 is a view illustrating a portion of the detergent injection device.
Figure 45:
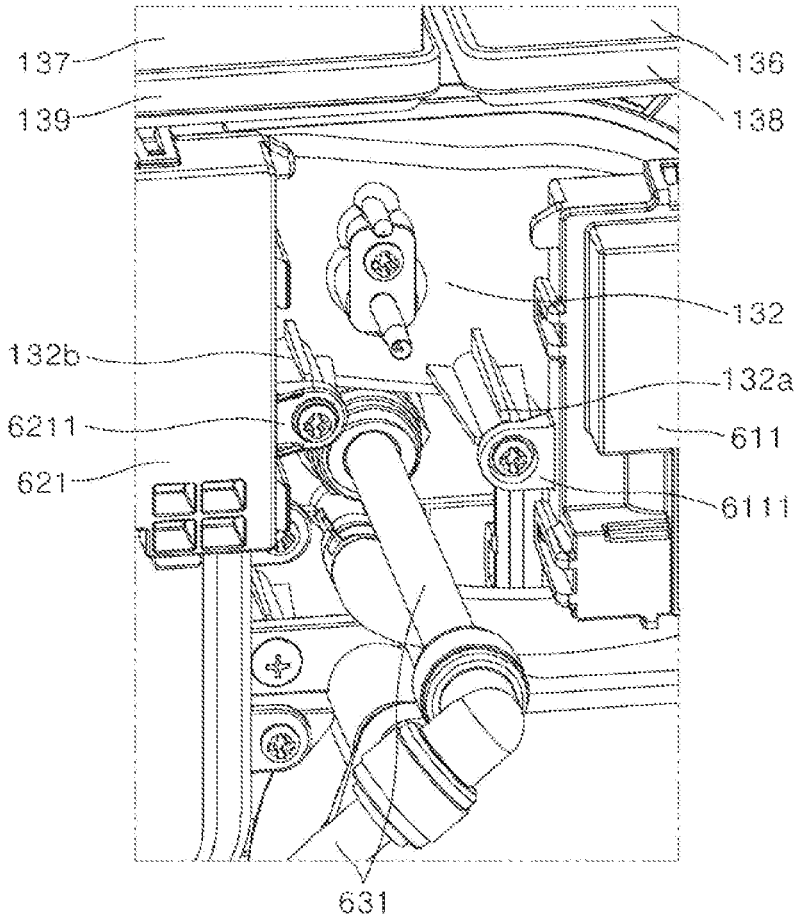
FIG. 45 is a view illustrating a portion of the washing unit.

FIG. 42 is a perspective view illustrating the detergent injection part 138 according to one embodiment. FIG. 43 is a view illustrating the detergent injection part of FIG. 42 in another direction. FIG. 44 is a view illustrating a portion of the detergent injection device. FIG. 45 is a view illustrating a portion of the washing unit 130.

The detergent injection part 138 may include a first lower cover 1381 and a first connecting portion 1382. The first lower cover 1381 may be coupled to the lower portion of the detergent storage 136 to cover an open lower surface of the detergent storage 136. Since the first lower cover 1381 covers a lower surface of the detergent storage 136, liquid detergent stored in the detergent storage 136 may be moved down by gravity and disposed on an upper surface of the first lower cover 1381.

The first connecting portion 1382 may protrude downward from the first lower cover 1381, may be coupled to the first connector 612, and may have a first flow hole 1382*a* through which detergent flows formed therein. The detergent disposed on the upper surface of the first lower cover 1381 may flow into the first connector 612 through the first flow hole 1382*a* provided in the first connecting portion 1382.

The upper surface of the first lower cover 1381 may be formed to be inclined to have a reduced height toward the first flow hole 1382*a*. Therefore, the liquid detergent disposed on the upper surface of the first lower cover 1381 may be collected to an inlet of the first flow hole 1382*a* disposed at a lowest position of the inclined upper surface of the first lower cover 1381 after flowing along the upper surface of the first lower cover 1381 by gravity.

The detergent collected to the inlet of the first flow hole 1382*a* may move down through the first flow hole 1382*a* to pass through the first connector 612 and flow into the detergent discharge unit 613 and may be pumped by the detergent pumping part 6131 to flow into the tub 131 through the detergent injection nozzle 6132 and the pipe.

Figure 46:
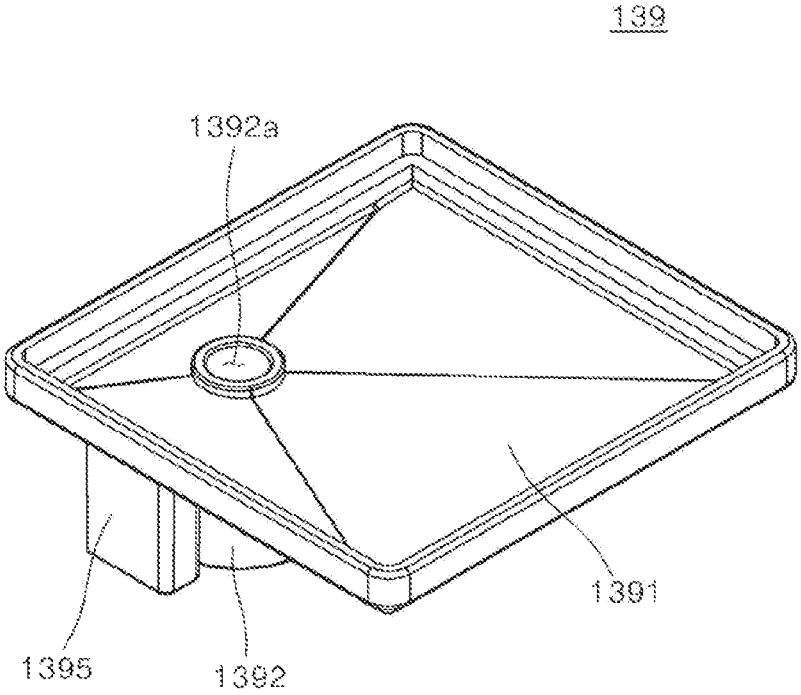
FIG. 46 is a perspective view illustrating a rinse injection part according to one embodiment.
Figure 47:
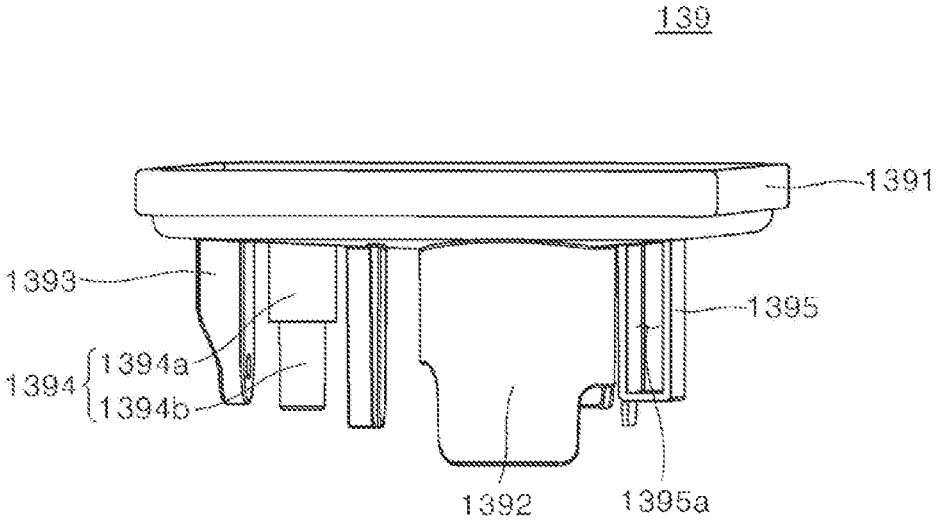
FIG. 47 is a view illustrating the rinse injection part of FIG. 46 in another direction.
Figure 48:
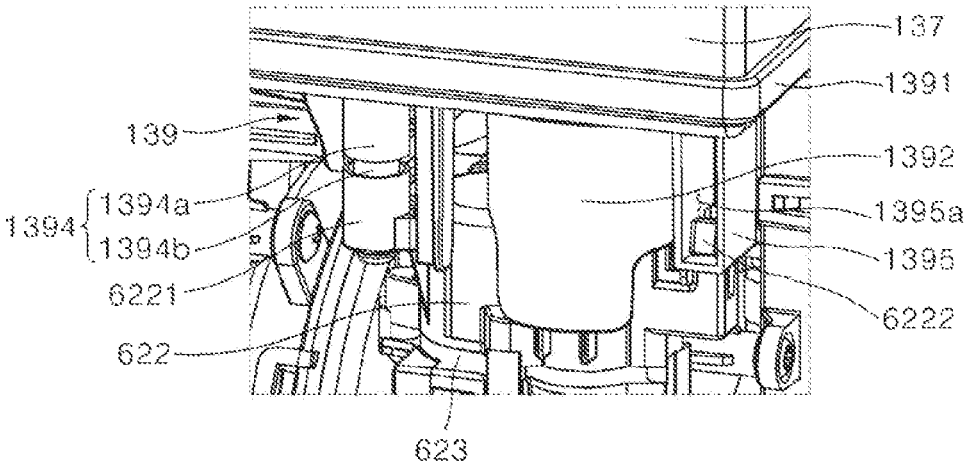
FIG. 48 is a view illustrating a portion of the rinse injection device.

FIG. 46 is a perspective view illustrating the rinse injection part 139 according to one embodiment. FIG. 47 is a view illustrating the rinse injection part of FIG. 46 in another direction. FIG. 48 is a view illustrating a portion of the rinse injection device.

The rinse injection part 139 may include a second lower cover 1391 and a second connecting portion 1392. The second lower cover 1391 may be coupled to the lower portion of the rinse storage 137 to cover an open lower surface of the rinse storage 137. Since the second lower cover 1391 covers the lower surface of the detergent storage 137, liquid rinse stored in the rinse storage 137 may be moved down by gravity and disposed on an upper surface of the second lower cover 1391.

The second connecting portion 1392 may protrude downward from the second lower cover 1391, may be coupled to the second connector 622, and may have a second flow hole 1392*a* through which rinse flows formed therein. The rinse disposed on the upper surface of the second lower cover 1391 may flow into the second connector 622 through the second flow hole 1392*a* provided in the second connecting portion 1392.

The upper surface of the second lower cover 1391 may be formed to be inclined to have a reduced height toward the second flow hole 1392*a*. Therefore, the liquid rinse disposed on the upper surface of the second lower cover 1391 may be collected to an inlet of the second flow hole 1392*a* disposed at a lowest position of the inclined upper surface of the second lower cover 1391 after flowing along the upper surface of the second lower cover 1391 by gravity.

The rinse collected to the inlet of the second flow hole 1392*a* may move down through the second flow hole 1392*a* to pass through the second connector 622 and flow into the rinse discharge unit 623 and may be pumped by the rinse pumping part 6231 to flow into the tub 131 through the rinse injection nozzle 6232 and the pipe.

Meanwhile, as illustrated in FIG. 9, the tub 131 may include a detergent inlet 1312 and a washing water inlet 1315. The detergent inlet 1312 may be connected to the detergent injection nozzle 6132 with a pipe, and detergent may flow into the tub 131 from the detergent injection nozzle 6132. Detergent discharged from the detergent discharge unit 613 may flow into the tub 131 through the detergent inlet 1312.

The washing water inlet 1315 may be disposed above the detergent inlet 1312, and water may flow into the tub 131. The washing water inlet 1315 may be connected to the water tank 120 with a pipe, and hot water from the water tank 120 may flow into the tub 131 through the washing water inlet 1315.

Figure 49:
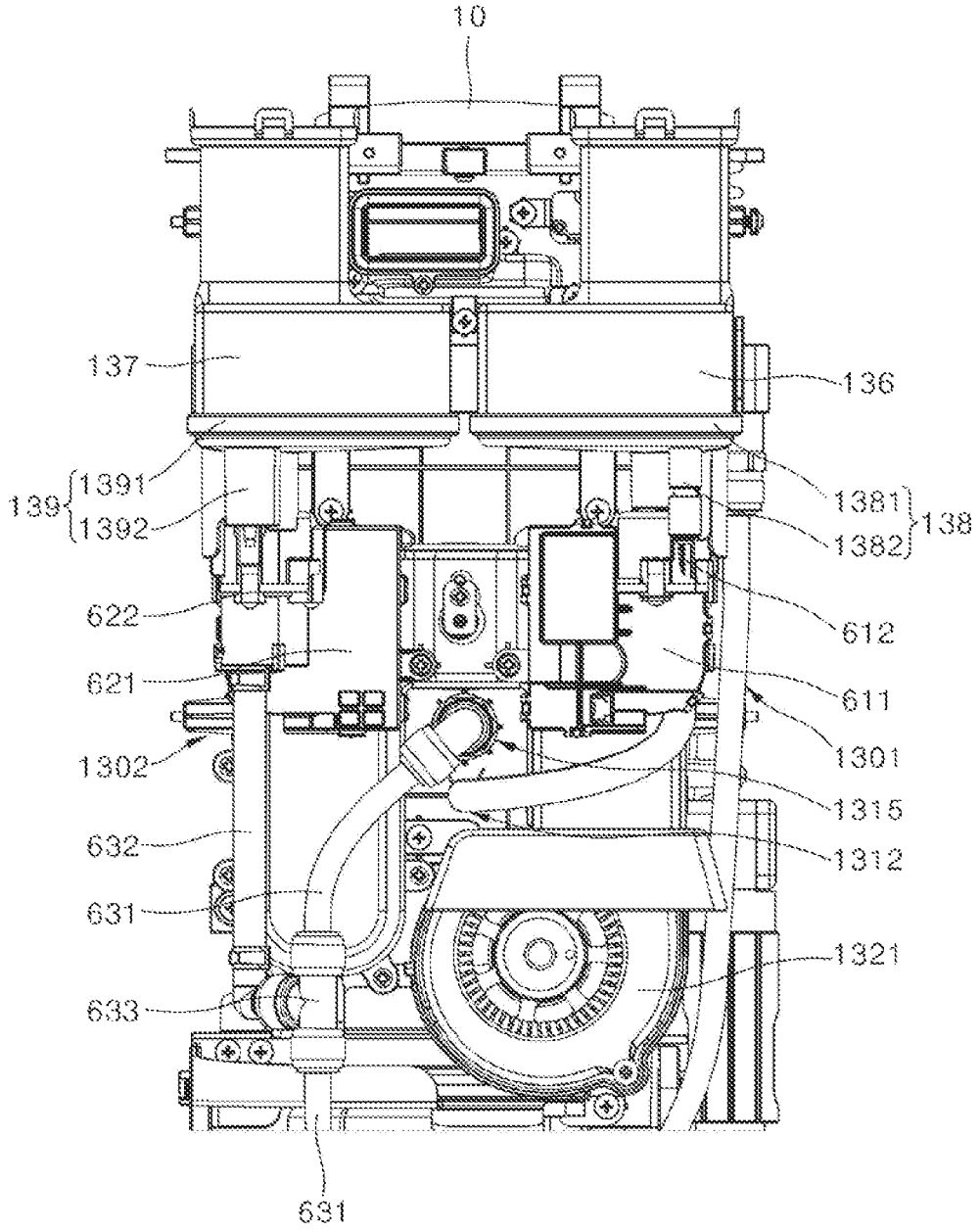
FIG. 49 is a view illustrating a structure in which pipes are connected to the washing unit.

In addition, the rinse may flow into the tub 131 through the washing water inlet 1315. This will be described in detail below. FIG. 49 is a view illustrating a structure in which a pipe is connected to the washing unit 130.

The cup washer may include the water tank 120, a first connecting pipe 631, a second connecting pipe 632, and a three-way fitting 633. The water tank 120 may be disposed under the washing unit 130 to store water for washing the cup.

The first connecting pipe 631 may connect the washing water inlet 1315 to the water tank 120. Water in the water tank 120 may be heated by a heating device to flow into the tub 131 through the first connecting pipe 631 and the washing water inlet 1315.

The second connecting pipe 632 may connect the rinse injection nozzle 6232 to the first connecting pipe 631. The three-way fitting 633 may be mounted on the first connecting pipe 631, and one end of the second connecting pipe 632 may be mounted thereon. Therefore, the rinse discharged from the rinse injection nozzle 6232 may be mixed with the water flowing through the first connecting pipe 631 at the three-way fitting 633, and the water mixed with rinse may flow into the tub 131 through the washing water inlet 1315.

With this structure, the rinse discharged from the rinse injection nozzle 6232 may flow into the first connecting pipe 631 from the second connecting pipe 632 and may be mixed with the water flowing through the first connecting pipe 631 to flow into the tub 131.

When the rinsing operation is performed, first, water mixed with filth and detergent stored in the sump 133 may be drained to the outside of the cup washer using the drain pump 135. Thereafter, hot water from the water tank 120 may re-flow into the tub 131 through the washing water intel 1315 and may be stored in the sump 133 under the tub 131.

The cap may be rinsed by spraying water to the cup accommodated in the tub 131 while circulating the water stored in the sump 133 between the tub 131 and the sump 133 using the circulation pump 134. When this rinsing operation is performed, the rinse may be mixed with water.

When water flows into the tub 131 from the water tank 120 and is filled in the sump 133 for the rinsing operation, the rinse may be simultaneously pumped at a time point at which the water flows through the first connecting pipe 631. At this time, the second connecting pipe 632 through which the rinse flows may be connected to the first connecting pipe 631 through the three-way fitting 633, and thus the rinse may be mixed with water to flow into the tub 131.

In the three-way fitting 633, water and rinse are mixed to flow together, and when the water and the rinse continuously flow and are stored in the sump 133, the water and the rinse are further mixed so that the water and the rinse may become a state of being uniformly mixed in the sump 133.

Meanwhile, the rinse may be used for the rinsing operation of washing off the detergent remaining on the surfaces of the cup after the washing operation using detergent is completed. Therefore, the detergent and the rinse need to be separated without being mixed with each other in the entire process of washing the cup.

Therefore, the detergent inlet 1312 separated from the washing water inlet 1315 may be formed in the tub 131, and the detergent injection nozzle 6132 and the detergent inlet 1312 may be connected with a separate pipe different from the first connecting pipe 631 or the second connecting pipe 632.

In the embodiment, the rinse may flow into the tub 131 through the second connecting pipe 632, the three-way fitting 633, the first connecting pipe 631, and the washing water inlet 1315. On the other hand, detergent may be introduced through the detergent inlet 1312 connected through a separate pipe. In addition, time points at which the detergent and the rinse flow into the tub 131 may be different.

With this structure, paths through which the detergent and the rinse are injected into the tub 131 may be separated so that the detergent and the rinse are not mixed, thereby increasing the efficiency of the washing operation and the rinsing operation of the cup washer.

In the embodiment, water and rinse may meet and flow in one pipe to flow into the tub 131 through the washing water inlet 1315. Therefore, the water and the rinse may be more uniformly mixed while flowing, and the washing water in which the water and the rinse are uniformly mixed may be sprayed to the cup, and thus the rinsing operation of the cup may be effectively performed.

As described above, the cup washer may include the drying module 132, the sump 133, the circulation pump 134, and the drain pump 135. The drying module 132 may be disposed on a side surface portion of the tub 131 to be connected to the tub 131 to blow heated air into the tub 131. After the above-described washing operation and rinsing operation are performed, the drying module 132 may be operated to dry the cup with the water remaining on the surfaces of the cup accommodated in the tub 131.

The sump 133 may be disposed under the tub 131 to be connected to the tub 131 to store the water sprayed from the tub 131. The circulation pump 134 may be disposed under the tub 131 to be connected to the tub 131 and the sump 133 to circulate water between the tub 131 and the sump 133. The cup accommodated in the tub 131 may be washed or rinsed by operating the circulation pump 134 to circulate and spray water to the tub 131.

The drain pump 135 may be disposed under the tub 131 to be connected to the sump 133 to discharge water from the sump 133 to the outside. After completing the washing operation or the rinsing operation, the water stored in the sump 133 may be discharged to the outside of the cup washer through the drain pump 135.

As illustrated in FIGS. 43 and 44, the detergent injection part 138 may include a 1-1 cover coupling protrusion 1383, a 1-2 cover coupling protrusion 1384, and a 1-3 cover coupling protrusion 1385. The 1-1 cover coupling protrusion 1383 may protrude from the first lower cover 1381 and may be coupled to the tub 131. In the tub 131, a coupling protrusion may protrude at a position corresponding to the 1-1 cover coupling protrusion 1383, and the 1-1 cover coupling protrusion 1383 and the coupling protrusion of the tub 131 may be coupled by a fastener such as a screw.

The 1-2 cover coupling protrusion 1384 may protrude from the first lower cover 1381 and may be coupled to the first connector 612. The 1-3 cover coupling protrusion 1385 may protrude from the first lower cover 1381, and a first insertion groove **1385*a* may be formed in the 1-3 cover coupling protrusion 1385**.

Correspondingly, the first connector 612 may include a first fastening portion 6121 and a first coupling hook 6122.

The first fastening portion 6121 may be formed to protrude laterally from the first connector 612 to be fastened to the 1-2 cover coupling protrusion 1384.

The 1-2 cover coupling protrusion 1384 may include a first large-diameter portion 1384*a* having a relatively larger outer diameter, and a first small-diameter portion 1384*b* protruding from the first large-diameter portion 1384*a* and having a relatively smaller outer diameter. A hole into which a fastener is fastened may be formed in each of the first large-diameter portion 1384*a* and the first small-diameter portion 1384*b*.

A hole may be formed in the first fastening portion 6121 of the first connector 612, and the first small-diameter portion 1384*b* of the 1-2 cover coupling protrusion 1384 may be inserted into the hole of the first fastening portion 6121. In a state in which the first small-diameter portion 1384*b* is inserted into the first fastening portion 6121, the 1-2 cover coupling protrusion 1384 and the first fastening portion 6121 may be coupled by a fastener.

The first coupling hook 6122 may be inserted into the first insertion groove 1385*a* and coupled to the 1-3 cover coupling protrusion 1385. The first insertion groove 1385*a* may be formed to have a predetermined length in a vertical direction of the detergent injection part 138. The first coupling hook 6122 may be inserted into the first insertion groove 1385*a* by moving in a longitudinal direction of the first insertion groove 1385*a*, that is, the vertical direction of the detergent injection part 138.

The first coupling hook 6122 may be formed not to be easily separated from the first insertion groove 1385*a* when moving down in a state of being inserted into the first insertion groove 1385*a*. Therefore, the 1-3 cover coupling protrusion 1385 may stably maintain a state of being coupled to the first connector 612 without a fastener.

As illustrated in FIG. 45, the detergent pump 1301 may be coupled to the drying module 132. To this end, a 1-1 module fastening portion 6111 may be provided in the first body 611 of the detergent pump 1301, and a 1-2 module fastening portion 132*a* may be provided in the drying module 132.

The 1-1 module fastening portion 6111 may be formed to protrude in a lateral direction of the first body 611 and fastened to the drying module 132. Correspondingly, the 1-2 module fastening portion 132*a* may protrude from the drying module 132 toward the 1-1 module fastening portion 6111, and the 1-1 module fastening portion 6111 may be fastened thereto. The 1-2 module fastening portion 132*a* and the 1-1 module fastening portion 6111 may be coupled by a fastener.

Therefore, a portion of the detergent injection device may be coupled to the tub 131 and the other portion thereof may be coupled to the drying module 132. With this structure, the drying module 132 may be disposed between the tub 131 and the detergent injection device, and at least portions of the drying module 132 and the detergent injection device may be disposed to overlap each other.

Therefore, by reducing a space in which the drying module 132 and the detergent injection device are disposed, it is possible to increase the space efficiency of the cup washer. In addition, since the detergent injection device is coupled to both the drying module 132 and the tub 131, it is possible to firmly couple the drying module 132 to the tub 131.

As illustrated in FIGS. 47 and 48, the rinse injection part 139 may include a 2-1 cover coupling protrusion 1393, a 2-2 cover coupling protrusion 1394, and a 2-3 cover coupling protrusion 1395. The 2-1 cover coupling protrusion 1393 may protrude from the second lower cover 1391 and may be coupled to the tub 131. In the tub 131, a coupling protrusion may protrude at a position corresponding to the 2-1 cover coupling protrusion 1393, and the 2-1 cover coupling protrusion 1393 and the coupling protrusion of the tub 131 may be coupled by a fastener such as a screw.

The 2-2 cover coupling protrusion 1394 may protrude from the second lower cover 1391 and may be coupled to the second connector 622. The 2-3 cover coupling protrusion 1395 may protrude from the second lower cover 1391, and a second insertion groove 1395*a* may be formed in the 2-3 cover coupling protrusion 1395.

Correspondingly, the second connector 622 may include a second fastening portion 6221 and a second coupling hook 6222. The second fastening portion 6221 may be formed to protrude laterally from the second connector 622 to be fastened to the 2-2 cover coupling protrusion 1394.

The 2-2 cover coupling protrusion 1394 may include a second large-diameter portion 1394*a* having a relatively larger outer diameter, and a second small-diameter portion 1394*b* protruding from the second large-diameter portion 1394*a* and having a relatively smaller outer diameter. A hole into which a fastener is fastened may be formed in each of the second large-diameter portion 1394*a* and the second small-diameter portion 1394*b*.

A hole may he formed in the second fastening portion 6221 of the second connector 622, and the second small-diameter portion 1394*b* of the 2-2 cover coupling protrusion 1394 may be inserted into the hole of the second fastening portion 6221. In a state in which the second small-diameter portion 1394*b* is inserted into the second fastening portion 6221, the 2-2 cover coupling protrusion 1394 and the second fastening portion 6221 may be coupled by a fastener.

The second coupling hook 6222 may be inserted into the second insertion groove 1395*a* and coupled to the 2-3 cover coupling protrusion 1395. The second insertion groove 1395*a* may be formed to have a predetermined length in a vertical direction of the rinse injection part 139. The second coupling hook 6222 may be inserted into the second insertion groove 1395*a* by moving in a longitudinal direction of the second insertion groove 1395*a*, that is, the vertical direction of the rinse injection part 139.

The second coupling hook 6222 may be formed not to be easily separated from the second insertion groove 1395*a* when moving down in a state of being inserted into the second insertion groove 1395*a*. Therefore, the 2-3 cover coupling protrusion 1395 may stably maintain a state of being coupled to the second connector 622 without a fastener.

As illustrated in FIG. 45, the rinse pump 1302 may be coupled to the drying module 132. To this end, a 2-1 module fastening portion 6211 may be provided in the second body 621 of the rinse pump 1302, and a 2-2 module fastening portion 132*b* may be provided in the drying module 132.

The 2-1 module fastening portion 6211 may be formed to protrude in a lateral direction of the second body 621 and fastened to the drying module 132. Correspondingly, the 2-2 module fastening portion 132*b* may protrude from the drying module 132 toward the 2-1 module fastening portion 6211, and the 2-1 module fastening portion 6211 may be fastened thereto. The 2-2 module fastening portion 132*b* and the 2-1 module fastening portion 6211 may be coupled by a fastener.

Therefore, a portion of the rinse injection device may be coupled to the tub 131 and the other portion thereof may be coupled to the drying module 132. With this structure, the drying module 132 may be disposed between the tub 131 and the rinse injection device, and at least portions of the drying module 132 and the rinse injection device may be disposed to overlap each other.

Therefore, by reducing a space in which the drying module 132 and the rinse injection device are disposed, it is possible to increase the space efficiency of the cup washer. In addition, since the rinse injection device is coupled to both the drying module 132 and the tub 131, it is possible to firmly couple the drying module 132 to the tub 131.

Figure 50:
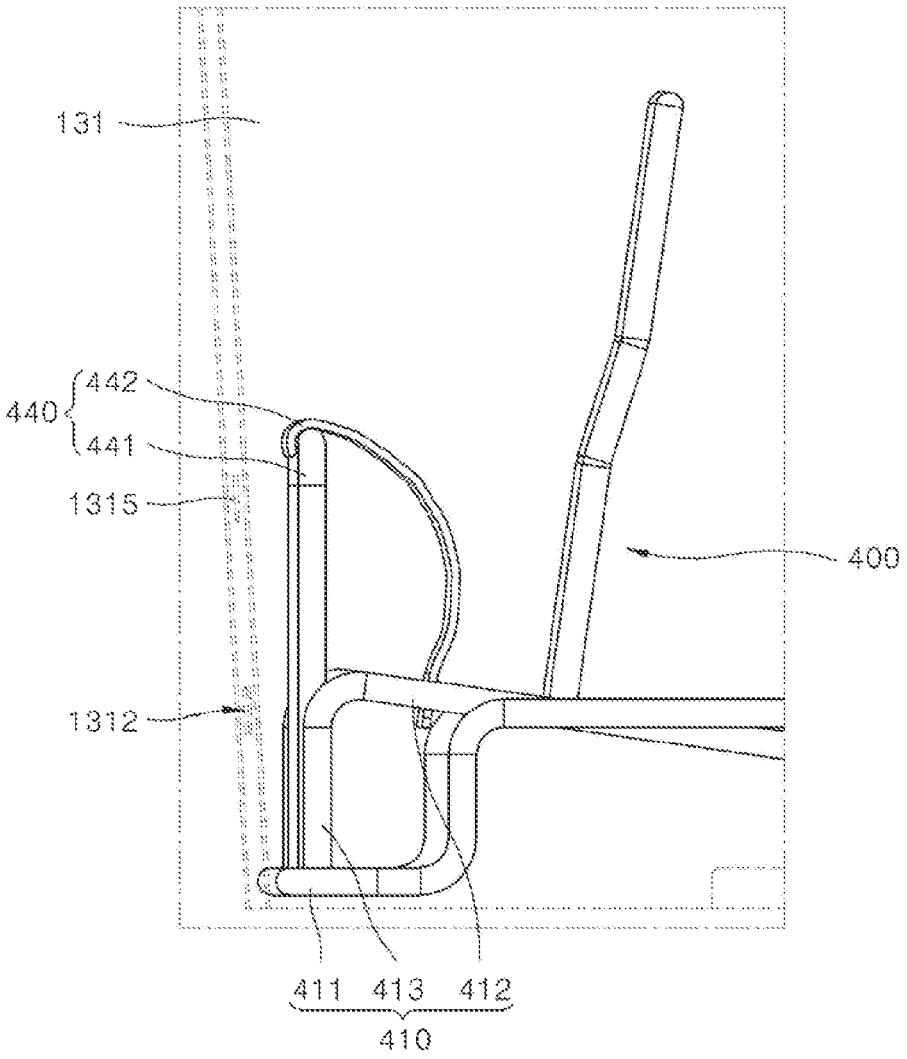
FIG. 50 is a side view illustrating a portion of the rack according to one embodiment.

FIG. 50 is a side view illustrating a portion of the rack 400 according to one embodiment. The washing water inlet 1315 may be disposed at a position spaced apart from the detergent inlet 1312 and disposed above the detergent inlet 1312. Therefore, the water flowing into the washing water inlet 1315 does not meet the detergent flowing into the tub 131, and the water may flow into the sump 133 under the tub 131, and likewise, the detergent may also flow into the sump 133, and then the detergent and the water may be mixed.

Since the flow of water is not somewhat active in a state of being stored in the sump 133, the water may not be well mixed with the detergent when the water and the detergent are mixed in the sump 133.

Therefore, in order to increase mixing efficiency, it is necessary to mix water with detergent around each inlet through which the water and the detergent flow into the tub 131. Since the water actively flows particularly at the inlet of the tub 131, the detergent may be easily mixed with the water when the water and the detergent are mixed around each inlet of the tub 131. This structure will be described below.

The tub 131 may include the washing water inlet 1315 and the detergent inlet 1312. The washing water inlet 1315 and the detergent inlet 1312 may be formed on the rear of the tub 131. The detergent inlet 1312 may be formed to pass through the one side of the tub 131 and may become a passage through which detergent flows into the tub 131. The washing water inlet 1315 may be disposed above the detergent inlet 1312 and may become a passage through which water flows into the tub 131.

The washing unit 130 may include the rack 400. The rack 400 may be provided inside the tub 131, the cup may be seated on the rack 400, and the rack 400 may be formed by coupling a plurality of wires. For example, a cup, a cup lid, a straw, or the like may be mounted on the rack 400.

In this case, the cup may be mounted upside down on the rack 400. That is, an open inlet of the cup may be disposed on the lower portion of the rack 400, and the bottom of the cup may be disposed on the upper portion of the rack 400. Therefore, water sprayed upward from a lower side of the rack 400 may smoothly flow into the cup to wash the inside of the cup.

The rack 400 may be formed in a three-dimensional mesh structure by entirely coupling wires. With this shape, a cup or the like may be easily mounted on the rack 400, and the sprayed water may easily wash the cup or the like mounted on the rack 400 with passing through the lower portion of the rack 400.

The rack 400 may include the bottom portion 410. The bottom portion 410 may be seated on the bottom of the tub 131 and support the cup seated on the rack 400 from a lower side. In order to stably support the cup or the like, the bottom portion 410 may be provided in a shape that is widely spread in front-rear and left-right directions in the lateral direction of the tub 131.

The bottom portion 410 may include an edge portion 411, a first inclined portion 412, and a first bent portion 413. The edge portion 411 may form edges of the bottom portion 410, and portions at both sides thereof may be formed to protrude upward from the tub 131.

The first inclined portion 412 may be disposed to have a longitudinal direction inclined with respect to the lateral direction of the tub 131. A plurality of first inclined portions 412 may be provided to be disposed at positions spaced apart from each other. Therefore, the plurality of first inclined portions 412 may form a bottom surface of the rack 400 on which the cup or the like is mounted.

Since each of the plurality of first inclined portions 412 has an inclination, the cup disposed on the first inclined portions 412 may be mounted on the rack 400 entirely, obliquely with respect to the vertical direction of the tub 131.

The first bent portion 413 may be bent from the first inclined portion 412 and coupled to the edge portion 411. The first bent portion 413 may be formed on one end portion of the first inclined portion 412 in order for the first inclined portion 412 to become a structure having an inclination.

A plurality of first bent portions 413 may be provided, in which the first bent portions 413 may be disposed to be spaced apart from each other, and each of the first bent portions 413 may extend from each of the first inclined portions 412.

The rack 400 may include a first flow path guide unit 440. The first flow path guide unit 440 may be coupled to the bottom portion 410 and disposed to face the washing water inlet 1315 so that the water flowing from the washing water inlet 1315 flows toward the detergent flowing into the detergent inlet 1312.

The first flow path guide unit 440 may be disposed on the rear of the tub 131 and disposed at a position adjacent to the washing water inlet 1315. Therefore, the water flowing into the washing water inlet 1315 and pouring into the tub 131 may collide with the first flow path guide unit 440, and thus the flow path of the water may be changed.

The first flow path guide unit 440 may include a base portion 441 and a first pad 442. The base portion 441 may be coupled to the bottom portion 410. The base portion 441 may be formed to protrude from a rear of the bottom portion 410 and formed by entirely bending a wire.

The first pad 442 may be coupled to the base portion 441 and disposed at a position corresponding to the washing water inlet 1315 to change a flow direction of the water flowing into the tub 131. The first pad 442 may be formed in a curved shape when viewed in cross section to guide water to flow downward of the tub 131.

The first pad 442 may be disposed to directly face the washing water inlet 1315. Therefore, since the water flowing into the washing water inlet 1315 is sprayed toward the first pad 442 and may collide with the first pad 442, the flow direction of the water may be changed downward of the tub 131.

The first pad 442 may be formed to have a curved cross section, and the first pad 442 may have a curved surface so that a lower end portion faces the washing water inlet 1315. Therefore, the water colliding with the first pad 442 may approach the wall surface of the tub 131 while flowing downward by gravity.

Meanwhile, the detergent inlet 1312 may be disposed under the washing water inlet 1315. Since the detergent introduced through the detergent inlet 1312 has a relatively higher viscosity, the detergent may flow down along the wall surface of the tub 131.

Since the water colliding with the first pad 442 approaches the wall surface of the tub 131 while flowing downward, the water may meet the detergent flowing down the wall surface of the tub 131. Therefore, the water flowing inside the tub 131 may meet the detergent.

With this structure, since water flowing at a position before flowing into the sump 133 meets the liquid detergent, the water may be easily mixed with the detergent compared to a case in which the detergent is mixed with the water collected in the sump 133.

During the washing process, the controller provided in the cup washer may control the operation of the detergent pump 1301 so that the detergent flows into the tub 131 at a time point at which the water flows into the tub 131 through the washing water inlet 1315. Therefore, since the flowing water and the detergent are mixed, the water may be easily mixed with the detergent.

In the embodiment, the rack 400 may include the first flow path guide unit 440 for guiding the flow direction of water at a position adjacent to the washing water inlet 1315 of the tub 131. Therefore, the water flowing into the tub 131 may flow toward the detergent flowing into the tub 131 by the first flow path guide unit 440. Therefore, since the flowing water is mixed with the detergent, it is possible to easily mix the water with the detergent and increase the washing efficiency of the cup washer.

Figure 51:
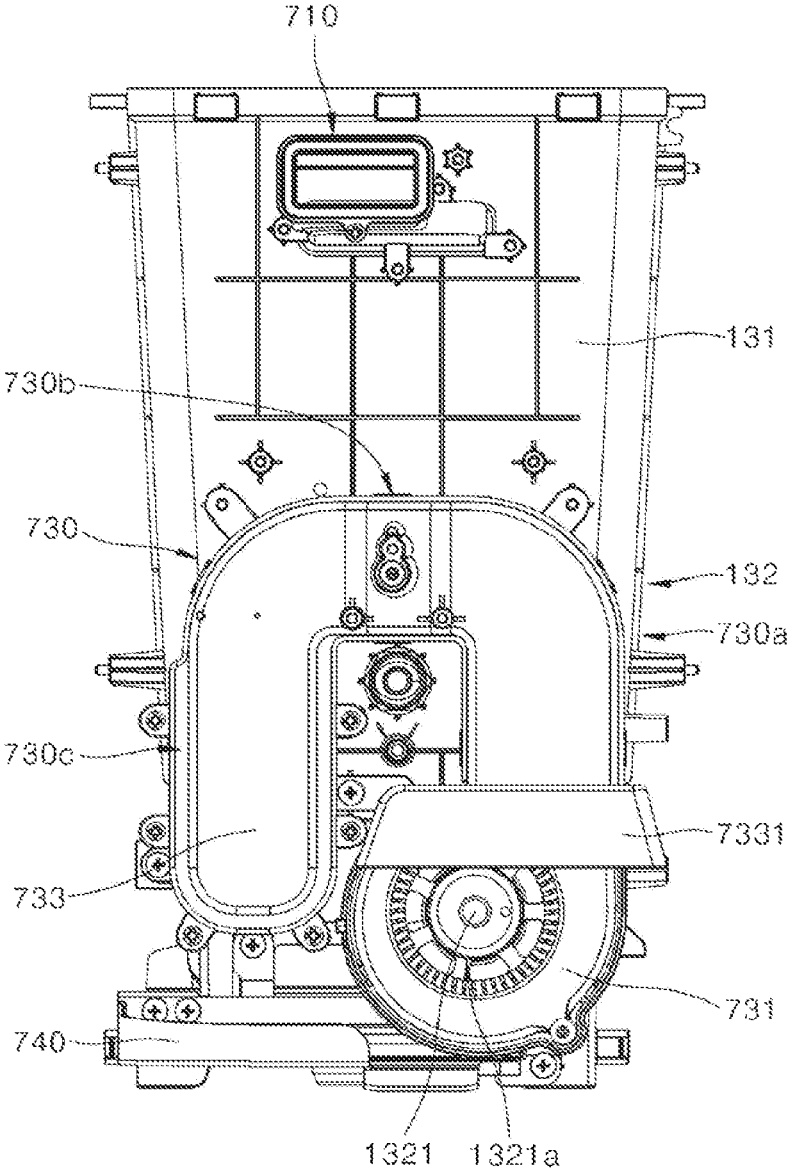
FIG. 51 is a rear view illustrating a state in which a drying module according to one embodiment is coupled to the tub.
Figure 52:
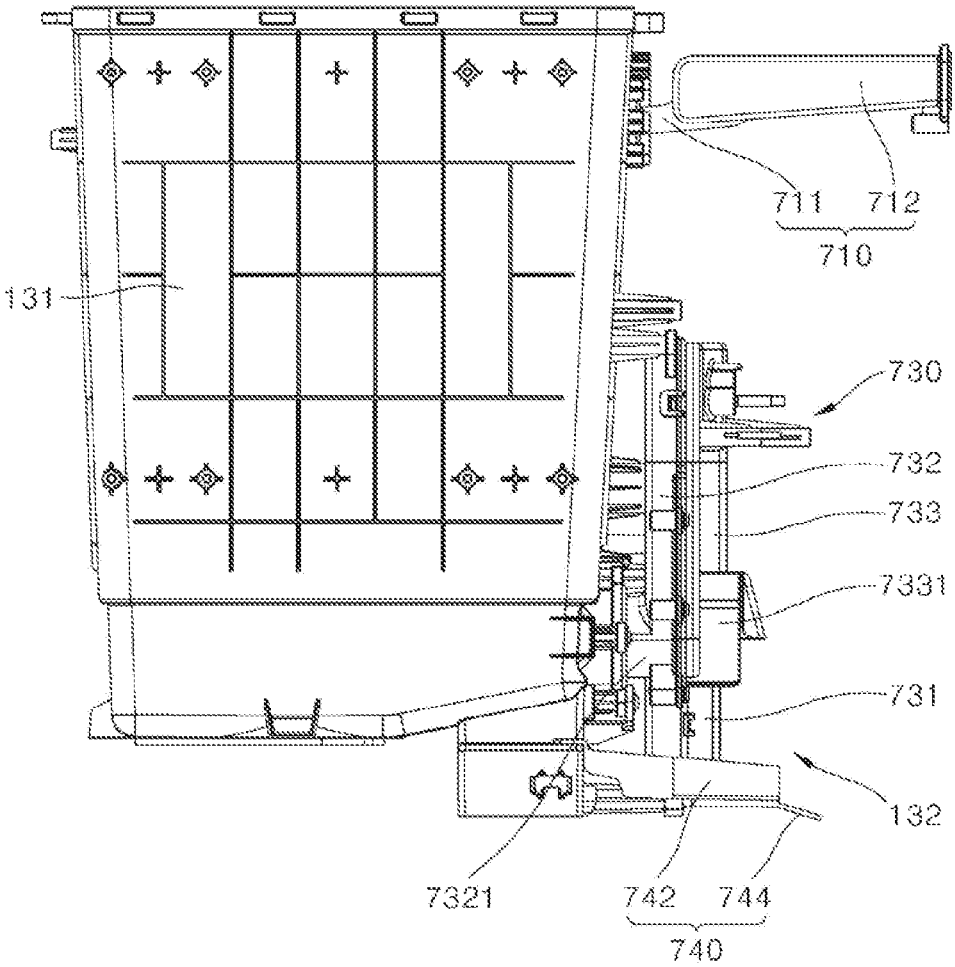
FIG. 52 is a side view illustrating the state of FIG. 51.
Figure 53:
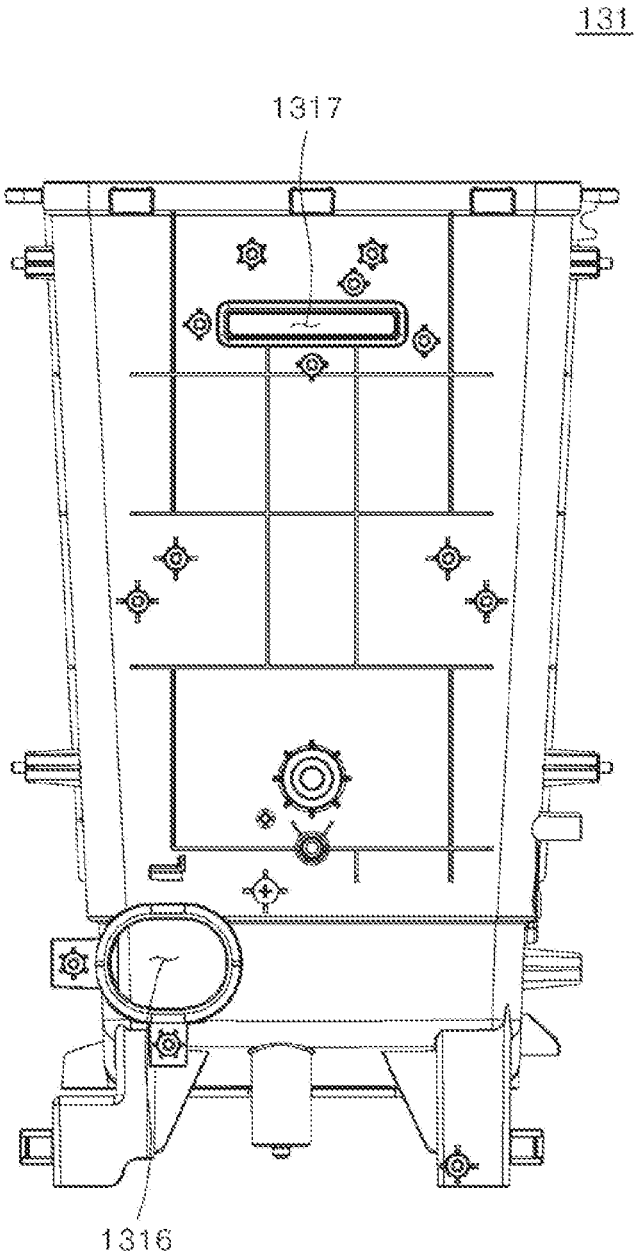
FIG. 53 is a rear view illustrating the tub according to one embodiment.

FIG. 51 is a rear view illustrating a state in which the drying module 132 according to one embodiment is coupled to the tub 131. FIG. 52 is a side view illustrating the state of FIG. 51. FIG. 53 is a rear view illustrating the tub 131 according to one embodiment.

The cup washer may include the washing unit 130 for washing the accommodated cup. The cup washer may include the tub 131, the drying module 132, and an air discharge unit 710, The tub 131 may provide a space in which the cup is accommodated, and washing water may be sprayed therein.

The drying module 132 may be disposed at one side of the tub 131 to be connected to the tub 131 and may spray heated air for drying into the tub 131. The drying module 132 may be operated after washing with water is completed to dry the cup by blowing heated air, that is, warm air to the cup to evaporate water remaining in the cup.

The air discharge unit 710 may be disposed on the upper portion of the tub 131, connected to the tub 131, and may discharge air inside the tub 131 to the outside. The air discharge unit 710 may provide a path through which air flowing inside the tub 131 is discharged to the outside of the tub 131. An inlet of the air discharge unit 710 may be connected to the tub 131, and an outlet of the air discharge unit may be disposed to face the outside of the cup washer.

Meanwhile, as illustrated in FIG. 53, the tub 131 may include an air inflow hole 1316, and an air discharge hole 1317. The air inflow hole 1316 may be formed on the lower portion of the tub 131 and connected to an outlet of the drying module 132. The air discharge hole 1317 may be formed on the upper portion of the tub 131 and connected to the inlet of the air discharge unit 710.

The warm air discharged from the drying module 132 may flow into the air inflow hole 1316 disposed on the lower portion of the tub 131 to move up while being spread to the entire tub 131. Therefore, the cup accommodated in the tub 131 may be exposed to the flowing warm air, and thus the water remaining on the surfaces may be evaporated by the warm air. The warm air may be discharged from the tub 131 through the air discharge hole 1317.

Figure 54:
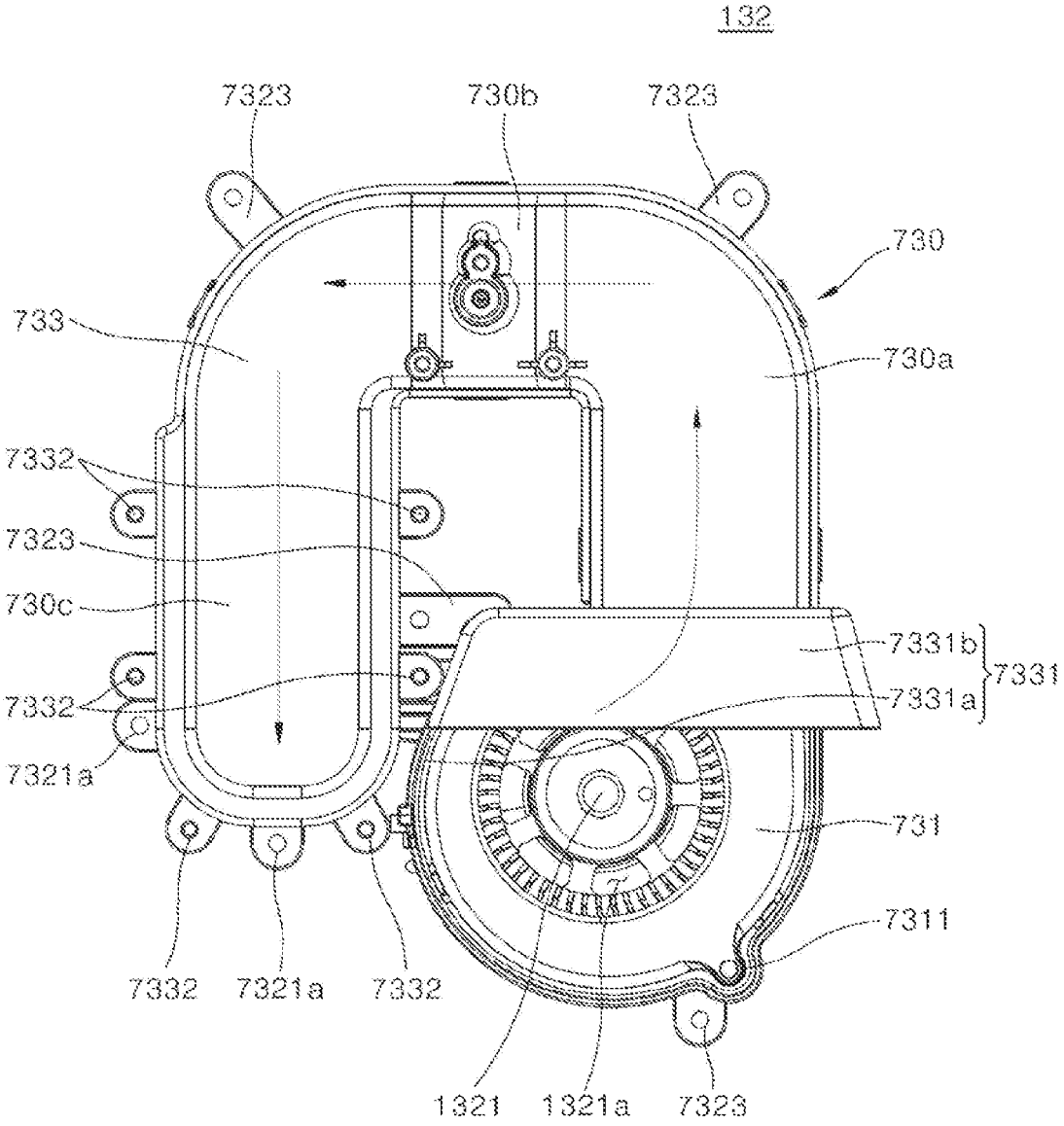
FIG. 54 is a view illustrating the drying module according to one embodiment.
Figure 55:
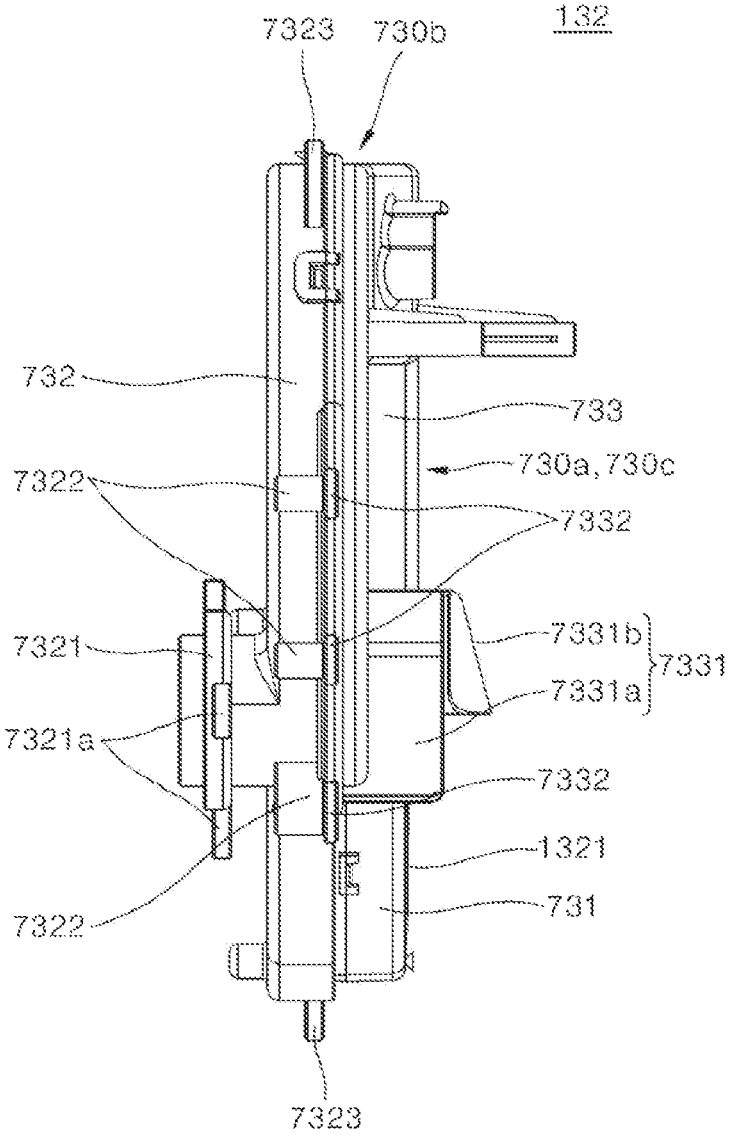
FIG. 55 is a side view illustrating the drying module according to one embodiment.
Figure 56:
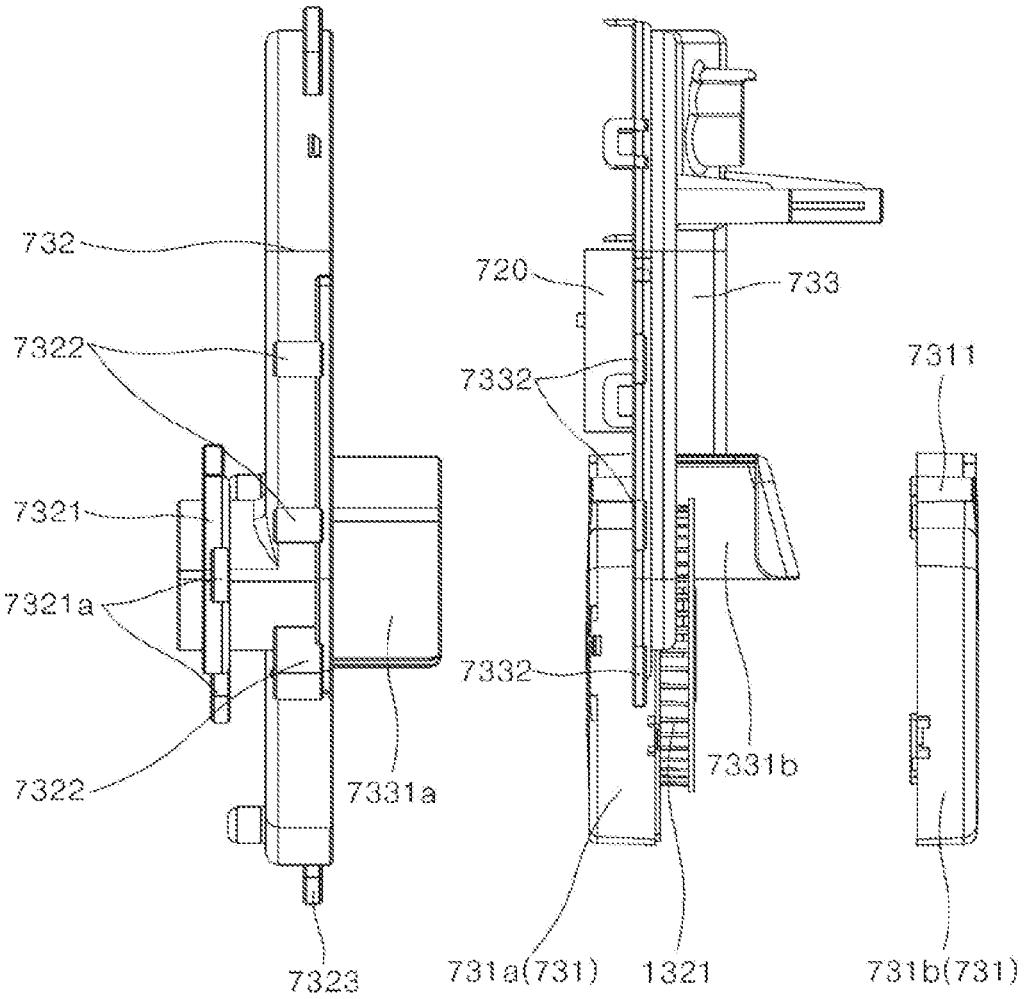
FIG. 56 is an exploded view illustrating the drying module of FIG. 55.

FIG. 54 is a view illustrating the drying module 132 according to one embodiment. FIG. 55 is a side view illustrating the drying module 132 according to one embodiment. FIG. 56 is an exploded view illustrating the drying module of FIG. 55. The drying module 132 may include a blowing fan 1321, an air heating unit 720, and an air flow path unit 730.

The blowing fan 1321 may include an air inlet 1321*a* through which air is introduced and blow the air flowing into the air inlet 1321*a* toward the tub 131. Outside air around the cup washer may flow into the drying module 132 through the blowing fan 1321. In addition, the blowing fan 1321 may force air to flow in the drying module 132 and the tub 131.

The air heating unit 720 may be disposed on an outlet side of the blowing fan 1321 to heat the air introduced from the blowing fan 1321. The air flowing into the blowing fan 1321 may be heated while passing through the air heating unit 720 to become warm air and flow through the drying module 132 and the washing unit 130. The air heating unit 720 may be provided as, for example, an electrical resistance type heating device having a small volume and a relatively simpler structure.

The air flow path unit 730 may accommodate the blowing fan 1321 and the air heating unit 720, may be connected to the air inflow hole 1316, and may form an air flow path that flows toward the tub 131. The air flow path unit 730 may form the air flow path by coupling a fan casing 731, a first duct 732, and a second duct 733.

When viewed in a lateral direction of each region through which air flows, the air flow path unit 730 may include a rising portion 730*a*, a lateral extension 730*b*, and a falling portion 730*c*. The rising portion 730*a* may extend upward from the tub 131 from the blowing fan 1321 so that air may rise.

The lateral extension 730*b* may be bent from the rising portion 730*a* to extend in the lateral direction of the tub 131 so that air may flow in the lateral direction. The falling portion 730*c* may be bent from the lateral extension 730*b* to extend downward of the tub 131 so that the air may fall.

As indicated by arrows in FIG. 54, air in the drying module 132 may flow into the tub 131 after flowing into the blowing fan 1321 and sequentially flowing through the rising portion 730*a*, the lateral extension 730*b*, and the falling portion 730*c*. The air may be heated by the air heating unit 720 disposed on the rising portion 730*a* while passing through the rising portion 730*a* to become warm air.

The water stored in the sump 133 disposed under the tub 131 may flow back through the air flow path unit 730 through the air inflow hole 1316 formed on the lower portion of the tub 131 to flow into the blowing fan 1321. When water flows into the blowing fan 1321, components of a motor provided in the blowing fan 1321 may be corroded. Therefore, it is necessary to suppress the water in the sump 133 from flowing back through the air flow path unit 730 through the air inflow hole 1316.

As described above, the air flow path unit 730 including the rising portion 730*a*, the lateral extension 730*b*, and the falling portion 730*c* may be formed entirely in an inverted U shape. With this structure, when viewed based on the air flow path unit 730, the air inflow hole 1316 of the tub 131 may be disposed under the lateral extension 730*b*.

Therefore, the water flowing into the air flow path unit 730 from the sump 133 through the air inflow hole 1316 may not rise from the falling portion 730*c* to the lateral extension 730*b* due to gravity. With this structure, it is possible to effectively suppress the water in the sump 133 from flowing back through the air flow path unit 730 to flow into the blowing fan 1321.

In the embodiment, the washing unit 130 may include the drying module 132 including the blowing fan 1321 and the air heating unit 720. By blowing warm air to the cup accommodated in the tub 131 using the drying module 132 after washing the cup with water, it is possible to provide the dried cup to a user, thereby promoting the user's convenience.

When viewed in a lateral direction of each component, the air flow path unit 730 may include the fan casing 731, the first duct 732, and the second duct 733. The fan casing 731 may cover the blowing fan 1321. The fan casing 731 may accommodate the blowing fan 1321 and cover the blowing fan 1321 to form the air inlet 1321*a*.

The first duct 732 may accommodate the blowing fan 1321, may be coupled to the fan casing 731, and coupled to the tub 131. The first duct 732 may be coupled to the fan casing 731 to accommodate the blowing fan 1321. The blowing fan 1321 may be disposed on an end portion of the first duct 732.

The second duct 733 may be connected to the fan casing 731 and coupled to the first duct 732. The second duct 733 may be coupled to the fan casing 731 to form a flow path through which air introduced from the blowing fan 1321 flows.

The first duct 732 and the second duct 733 may be coupled to form a space in which air flows therein and form the rising portion 730*a*, the lateral extension 730*b*, and the falling portion 730*c*. The first duct 732 and the second duct 733 may be formed in substantially corresponding shapes, and each may be formed in an inverted U shape.

The air flow path unit 730 may include a water roof 7331. When warm air flows through the air flow path unit 730 of the drying module 132, water vapor may condense on a surface of the drying module 132 due to a temperature difference with air around the drying module 132. The condensed water may flow down to the lower portion of the drying module 132, and the flowed-down water may adversely affect components of the cup washer.

In particular, when water flows into the blowing fan 1321 disposed on a lower end portion of the rising portion 730*a* of the air flow path unit 730, a malfunction of the blowing fan 1321 may occur, and thus it is necessary to block the condensed water from flowing down and flowing into the blowing fan 1321.

Therefore, since the water roof 7331 is provided in the air flow path unit 730, it is possible to suppress the water condensed on the surface of the drying module 132 from flowing down and flowing into the blowing fan 1321. The water roof 7331 can prevent the water remaining on an outer surface of the air flow path unit 730 from flowing into the blowing fan 1321 and may include a first roof 7331*a* and a second roof 7331*b*.

The first roof 7331*a* may be provided to protrude from the first duct 732 toward the second duct 733 to cover the blowing fan 1321 from an upper side. The second roof 7331*b* may be coupled to the first roof 7331*a* and provided to protrude from a lower end portion of the second duct 733 and be formed to have an expanding cross-sectional area downward to cover the blowing fan 1321 from an upper side.

The first roof 7331*a* and the second roof 7331*b* may be coupled and disposed above the blowing fan 1321 and the fan casing 731 accommodating the blowing fan 1321. The water roof 7331 may be formed to protrude from the first duct 732 and the second duct 733 and disposed above the blowing fan 1321.

Therefore, it is possible to prevent the water condensed on the outer surface of the air flow path unit 730 from flowing down along the rising portion 730*a* of the air flow path unit 730 and then flowing into the blowing fan 1321 by the water roof 7331. The condensed water may flow down along the outer surface of the water roof 7331 and fall down from a lower end of the water roof 7331. At this time, it is possible to suppress the condensed water from being separated from the blowing fan 1321 by the water roof 7331 to fall down and flowing into the blowing fan 1321.

In the embodiment, the water roof 7331 may be formed on the lower end portion of the rising portion 730*a* constituting the air flow path unit 730. The water condensed on the surface of the drying module 132 by the water roof 7331 may flow down while avoiding the blowing fan 1321. Therefore, it is possible to block the condensed water flowing into the blowing fan 1321, thereby effectively preventing a malfunction or failure of the blowing fan 1321.

The first duct 732 may include an air discharge duct 7321. The air discharge duct 7321 may protrude from a lower end portion of the first duct 732 toward the air inflow hole 1316 of the tub 131 and have an end connected to the air inflow hole 1316.

A flow direction of the warm air falling in the falling portion 730*c* of the air flow path unit 730 may be changed in the air discharge duct 7321, and thus the warm air may rise while flowing toward the air inflow hole 1316 of the tub 131 to flow into the tub 131 and be spread in the tub 131.

Figure 57:
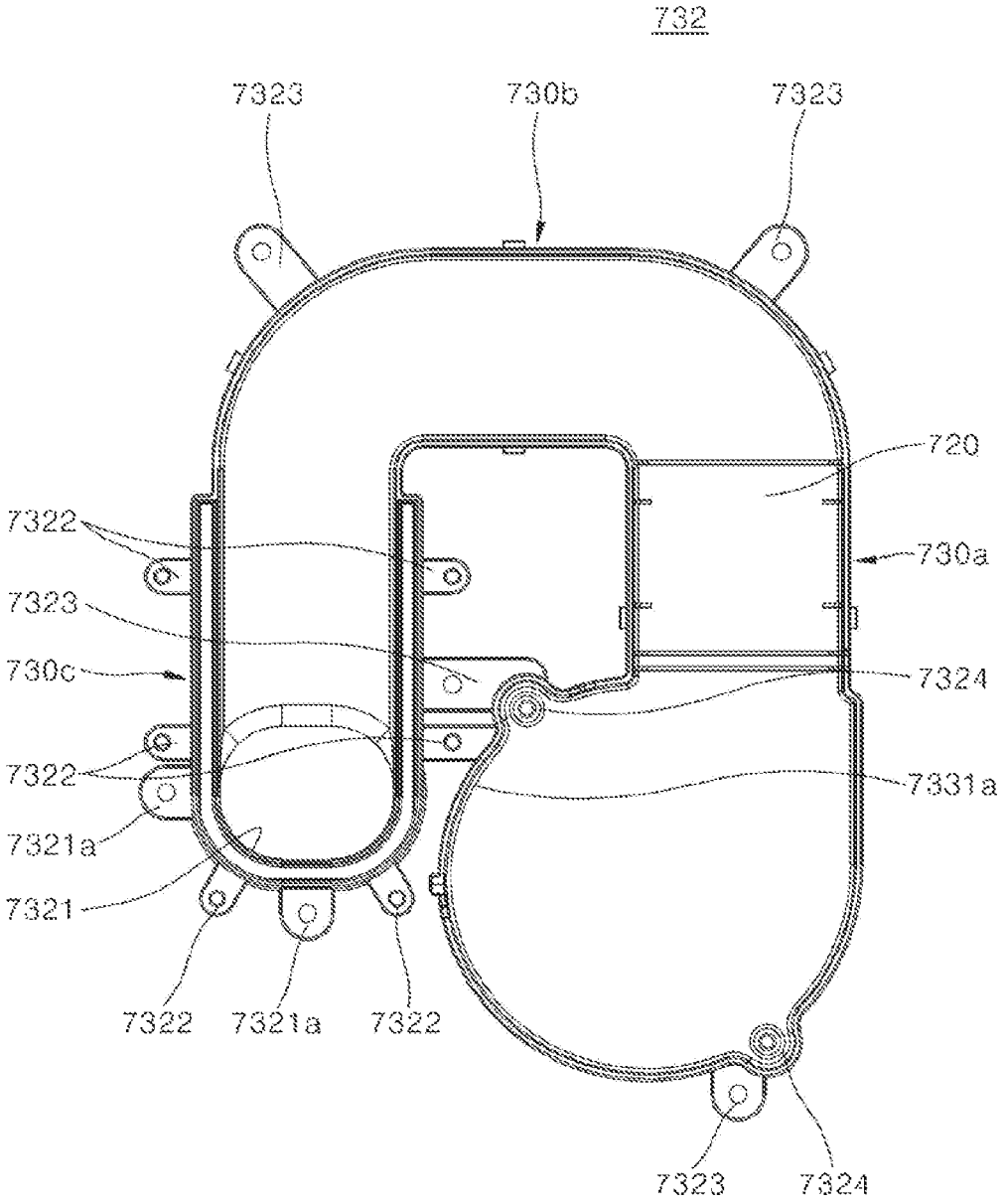
FIG. 57 is a view illustrating a first duct according to one embodiment.
Figure 58:
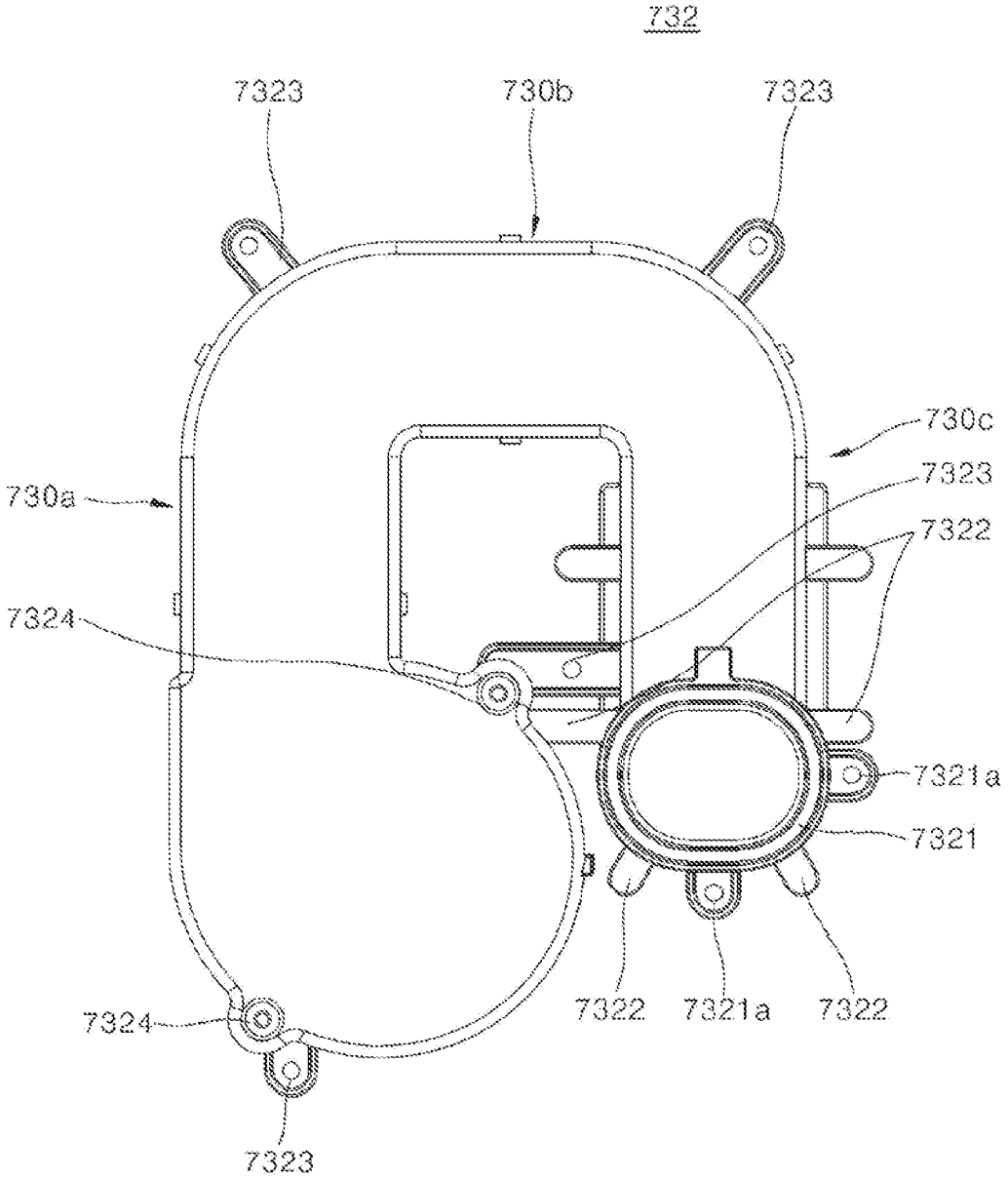
FIG. 58 is a rear view illustrating a first duct of FIG. 57.
Figure 59:
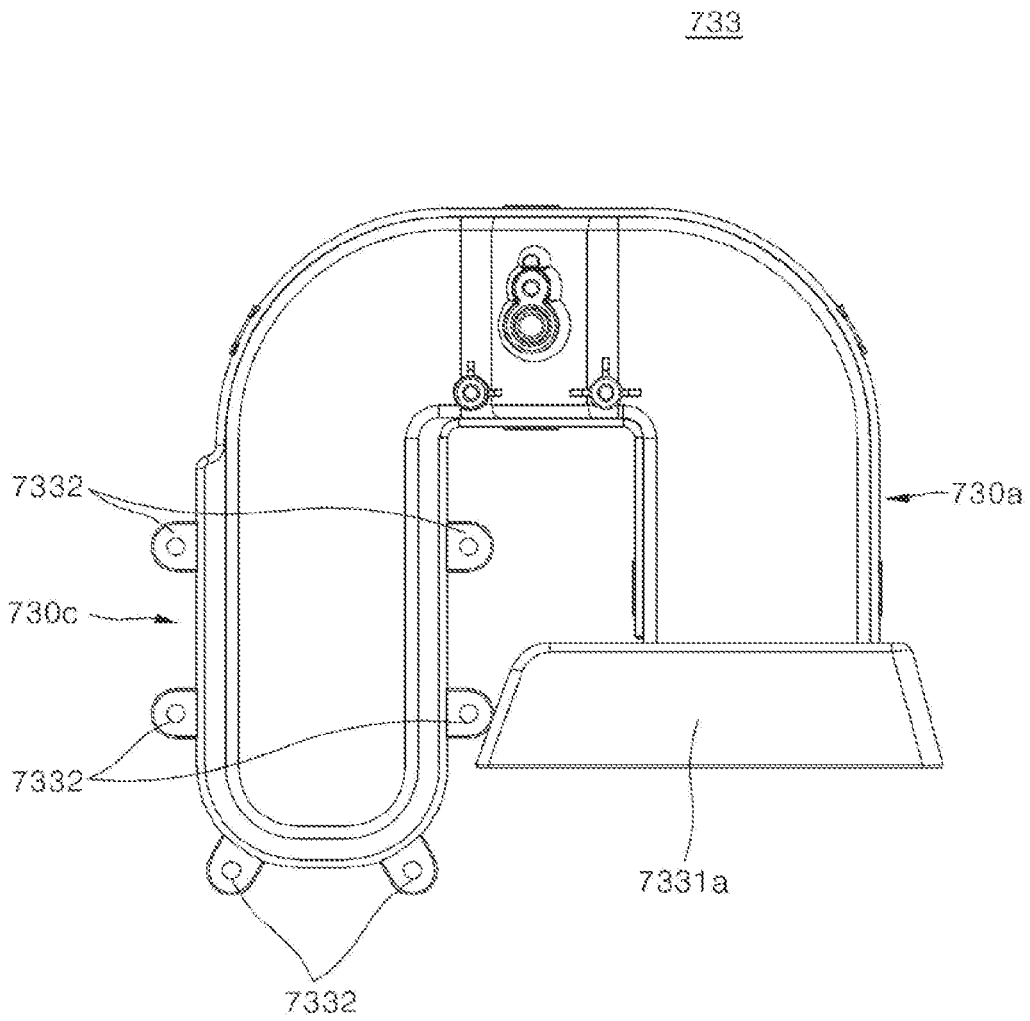
FIG. 59 is a view illustrating a second duct according to one embodiment.

FIG. 57 is a view illustrating the first duct 732 according to one embodiment. FIG. 58 is a rear view illustrating a first duct of FIG. 57. FIG. 59 is a view illustrating the second duct 733 according to one embodiment.

The first duct 732 and the second duct 733 may be coupled by a fastener such as a screw. For coupling therebetween, the first duct 732 may include a first coupling protrusion 7322, and the second duct 733 may include a second coupling protrusion 7332.

The first coupling protrusion 7322 may protrude from an edge of the first duct 732 and may be coupled to the second duct 733. A plurality of first coupling protrusions 7322 may be provided to be spaced apart from each other along the edge of the first duct 732.

The second coupling protrusion 7332 may protrude from an edge of the second duct 733, may be disposed at a position corresponding to the first coupling protrusion 7322, and coupled to the first coupling protrusion 7322. Holes into which a fastener is fastened may be formed in the first coupling protrusion 7322 and the second coupling protrusion 7332.

The first duct 732 may be coupled to the sidewall of the tub 131. To this end, the first duct 732 may include a third coupling protrusion 7323. The third coupling protrusion 7323 may protrude from an edge of the first duct 732, may be disposed at a position corresponding to the first coupling protrusion 7322, and coupled to the tub 131. A plurality of third coupling protrusions 7323 may be disposed to be spaced apart from each other along the edge of the first duct 732.

Meanwhile, a protrusion for coupling with the third coupling protrusion 7323 may be formed at a position corresponding to the third coupling protrusion 7323 in the tub 131, The third coupling protrusion 7323 and the corresponding protrusion of the tub 131 may be coupled by a fastener. Holes into which the fastener is fastened may be formed in the third coupling protrusion 7323 and the corresponding protrusion of the tub 131.

Meanwhile, the air discharge duct 7321 integrally formed with the first duct 732 may also be coupled to the tub 131. To this end, the air discharge duct 7321 may include a fourth coupling protrusion 7321*a*. The fourth coupling protrusion

7321*a* may protrude from an edge of the air discharge duct 7321 and may be coupled to the tub 131. A plurality of fourth coupling protrusions 7321*a* may be disposed to be spaced apart from each other along the edge of the air discharge duct 7321.

A protrusion for coupling with the fourth coupling protrusion 7321*a* may be formed at a position corresponding to the fourth coupling protrusion 7321*a* in the tub 131. The fourth coupling protrusion 7321*a* and the corresponding protrusion of the tub 131 may be coupled by a fastener. A hole into which the fastener is fastened may be formed in the fourth coupling protrusion 7321*a* and the corresponding protrusion of the tub 131.

Figure 60:
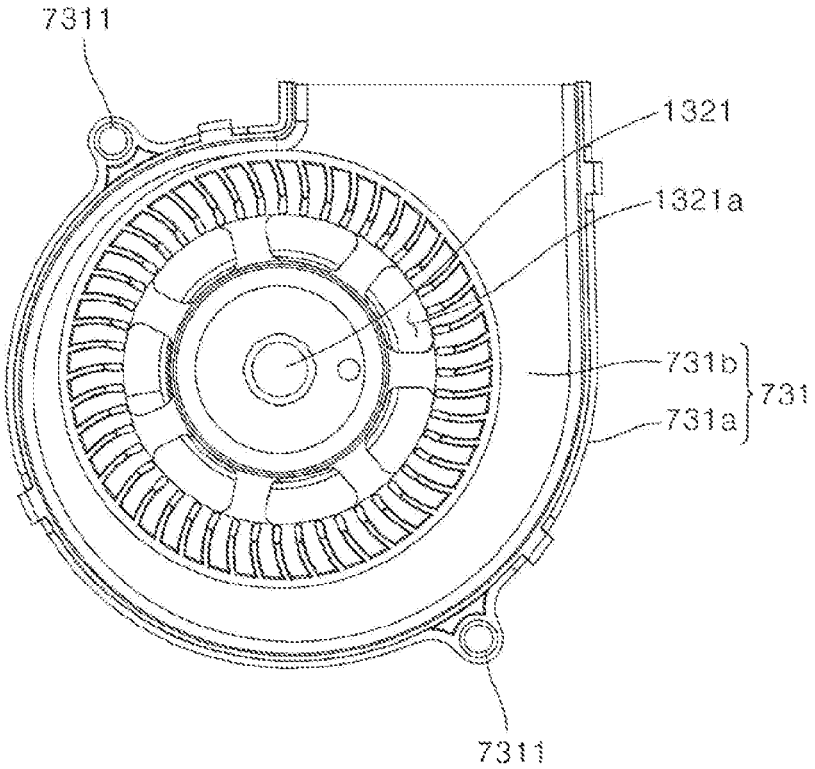
FIG. 60 is a view illustrating a blowing fan and a fan casing.

FIG. 60 is a view illustrating the blowing fan 1321 and the fan casing 731. The fare casing 731 may include a fifth coupling protrusion 7311 for coupling with the first duct 732. The fifth coupling protrusion 7311 may protrude from an edge of the fan casing 731 and may be coupled to the first duct 732. A plurality of fifth coupling protrusions 7311 may be provided to be spaced apart from each other.

Corresponding to the fifth coupling protrusion 7311, a sixth coupling protrusion 7324 may be formed at a position corresponding to the fifth coupling protrusion 7311 in the first duct 732. The fifth coupling protrusion 7311 and the sixth coupling protrusion 7324 may be coupled by a fastener. Holes into which a fastener is fastened may be formed in the fifth coupling protrusion 7311 and the sixth coupling protrusion 7324.

The fan casing 731 may include a first casing 731*a* and a second casing 731*b*. The blowing fan 1321 may be seated on the first casing 731*a*. A hole forming the air inlet 1321*a* of the blowing fan 1321 may be provided in the second casing 731*b* to cover the blowing fan 1321.

The fifth coupling protrusion 7311 may be formed at each of positions corresponding to each other in the first casing 731*a* and the second casing 731*b*. When the fastener is fastened to the fifth coupling protrusion 7311 and the sixth coupling protrusion 7324 and the fan casing 731 is coupled to the first duct 732, the first casing 731*a* and the second casing 731*b* may be fixedly coupled.

Figure 61:
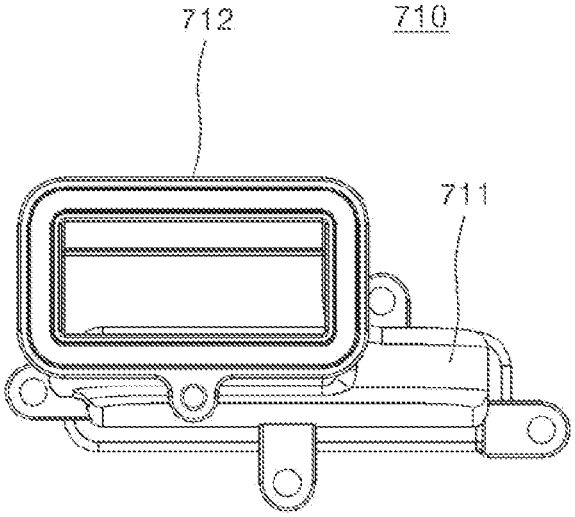
FIG. 61 is a view illustrating an air discharge unit according to one embodiment.
Figure 62:
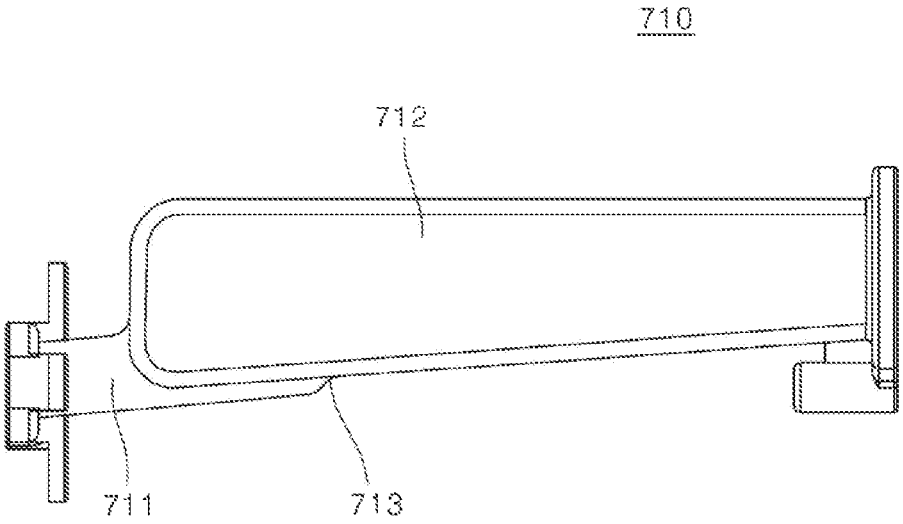
FIG. 62 is a side view illustrating the air discharge unit of FIG. 61.
Figure 63:
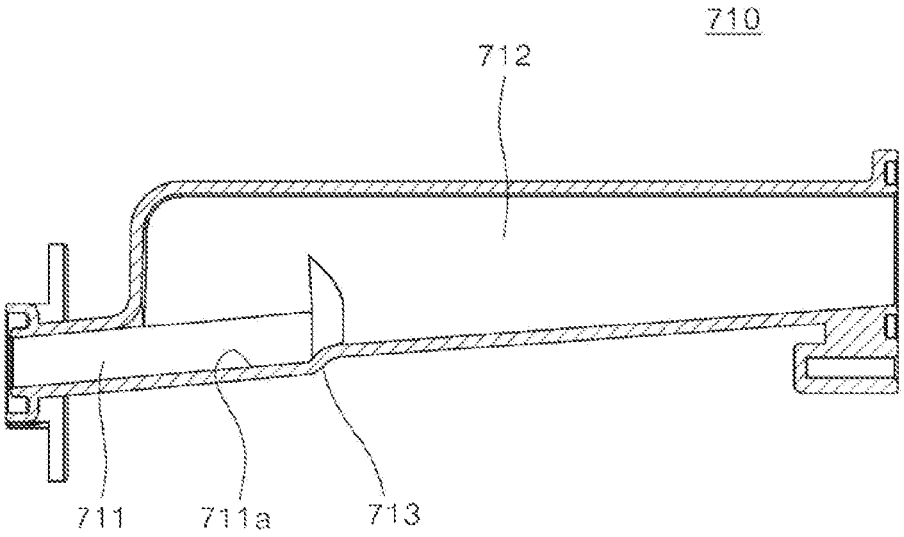
FIG. 63 is a cross-sectional view illustrating the air discharge unit of FIG. 62.

FIG. 61 is a view illustrating the air discharge unit 710 according to one embodiment. FIG. 62 is a side view illustrating the air discharge unit of FIG. 61. FIG. 63 is a cross-sectional view illustrating the air discharge unit of FIG. 62. The air discharge unit 710 may include a third duct 711 and a fourth duct 712.

The third duct 711 may be connected to the air discharge hole 1317. The warm air flowing through the tub 131 may be discharged from the tub 131 through the air discharge hole 1317 to flow into the third duct 711. The fourth duct 712 may have an inlet disposed above the third duct 711 and may be connected to the third duct 711.

The warm air discharged from the drying module 132 flows inside the tub 131 in which the cup is accommodated and is discharged to the outside of the tub 131. At this time, the water remaining inside the tub 131 may be discharged to the outside through the air discharge hole 1317 together with air. In this case, water may be discharged to the outside of the cup washer and thus the water may flow around the cup washer, resulting in a user's inconvenience.

In order to suppress the water remaining in the tub 131 from being discharged to the outside through the air discharge hole 1317, the air discharge unit 710 may be provided to have an inlet and an outlet with different heights. In addition, it is necessary to allow the air discharge unit 710 to be inclined so that the water flowing into the air discharge unit 710 flows back to the tub 131.

In the air discharge unit 710, a stepped portion 713 may be formed so that an inlet of the fourth duct 712 is positioned above an outlet of the third duct 711 on a portion in which the third duct 711 and the fourth duct 712 are connected.

Since the stepped portion 713 may be formed between the third duct 711 and the fourth duct 712, the fourth duct 712 may be disposed at a higher position than the third duct 711. With this structure, water flowing into the third duct 711 from the tub 131 may not flow into the fourth duct 712 because it may not go over the stepped portion 713. Therefore, it is possible to prevent the water discharged through the air discharge unit 710 from flowing into the fourth duct 712 and effectively suppress the water from being discharged to the outside through the fourth duct 712.

The third duct 711 may be formed so that an inner bottom surface 711*a* is inclined upward from the air discharge hole 1317 toward the fourth duct 712. That is, the third duct 711 may be formed to be inclined so that the inner bottom surface 711*a* is inclined downward toward the air discharge hole 1317 of the tub 131.

Therefore, the water flowing into the third duct 711 through the air discharge hole 1317 may not be discharged to the outside because it is blocked by the stepped portion 713. In addition, the inner bottom surface 711*a* of the third duct 711 may be formed to be inclined downward toward the tub 131. Therefore, the water flowing into the third duct 711 may flow back to the tub 131 by gravity.

With this structure, it is possible to effectively suppress the water flowing into the air discharge unit through the air discharge hole 1317 from being discharged to the outside of the cup washer, thereby reducing the user's inconvenience caused by the discharge of water through the air discharge hole 1317.

Meanwhile, when warm air flows through the air flow path unit 730 of the drying module 132, water vapor may condense on the surface of the drying module 132 due to a temperature difference with the air around the drying module 132. The condensed water may flow down to the lower portion of the drying module 132, and the flowed-down water may adversely affect components of the cup washer.

A circulation pump 134 may be provided under the drying module 132, and the water condensed on the outer surface of the drying module 132 to flow down therefrom may flow into the circulation pump 134. When the condensed water flows into the circulation pump 134, the condensed water may adversely affect electrical wirings and electric components provided in the circulation pump 134, thereby causing a malfunction or failure of the circulation pump 134.

Therefore, it is necessary to prevent the water flowing down in the drying module 132 from flowing into the circulation pump 134. To this end, in the cup washer according to the embodiment, a water tray 740 may be provided between the drying module 132 and the circulation pump 134.

Figure 64:
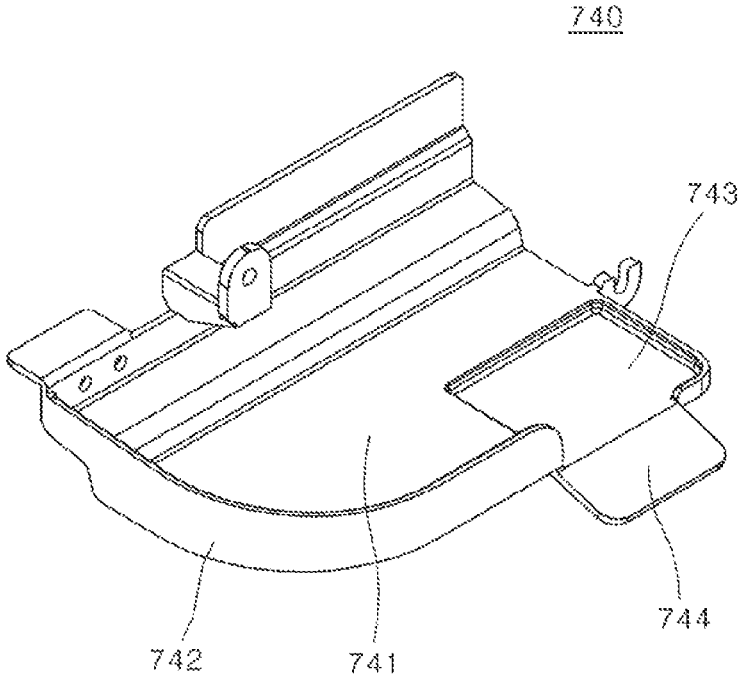
FIG. 64 is a view illustrating a water tray according to one embodiment.

FIG. 64 is a view illustrating the water tray 740 according to one embodiment. The cup washer may include the sump 133, the circulation pump 134, and the water tray 740. The sump 133 may be disposed under the tub 131 to be connected to the tub 131 to store the water sprayed at the tub 131.

The circulation pump 134 may be disposed under the tub 131 to be connected to the tub 131 and the sump 133 and disposed under the drying module 132 to circulate water between the tub 131 and the sump 133.

The water tray 740 may be disposed between the drying module 132 and the circulation pump 134 and provided to cover the circulation pump 134 from an upper side to suppress the water remaining on the outer surface of the air flow path unit 730 from falling into the circulation pump 134.

The drying module 132 may be disposed above the water tray 740, and the circulation pump 134 may be disposed thereunder. In addition, the water tray 740 may be disposed to protrude in a lateral direction, and when viewed in the vertical direction of the cup washer, the water tray 740 may cover the circulation pump 134 from the upper side.

With this structure, the water condensed on the surface of the drying module 132 may flow down along the drying module 132 to fall on an upper surface of the water tray 740. Therefore, it is possible to block the water flowing down from the surface of the drying module 132 to fall from flowing on the circulation pump 134.

Therefore, it is possible to effectively suppress water from falling into the circulation pump 134 and being in contact with the electrical wirings and the electric components provided in the circulation pump 134 to cause a malfunction or failure of the circulation pump 134.

The water tray 740 may include a bottom plate 741, a first rib 742, a recess 743, and a second rib 744. The water condensed on the surface of the drying module 132 and flowed down may fall on an upper surface of the bottom plate 741.

The first rib 742 may be formed to protrude from an edge of the bottom plate 741 upward from the tub 131. The first rib 742 may be formed at the edge of the bottom plate 741 excluding a region in which the second rib 744 is formed to allow the water falling into the bottom plate 741 to flow toward the second rib 744 without flowing down on another portion.

The recess 743 may be formed by recessing a portion of the bottom plate 741, and the water falling into the bottom plate 741 may be collected therein. The recess 743 may be formed at a position adjacent to the second rib 744. The water falling into the bottom plate 741 may be blocked by the first rib 742 and guided to flow toward the recess 743 and collected in the recess 743.

The second rib 744 may be formed to protrude in the lateral direction of the tub 131 at a position at which the recess 743 is formed and provided to drain the water collected in the recess 743. The recess 743 may be directly connected to the second rib 744.

Therefore, the water collected in the recess 743 may be guided by the second rib 744 to fall downward of the water tray 740 on a position further away from the circulation pump 134 disposed under the water tray 740.

Since the second rib 744 protrudes in the lateral direction of the tub 131, the water falling from an end of the second rib 744 falls on the position away from the circulation pump 134, and thus it is possible to effectively suppress the water from falling into the circulation pump 134. In order for the water to smoothly flow in the second rib 744, the second rib 744 may be formed to have an inclination downward toward the end thereof.

Meanwhile, referring to FIG. 2, the cup washer may include the rear panel 180 for covering the rear of the cup washer. Both the air flowing into the drying module 132 and the air discharged through the air discharge unit 710 may flow through the rear panel. Therefore, for smooth air flow, the rear panel 180 may include a first vent 181 and a second vent 182.

The first vent 181 may be formed at a position corresponding to the air inlet 1321*a* of the blowing fan 1321 to ventilate the inside and outside of the cup washer. The second vent 182 may be formed at a position corresponding to the outlet of the air discharge unit 710 to ventilate the inside and outside of the cup washer.

The air used to dry the cup may flow into the drying module 132 through the first vent 181 of the rear panel 180 and the air inlet 1321*a* of the drying module 132. In addition, the air may be heated by the air heating unit 720 while passing through the drying module 132 to become warm air, may rise while flowing into the tub 131 through the air inflow hole 1316 and being spread, and dry the cup accommodated in the tub 131.

The air may be discharged from the tub 131 through the air discharge hole 1317 and discharged to the outside of the cup washer through the air discharge unit 710 and the second vent 182 of the rear panel 180. The air flow may be performed by the blowing fan 1321 provided in the drying module 132.

Figure 65:
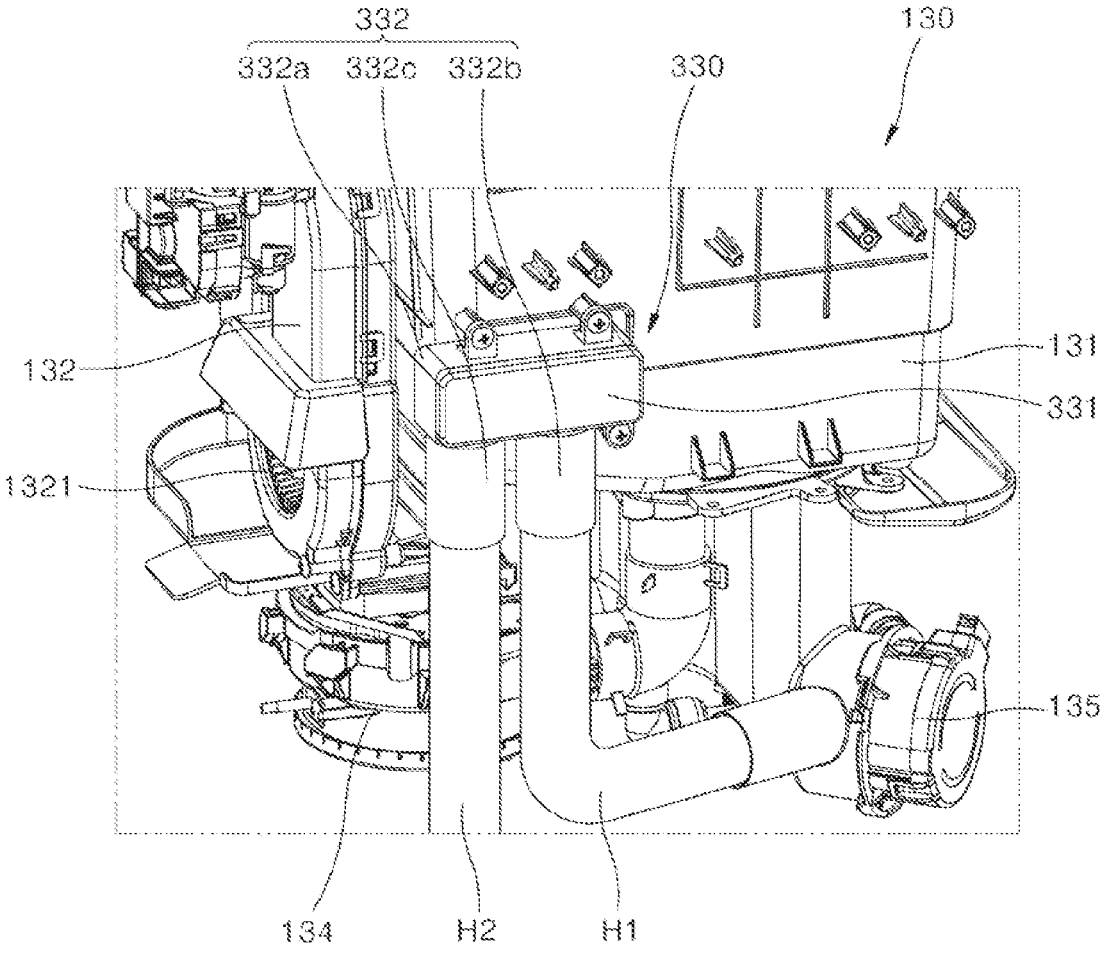
FIG. 65 is a perspective view illustrating a portion of the washing unit.
Figure 66:
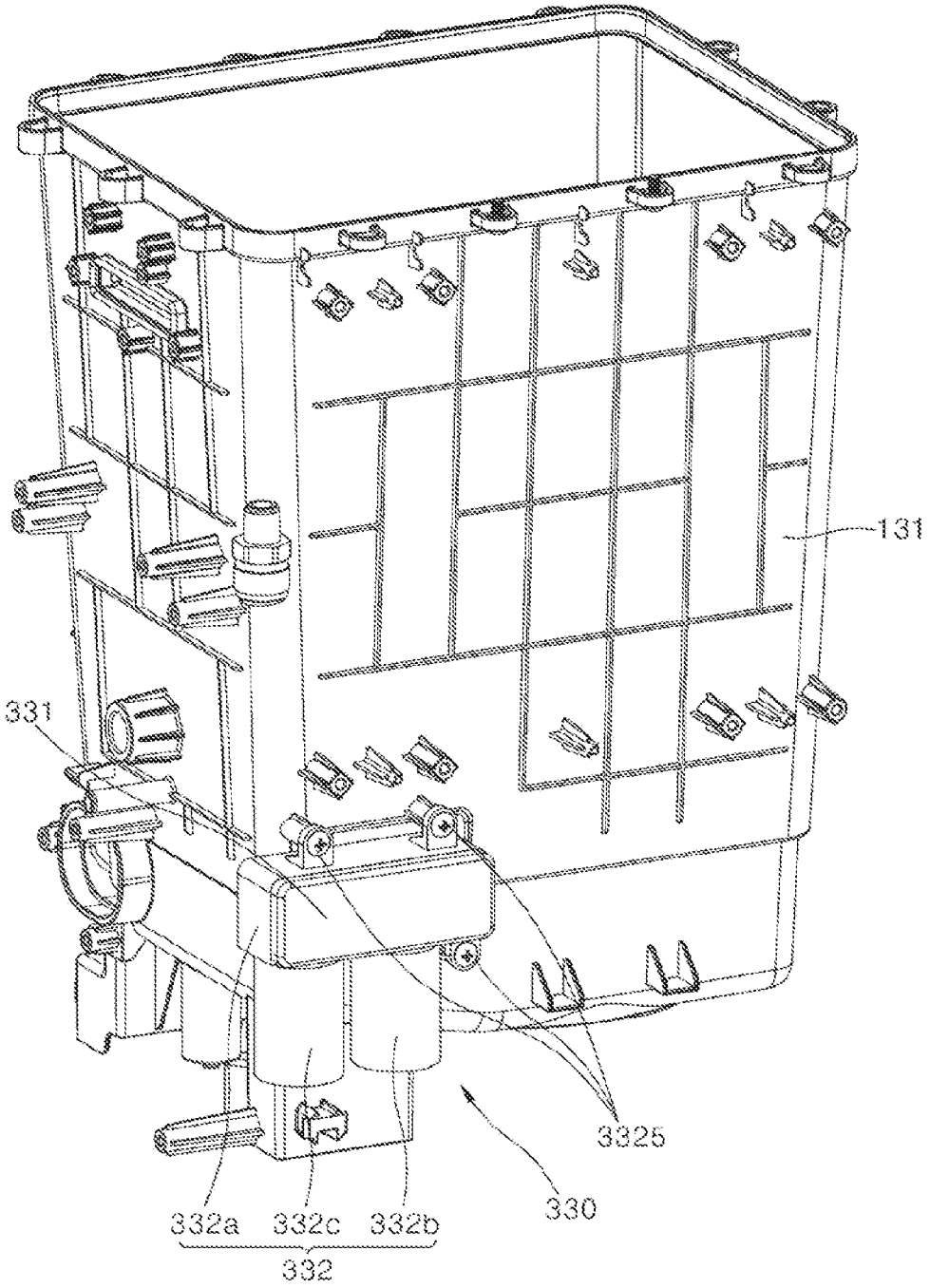
FIG. 66 is a view illustrating a state in which the tub is coupled to a pipe assembly according to one embodiment.

FIG. 65 is a perspective view illustrating a portion of the washing unit 130. FIG. 66 is a view illustrating a state in which the tub is coupled to a pipe assembly 330 according to one embodiment. The cup washer may include the pipe assembly 330 connected to an outlet of the drain pump 135.

The pipe assembly 330 may be coupled to the outer surface of the sidewall of the tub 131 and connected to the drain pump 135 and the drainpipe, and a flow path through which water flowing into the drain pump 135 flows may be formed in the pipe assembly 330.

The pipe assembly 330 may be disposed between the drain pump 135 and the drainpipe in consideration of the flow path of water. The pipe assembly 330 may be connected to each of the drain pump 135 and the drainpipe through hoses.

For example, a first hose H1 may connect the drain pump 135 to the pipe assembly 330, and a second hose 112 may connect the pipe assembly 330 to the drainpipe. When the drain pump 135 is operated, water collected in the sump 133 may flow through the pipe assembly 330 via the drain pump 135 and may be discharged through the drainpipe.

The pipe assembly 330 may be coupled to the sidewall of the tub 131 disposed above the drain pump 135. Therefore, the pipe assembly 330 may be disposed above the drain pump 135.

In addition, the pipe assembly 330 may be disposed on a second floor, that is, an upper portion of the cup washer, and the drainpipe may be disposed on a first floor, that is, a lower portion of the cup washer. Therefore, the pipe assembly 330 may be disposed above the drainpipe.

The drainpipe may be commonly connected to a plurality of cup washers or connected to another home appliance, such as a water purifier through which water flows. Therefore, water discharged from another device may flow into the cup washer through the drainpipe.

Therefore, in the cup washer according to the embodiment, water flows back from the drainpipe to the drain pump 135, and thus contaminated water in the drainpipe may flow into the drain pump 135 and the sump 133. It is necessary to prevent this backflow.

In the embodiment, the pipe assembly 330 may be disposed between the drainpipe and the drain pump 135, and the pipe assembly 330 may be disposed at a higher position than the drain pump 135. In other words, the pipe assembly 330 may function to increase a height at which the water flowing back from the drainpipe to the drain pump 135 should move up in order to reach the drain pump 135.

For example, when there is no pipe assembly 330, a height difference between the drainpipe and the drain pump 135 is slightly small. In this case, when a pressure of the drainpipe is slightly high, the water in the drainpipe may easily flow back toward the drain pump 135.

In the embodiment, the pipe assembly 330 may be disposed at a significantly higher position than the drain pump 135, and the pipe assembly 330 may be connected to the drainpipe and the drain pump 135. Therefore, a height between the drainpipe and the pipe assembly may be significantly higher than a height between the drainpipe and the drain pump 135.

Therefore, in order for the water in the drainpipe to flow back and flow into the drain pump 135, the pressure of the water in the drainpipe should be high enough to move up to the pipe assembly 330 at a significantly higher position than the drain pump 135.

Therefore, since it is difficult for water in the drainpipe having substantially a pressure slightly higher than or equal to atmospheric pressure to exceed the height up to the pipe assembly 330, the water in the drainpipe may not exceed the pipe assembly 330 and may not enter the drain pump 135, and thus it is possible to very effectively suppress the backflow of water from the drainpipe to the drain pump 135.

In the embodiment, the pipe assembly 330 may raise a position of a portion of the discharge line of the water connected to the outlet of the drain pump 135 to prevent the water flowing from the drainpipe to the drain pump 135 from exceeding the height of the pipe assembly 330, thereby effectively suppressing the backflow of the contaminated water from the drainpipe to the drain pump 135.

Figure 67:
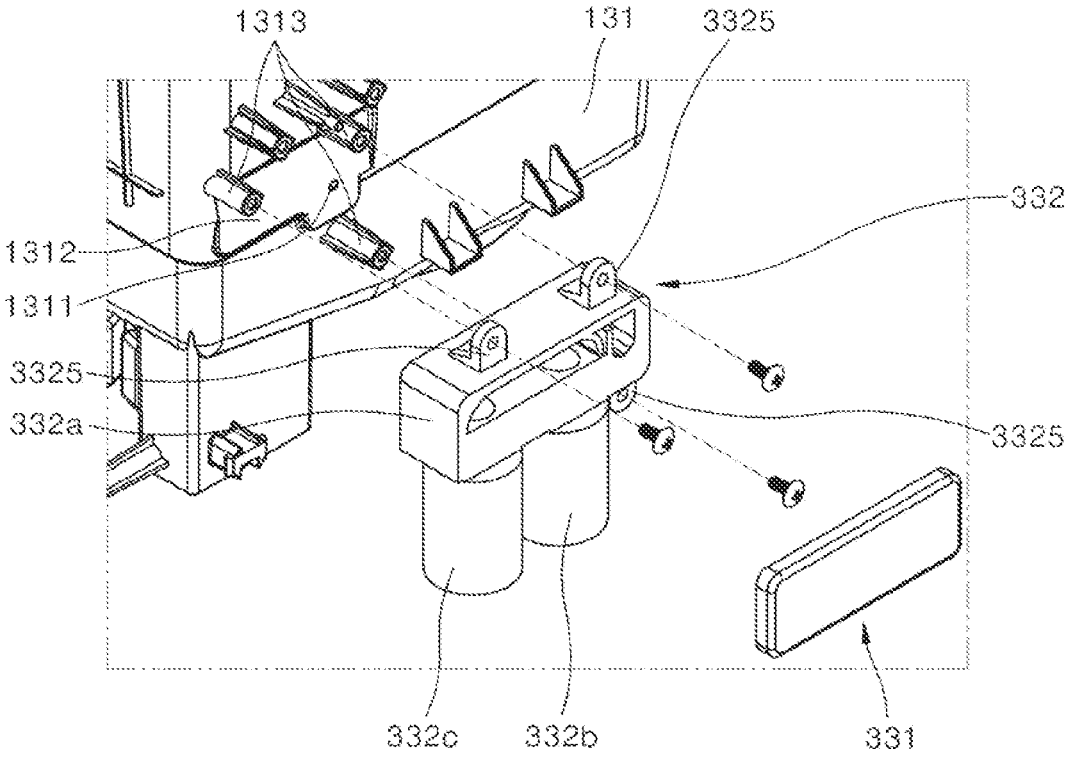
FIG. 67 is a view illustrating a disassembled state of the pipe assembly in FIG. 66.
Figure 68:
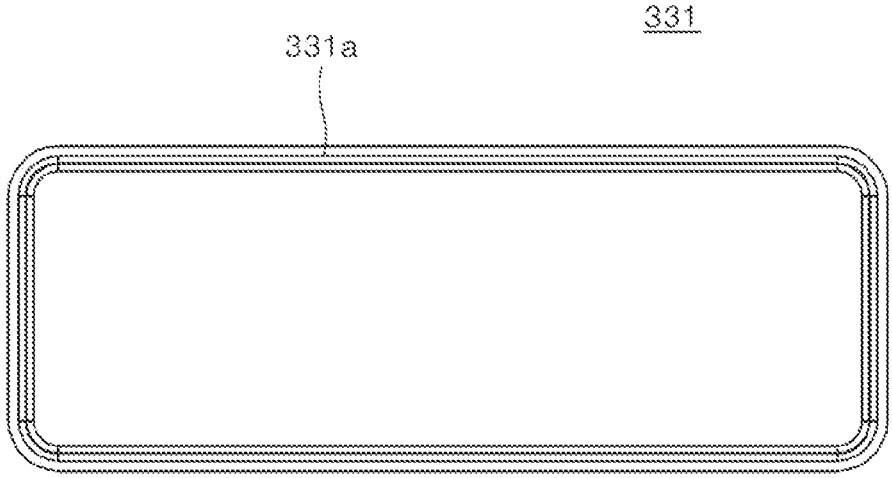
FIG. 68 is a rear view illustrating an assembly cover according to one embodiment.
Figure 69:
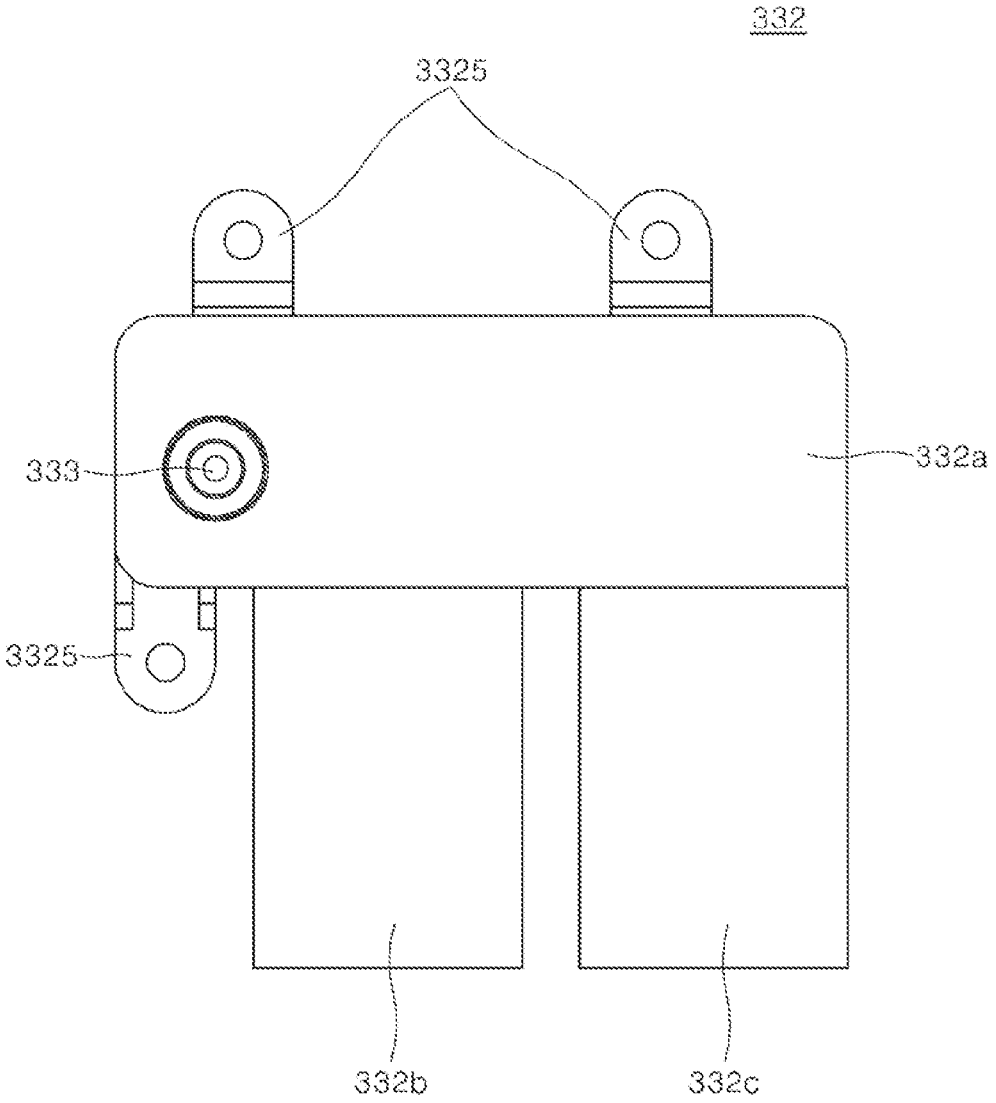
FIG. 69 is a rear view illustrating an assembly body according to one embodiment.

FIG. 67 is a view illustrating a disassembled state of the pipe assembly 330 in FIG. 66. FIG. 68 is a rear view illustrating an assembly cover 331 according to one embodiment. FIG. 69 is a rear view illustrating an assembly body 332 according to one embodiment.

The drainpipe may be disposed at a lower position than the drain pump 135. Therefore, when the flow path of water between the outlet of the drain pump 135 and an inlet of the drainpipe is filled with water, all the water inside the drain pump 135 may be discharged through the drainpipe by a siphon phenomenon. At this time, the water collected in the sump 133 connected to the drain pump 135 may also be discharged through the drainpipe.

Therefore, when the siphon phenomenon occurs, all the water collected in the washing unit 130 may be discharged through the drainpipe when the circulation pump is operated, thereby making it impossible to wash the cup. Therefore, only when the water collected in the sump 133 needs to be drained, that is, when the drain pump 135 is operated, a device for preventing the siphon phenomenon, that is, a siphon breaker, is required so that the water in the tub 131, the sump 133, and the drain pump 135 may be discharged through the drainpipe.

In the embodiment, the pipe assembly 330 may be used as the siphon breaker. In order to prevent the siphon phenomenon, the pipe assembly 330 may have a hole through which air is introduced.

It is possible to effectively prevent the siphon phenomenon caused by the fact that air flows into the flow path of the water in the pipe assembly 330 through such a hole and the flow path is filled with water. Hereinafter, a structure of the hole through which air flows into the pipe assembly 330 will be described in detail.

The tub 131 may include a first through hole 1311 formed to pass through the side wall thereof, and the pipe assembly 330 may include a second through hole connected to the first through hole 1311. The first through hole 1311 and the second through hole may be disposed at positions corresponding to each other, and the air inside the tub 131 may flow into the pipe assembly 330 through the first through hole 1311 and the second through hole.

Since the water in the tub 131 flows into the pipe assembly 330 through the first through hole 1311 and the second through hole when a water level of the tub 131 is higher than the first through hole 1311, the siphon phenomenon may be maintained inside the pipe assembly 330 because the pipe assembly 330 is still filled with water.

However, since air flows into the pipe assembly 330 through the first through hole 1311 and the second through hole when the water level of the tub 131 is the same as or lower than the first through hole 1311, the water flowing into the pipe assembly 330 by the air introduced by the pipe assembly 330 and the water discharged from the pipe assembly 330 may be separated, and thus it is possible to block the occurrence of the siphon phenomenon.

Therefore, when the water level in the tub 131 is lower than or equal to the first through hole 1311, water is not discharged from the drain pump 135 to the drainpipe, the water level in the tub 131 may be maintained, and water may be contained in the sump 133 and the drain pump 135 disposed under the tub 131 without being discharged.

In the embodiment, the first through hole 1311 is formed in the tub 131, the second through hole is formed in the pipe assembly 330, and air flows into the pipe assembly 330 through the first through hole 1311 and the second through hole to prevent the occurrence of the siphon phenomenon in the drain line connected to the drain pump 135, thereby maintaining the water level set inside the tub 131 when the drain pump 135 is not operated.

Therefore, it is possible to effectively wash the cup using the circulation pump after collecting water in the tub.

The pipe assembly 330 may include the assembly body 332 and the assembly cover 331. The assembly body 332 may be coupled to the tub 131 and formed with a flow path through which water flows. The assembly body 332 may be coupled to the outer surface of the sidewall of the tub 131, for example, by a fastener such as a screw.

A plurality of device coupling portions 3325 protruding from an edge of the assembly body 332 and having holes to which fasteners are fastened may be provided on the assembly body 332. The appropriate number of device coupling portions 3325 may be disposed at appropriate positrons.

The tub 131 may include a plurality of device coupling protrusions 1313 protruding from the sidewall of the tub 131 at positions corresponding to the device coupling portions 3325 and having holes to which fasteners are fastened. The number of device coupling protrusions 1313 may be provided to be the same as the number of device coupling portions 3325.

The assembly cover 331 may be coupled to the assembly body 332 to cover an exposed portion of the assembly body 332. For example, the pipe assembly 330 may be made of a plastic material that is easily injection-molded.

However, as described below, a space forming portion **332*a* having a relatively complicated shape may be provided in the assembly body 332. Therefore, in order to form the space forming portion, the assembly body 332 and the assembly cover 331 may each be separately manufactured by injection-molding and coupled to finally complete the pipe assembly 330**, thereby reducing a manufacturing cost and the occurrence of product defects.

The pipe assembly 330 may be ultimately completed by coupling the assembly cover 331 to the assembly body 332 to integrate the assembly cover 331 and the assembly body 332. To this end, the assembly cover 331 may be fixedly coupled to the assembly body 332 by a thermal fusion method.

As illustrated in FIG. 68, a thermal fusion portion 331*a* may be formed on a rear surface of the assembly cover 331, that is, a surface thermally fused to the assembly body 332. The thermal fusion portion 331*a* may protrude from the assembly cover 331 and may be formed entirely in a shape corresponding to an edge of the assembly cover 331 adjacent to the edge of the assembly cover 331.

When the assembly cover 331 is in contact with the assembly body 332 and heat is applied to the assembly cover 331 and/or the assembly body 332, the thermal fusion portion 331*a* may melt and may be fused to the assembly body 332. Therefore, the assembly cover 331 and the assembly body 332 may be integrally coupled.

A pair of openings 3301*a* (see FIG. 72) for connection with the drain pump 135 and the drainpipe may be formed in the space forming portion 332*a* of the assembly body 332. When a thermal fusion operation is performed, a periphery of the opening 3301*a* may be heated and thus the opening 3301*a* may be deformed.

In order to suppress the deformation of the opening 3301*a*, a fusion surface of the assembly body 332, which is heated to be fused in contact with the assembly cover 331, needs to be disposed at a position as far as possible from the opening 3301*a*.

The tub 131 may include a coupling surface 1312 formed on a portion of the sidewall to which the assembly body 332 is coupled, formed by recessing at least a portion of the sidewall, and formed with the first through hole 1311.

When a gap is present between surfaces of the sidewall of the tub 131 and the assembly body 332 in contact with each other, water passing through the first through hole 1311 and the second through hole may be discharged through the gap. In order to block the discharge of water, the coupling surface 1312 that is recessed and entirely flat may be formed in the tub 131, and a rear surface of the assembly body may be in contact with the coupling surface 1312, thereby effectively suppressing the above-described gap.

Meanwhile, since the tub 131 has a structure inclined in substantially a vertical direction, the coupling surface 1312 may be formed by recessing at least a portion of the sidewall of the tub 131 so that the pipe assembly 330 is vertically disposed rather than being disposed to be inclined in the vertical direction of the tub 131.

Figure 70:
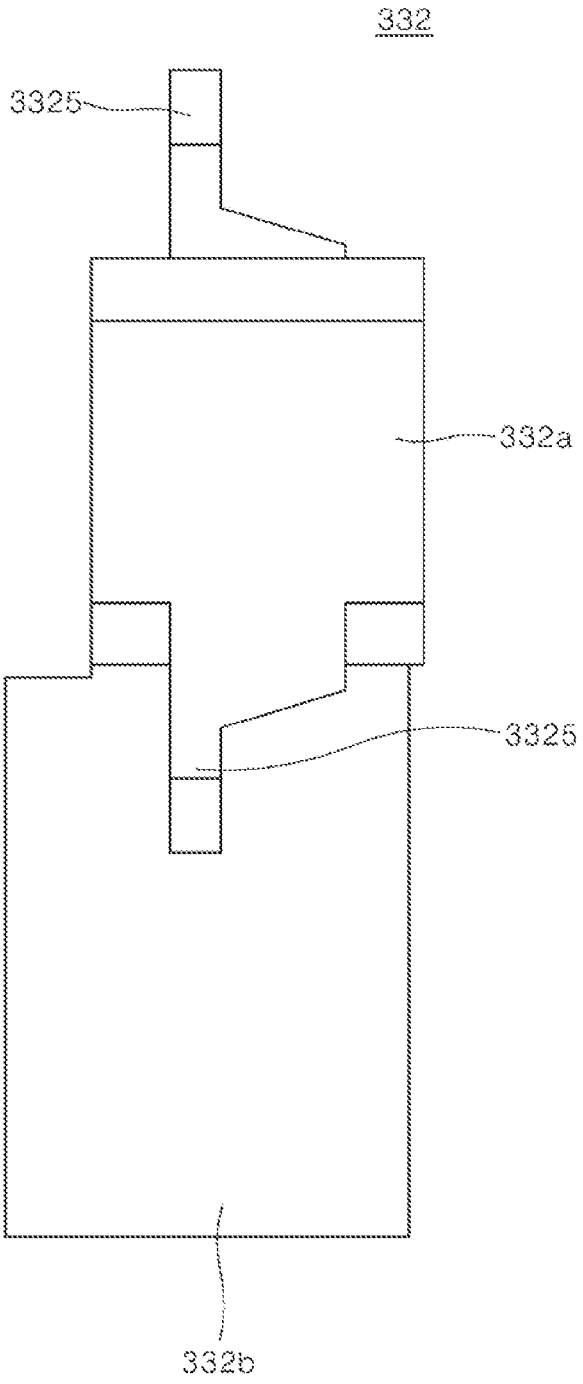
FIG. 70 is a side view illustrating the assembly body according to one embodiment.
Figure 71:
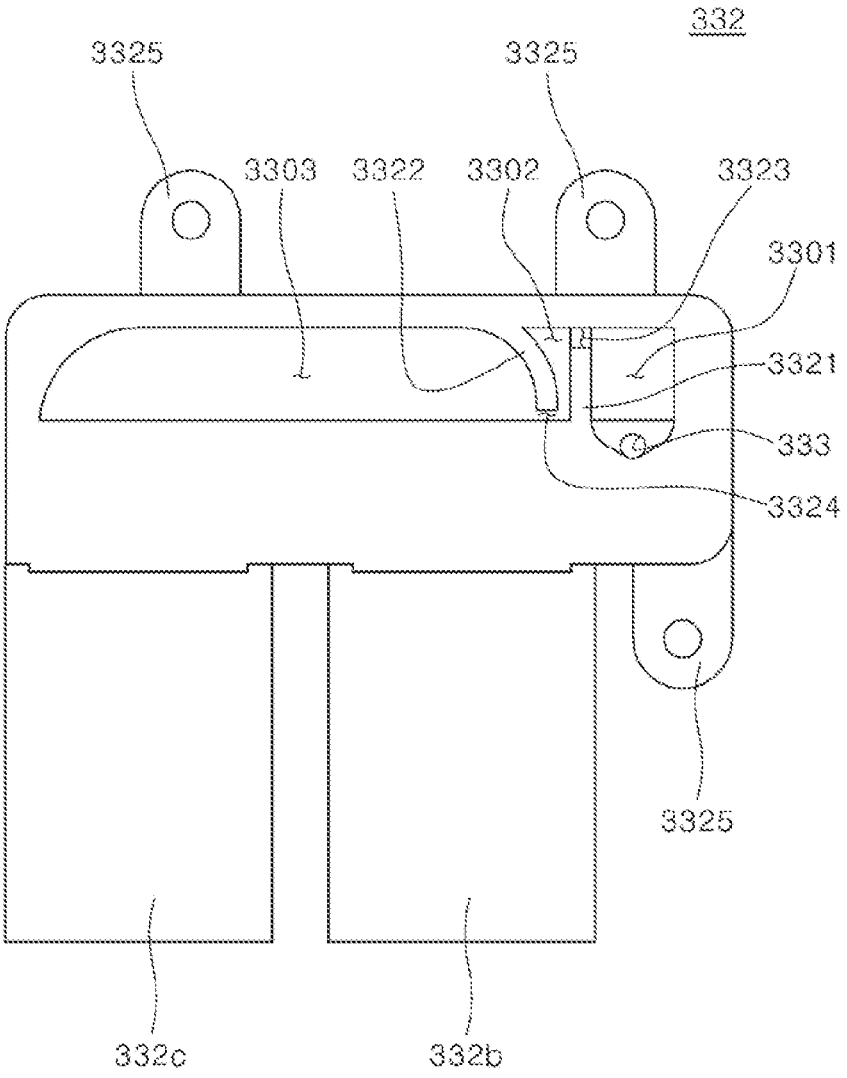
FIG. 71 is a front view illustrating the assembly body according to one embodiment.
Figure 72:
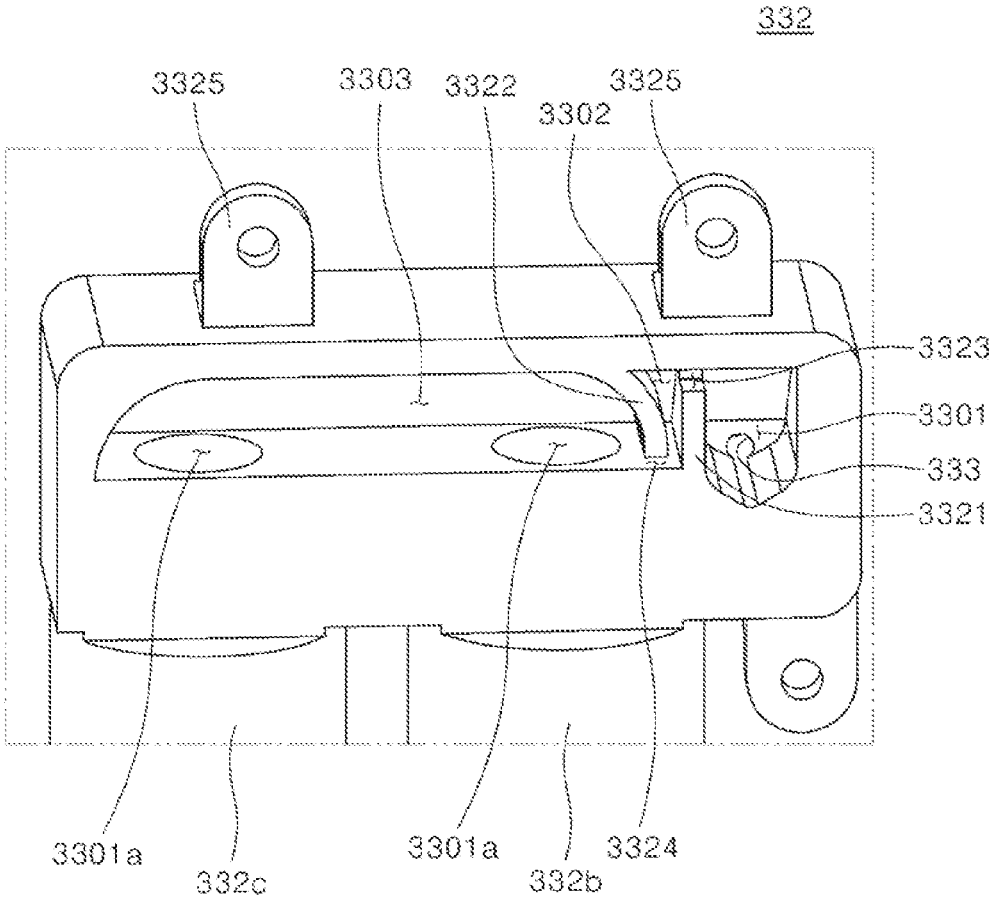
FIG. 72 is a perspective view illustrating a portion of the assembly body of FIG. 71.

FIG. 70 is a side view illustrating the assembly body 332 according to one embodiment. FIG. 71 is a front view illustrating the assembly body 332 according to one embodiment. FIG. 72 is a perspective view illustrating a portion of the assembly body 332 of FIG. 71.

The assembly body 332 may include the space forming portion 332*a*, a first flow pipe 332*b*, and a second flow pipe 332*c*. The space forming portion 332*a* may be connected to the first flow pipe 332*b* and the second flow pipe 332*c* through each of a pair of openings 3301*a*.

The space forming portion 332*a* may be formed as a space therein and formed with the second through hole. In the space forming portion 332*a*, water may come into contact with air flowing into the pipe assembly 330 from the tub 131 through the first through hole 1311 and the second through hole.

The first flow pipe 332*b* may protrude to the outside of the space forming portion 332*a*, allow water to flow therethrough, and may be connected to the drain pump 135. The first flow pipe 332*b* and the drain pump 135 may be connected, for example, by the first hose H1.

The second flow pipe 332*c* may protrude to the outside of the space forming portion 332*a*, allow water to flow therethrough, may be disposed to be spaced apart from the first flow pipe 332*b*, and connected to the drainpipe. The second flow pipe 332*c* and the drainpipe may be connected, for example, by the second hose H2.

The space forming portion 332*a* may include a first region 3301 and a second region 3302. The first region 3301 may be provided as a space and connected to the second through hole. The second through hole may be formed to pass through the assembly body 332 and connected to the first region 3301.

The second region 3302 may be provided as a space and connected to the first flow pipe 332*b* and the second flow pipe 332*c*. The first region 3301 and the second region 3302 are connected so that the air in the tub 131 may come into contact with the water flowing in the second region 3302 after passing through the first through hole 1311, the second through hole, the first region 3301, and the second region 3302.

Meanwhile, since the water flowing into the space forming portion 332*a* has a pressure higher than atmospheric pressure when the drain pump 135 is operated, the water may flow in the first region 3301 and also sequentially flow through the second through hole and the first through hole 1311 to flow into the tub 131.

Since the water drained by the drain pump 135 is contaminated water containing foreign substances after washing the cup, when this water re-flows into the tub 131, the inside of the tub 131 and the cup accommodated in the tub 131 may be contaminated.

Of course, although the inflow of water into the tub 131 from the space forming portion 332*a* is structurally unavoidable, it is necessary to minimize the amount of contaminated water flowing into the tub 131. When the first region 3301 and the second region 3302 are not separated and there is no obstacle therebetween, the amount of contaminated water flowing into the tub 131 from the pipe assembly 330 may increase, and in order to reduce this, in the embodiment, the following structure may be provided.

The space forming portion 332*a* may include a third region 3303, a first diaphragm 3321, and a second diaphragm 3322. The third region 3303 may be provided as a space and disposed between the first region 3301 and the second region 3302. In other words, by arranging the third region 3303 between the first region 3301 and the second region 3302, it is possible to slightly block the water in the second region 3302 from easily flowing to the first region 3301.

The first diaphragm 3321 may be disposed between the first region 3301 and the second region 3302 to separate the first region 3301 and the second region 3302. A first through space 3323 to be described below may be formed in the first diaphragm 3321 so that the first region 3301 and the second region 3302 may be connected.

The second diaphragm 3322 may be disposed between the second region 3302 and the third region 3303 to separate the first region 3301 and the second region 3302. A second through space 3324 to be described below may be formed in the second diaphragm 3322 so that the second region 3302 and the third region 3303 may be connected.

The first region 3301 and the second region 3302 may be separated by the third region 3303 and the first diaphragm 3321 and the second diaphragm 3322 disposed at both sides of the third region 3303, and the first diaphragm 3321 and the second diaphragm 3322 may act as obstacles, and thus effectively hinder the flow of water.

Therefore, the amount of water in the second region 3302 flowing to the first region 3301 may be significantly reduced, and thus the amount of water discharged through the second through hole connected to the first region 3301 may be significantly reduced, thereby significantly reducing the contaminated water flowing into the tub 131.

The space forming portion may include the first through space 3323 and the second through space 3324. The first through space 3323 may be formed to pass through the first diaphragm and may connect the first region 3301 to the third region 3303. The second through space 3324 may be formed to pass through the second diaphragm 3322 and may connect the second region 3302 to the third region 3303.

The air flowing into the first region 3301 from the tub 131 may flow into the second region 3302 through the first through space 3323 and the second through space 3324 to separate water in the second region 3302, thereby blocking the siphon phenomenon.

Meanwhile, in order to minimize the amount of water in the pipe assembly 330 flowing into the tub 131, the space forming portion 332*a* may be appropriately disposed entirely in a labyrinth shape.

Therefore, in the embodiment, the second through hole may be disposed in a lower portion of the first region 3301, the first through space 3323 may be formed in upper portions of the first region 3301 and the third region 3303, and the second through space 3324 may be formed in lower portions of the second region 3302 and the third region 3303.

With this structure, the space forming portion 332*a* entirely has a labyrinth-shaped structure, and thus an obstacle having a complicated structure may be disposed on the flow path through which the water in the first region 3301 flows into the tub 131 through the second through hole, and thus it is possible to minimize the amount of contaminated water in the pipe assembly 330 flowing into the tub 131. Therefore, it is possible to effectively suppress the contaminated water from flowing into the tub 131 through the first through hole 1311 and contaminating the cup accommodated in the tub 131.

In addition, as illustrated in FIG. 71, forming directions of the second through hole and the first through space 3323 may be provided to cross each other. In FIG. 71, the second through hole may be formed in a front-rear direction of the pipe assembly 330, and the first through space 3323 may be formed in a lateral direction of the pipe assembly 330.

As described above, since the forming directions of the second through hole and the first through space 3323 are provided to cross each other and thus flowing directions are changed when water sequentially flows through the first through space 3323 and the second through hole, it is possible to suppress the flow of the water, thereby minimizing the amount of contaminated water in the pipe assembly 330 flowing into the tub 131.

Meanwhile, it is necessary to suppress the contamination of the cup by suppressing the water flowing into the tub 131 through the first through hole 1311 from directly hitting the cup disposed in the tub 131. For example, by arranging some wires of the rack 400 between the cup and the first through hole 1311 to prevent the cup from being directly disposed at a position at which the first through hole 1311 faces to allow the contaminated water introduced from the first through hole 1311 to hit the rack 400 and suppress the contaminated water from directly hitting the cup, it is possible to effectively suppress the cup from being contaminated by the contaminated water flowing into the tub 131 from the first through hole 1311.

Although the present disclosure has been described above with reference to the exemplary drawings, the present disclosure is not limited by the embodiments and drawings disclosed in the specification, and it is apparent that various modifications can be made by those skilled in the art within the scope of the technical spirit of the present disclosure. In addition, even when the operational effects according to the configuration of the present disclosure have not been explicitly described in the description of the embodiments of the present disclosure, it goes without saying that the effects predictable by the corresponding configuration should be recognized.

What is claimed is:

1. A cup washer comprising:

a base plate;

a water tank disposed on the base plate to store water therein; and a washing unit disposed above the water tank, the washing unit being configured to wash a cup accommodated therein, the washing unit including a tub having a space to accommodate the cup therein, the tub having an opening in an upper portion thereof; and a door located at the tub, wherein the door is configured to rotate upward from the tub to open the opening.

2. The cup washer of claim 1, wherein the tub is located in an upper portion of the cup washer.

3. The cup washer of claim 2, wherein the washing unit further includes:

a sump connected to the tub, the sump being configured to store water received from the tub; and a circulation pump connecting the tub to the sump, the circulation pump being configured to circulate water between the tub and the sump.

4. The cup washer of claim 3, wherein the sump and the circulation pump are located between the tub and the water tank.

5. The cup washer of claim 2, further comprising:

a drying module connected to the tub, the drying module being configured to blow heated air into the tub; and a liquid input module configured to input at least one of detergent or rinse into the tub.

6. The cup washer of claim 5, wherein the drying module and the liquid input module are located behind the tub.

7. The cup washer of claim 5, wherein the liquid input module includes:

a detergent storage configured to store the detergent;

a rinse storage disposed separately from the detergent storage, the rinse storage being configured to store the rinse;

a detergent injector connecting the detergent storage to the tub, the detergent injector being configured to inject the detergent into the tub;

a rinse injector connecting the rinse storage to the tub, the rinse injector being configured to inject the rinse into the tub;

a detergent pump connected to the detergent injector, the detergent pump being configured to pump the detergent to the tub; and a rinse pump connected to the rinse injector, the rinse pump being configured to pump the rinse to the tub.

8. The cup washer of claim 2, further comprising:

an intermediate plate located above the water tank;

a circuit board located behind the water tank, the circuit board including a controller configured to control an operation of the cup washer; and a board support coupled to the circuit board, the board support extending between the base plate and the intermediate plate.

9. The cup washer of claim 8, further comprising a supply pipe configured to supply at least one of detergent or rinse to the tub, wherein the circuit board and the supply pipe are spaced apart from the water tank and the washing unit behind the water tank.

10. The cup washer of claim 1, further comprising a top cover located on the upper portion of the tub, wherein the door is rotatably coupled to the top cover.

11. The cup washer of claim 1, wherein the washing unit further includes:

a rack located in the tub to support the cup accommodated therein; and a link connecting the rack to the door such that the rack is lifted upwards when the door is rotated upwards.

12. The cup washer of claim 1, further comprising:

a frame supported by the base plate;

a front panel coupled to the frame to cover the water tank; and a rear panel coupled to the frame at a rear of the cup washer.

13. The cup washer of claim 12, wherein the frame includes:

a pair of front supports located at a front of the cup washer, the pair of front supports being coupled to the base plate;

a pair of rear supports located at the rear of the cup washer, the pair of rear supports being coupled to the base plate; and a pair of intermediate supports located between the pair of front supports and the pair of rear supports, the pair of intermediate supports being coupled to the base plate.

14. The cup washer of claim 13, wherein the front panel includes:

a first wall defining a front of the cup washer;

a pair of second walls extending from opposite ends of the first wall;

first coupling protrusions protruding from free ends of each of the second walls, the first coupling protrusions being coupled to a corresponding rear support of the pair of rear supports; and second coupling protrusions protruding from upper end portions of the first wall and the second walls, the second coupling protrusions being configured to suppress separation of the front panel from the cup washer.

15. The cup washer of claim 14, wherein each of the second coupling protrusions includes:

a fitting portion; and a hook surrounded by the fitting portion, the hook having a V-shaped cross section, the hook being elastically deformable.

16. A cup washer comprising:

a base plate;

a water tank located on the base plate;

a tub located above the water tank, the tub having a space to accommodate a cup therein, the tub having an opening in an upper portion thereof;

a door located at the tub; and an intermediate plate located between the water tank and the tub to partition the water tank from the tub, the intermediate plate being configured to support the tub, wherein the door is configured to rotate upward from the tub to open the opening.

17. The cup washer of claim 16, further comprising:

a frame supported by the base plate, the frame being configured to support the intermediate plate;

a front panel coupled to the frame to cover the water tank and the tub;

a rear panel coupled to the frame at a rear of the cup washer; and at least one exterior part coupled to the rear panel.

18. The cup washer of claim 17, wherein the frame includes:

a pair of front supports located at a front of the cup washer, the pair of front supports being coupled to the base plate; and a pair of rear supports located at the rear of the cup washer, the pair of rear supports being coupled to the base plate, wherein the at least one exterior part includes two exterior parts configured to cover portions of the rear supports.

* * * * *